US009892598B2

(12) United States Patent
Kitamura et al.

(10) Patent No.: US 9,892,598 B2
(45) Date of Patent: Feb. 13, 2018

(54) GAMING MACHINE FOR RUNNING NORMAL GAME AND FREE GAME

(71) Applicants: Universal Entertainment Corporation, Tokyo (JP); Aruze Gaming America, Inc., Las Vegas, NV (US)

(72) Inventors: Kenta Kitamura, Tokyo (JP); Susumu Mio, Tokyo (JP); Kazunori Ohtsuka, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 179 days.

(21) Appl. No.: 14/697,791

(22) Filed: Apr. 28, 2015

(65) Prior Publication Data

US 2015/0325083 A1 Nov. 12, 2015

(30) Foreign Application Priority Data

May 9, 2014 (JP) ..... 2014-098131

(51) Int. Cl.
*G07F 17/32* (2006.01)
*G07F 17/34* (2006.01)

(52) U.S. Cl.
CPC ..... *G07F 17/34* (2013.01); *G07F 17/3213* (2013.01); *G07F 17/3244* (2013.01); *G07F 17/3267* (2013.01); *G07F 17/326* (2013.01)

(58) Field of Classification Search
CPC .... G07F 17/32; G07F 17/3244; G07F 17/326; G07F 17/34
USPC ..... 463/16, 20, 21, 22, 25
See application file for complete search history.

(56) References Cited

U.S. PATENT DOCUMENTS

| | | | | |
|---|---|---|---|---|
| 4,097,048 | A | 6/1978 | Poulsen et al. | |
| 4,508,345 | A | 4/1985 | Okada | |
| 6,203,429 | B1 * | 3/2001 | Demar | G07F 17/34 273/143 R |
| 6,234,897 | B1 * | 5/2001 | Frohm | G07F 17/32 273/143 R |
| 6,565,436 | B1 * | 5/2003 | Baerlocher | G07F 17/32 463/20 |
| 7,942,733 | B2 | 5/2011 | Sakuma | |
| 2004/0147306 | A1 * | 7/2004 | Randall | G07F 17/32 463/20 |
| 2006/0084494 | A1 * | 4/2006 | Belger | G07F 17/3265 463/20 |
| 2006/0160620 | A1 * | 7/2006 | Matthews | G07F 17/32 463/42 |
| 2013/0065663 | A1 * | 3/2013 | Johnson | G07F 17/3213 463/20 |

* cited by examiner

*Primary Examiner* — William H McCulloch, Jr.
*Assistant Examiner* — Chase Leichliter
(74) *Attorney, Agent, or Firm* — Lex IP Meister, PLLC

(57) ABSTRACT

It is an object of the present invention to provide a gaming machine that offers wider applicability and more enjoyment. To this end, a slot machine 1 configured to run a normal game and a free game which develops from the normal game, includes a storage device storing a free game payout table and a normal game payout table, wherein a maximum payout obtainable in the normal game is higher than a maximum payout obtainable in the free game, and a chance of winning the maximum payout in the normal game is higher than a chance of winning the maximum payout in the free game.

8 Claims, 51 Drawing Sheets

FIG.6 V01

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 10 | WILD1 | 2 | WILD1 | 2 | WILD1 | 2 | WILD1 | 2 |
| 1 | BLANK | 10 | WILD2 | 1 | WILD2 | 1 | WILD2 | 1 | WILD2 | 2 |
| 2 | 3BAR | 10 | WILD3 | 2 | WILD3 | 3 | WILD3 | 2 | WILD3 | 2 |
| 3 | BLANK | 9 | BLANK | 3 | BLANK | 6 | BLANK | 4 | BLANK | 2 |
| 4 | 1BAR | 11 | 3BAR | 5 | 2BAR | 8 | 3BAR | 10 | 1BAR | 20 |
| 5 | BLANK | 9 | BLANK | 8 | BLANK | 4 | BLANK | 4 | BLANK | 20 |
| 6 | RED7 | 5 | RED7 | 3 | RED7 | 3 | RED7 | 5 | RED7 | 10 |
| 7 | BLANK | 3 | BLANK | 2 | BLANK | 3 | BLANK | 3 | BLANK | 10 |
| 8 | BLUE7 | 4 | BLUE7 | 3 | BLUE7 | 3 | BLUE7 | 4 | BLUE7 | 10 |
| 9 | BLANK | 9 | BLANK | 2 | BLANK | 2 | BLANK | 4 | BLANK | 20 |
| 10 | 1BAR | 10 | 1BAR | 5 | 1BAR | 1 | 2BAR | 4 | 3BAR | 30 |
| 11 | BLANK | 9 | BLANK | 3 | BLANK | 6 | BLANK | 10 | BLANK | 25 |
| 12 | 3BAR | 10 | 2BAR | 3 | 3BAR | 6 | 1BAR | 11 | 2BAR | 35 |
| 13 | BLANK | 2 | BLANK | 3 | BLANK | 2 | BLANK | 4 | BLANK | 20 |
| 14 | BLUE7 | 6 | RED7 | 6 | RED7 | 5 | RED7 | 4 | BLUE7 | 20 |
| 15 | BLANK | 5 | BLANK | 5 | BLANK | 5 | BLANK | 4 | BLANK | 20 |
| 16 | RED7 | 6 | BLUE7 | 6 | BLUE7 | 5 | BLUE7 | 4 | RED7 | 20 |
| 17 | BLANK | 15 | BLANK | 8 | BLANK | 3 | BLANK | 16 | BLANK | 2 |
| 18 | BONUS | 21 | BONUS | 9 | BONUS | 5 | BONUS | 34 | BONUS | 1 |
| 19 | BLANK | 14 | BLANK | 8 | BLANK | 4 | BLANK | 46 | BLANK | 3 |
| 20 | 1BAR | 18 | 1BAR | 11 | 1BAR | 3 | 2BAR | 12 | 3BAR | 20 |
| 21 | BLANK | 10 | BLANK | 2 | BLANK | 6 | BLANK | 4 | BLANK | 20 |
| TOTAL | | 206 | | 100 | | 86 | | 192 | | 314 |

FIG.7 V02

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 11 | WILD1 | 2 | WILD1 | 2 | WILD1 | 2 | WILD1 | 2 |
| 1 | BLANK | 10 | WILD2 | 1 | WILD2 | 1 | WILD2 | 1 | WILD2 | 2 |
| 2 | 3BAR | 10 | WILD3 | 2 | WILD3 | 3 | WILD3 | 2 | WILD3 | 2 |
| 3 | BLANK | 9 | BLANK | 3 | BLANK | 6 | BLANK | 4 | BLANK | 2 |
| 4 | 1BAR | 11 | 3BAR | 5 | 2BAR | 8 | 3BAR | 10 | 1BAR | 20 |
| 5 | BLANK | 9 | BLANK | 8 | BLANK | 4 | BLANK | 4 | BLANK | 20 |
| 6 | RED7 | 5 | RED7 | 3 | RED7 | 3 | RED7 | 5 | RED7 | 10 |
| 7 | BLANK | 3 | BLANK | 2 | BLANK | 3 | BLANK | 3 | BLANK | 10 |
| 8 | BLUE7 | 4 | BLUE7 | 3 | BLUE7 | 3 | BLUE7 | 4 | BLUE7 | 10 |
| 9 | BLANK | 9 | BLANK | 2 | BLANK | 2 | BLANK | 4 | BLANK | 20 |
| 10 | 1BAR | 10 | 1BAR | 5 | 1BAR | 1 | 2BAR | 4 | 3BAR | 30 |
| 11 | BLANK | 9 | BLANK | 3 | BLANK | 6 | BLANK | 10 | BLANK | 25 |
| 12 | 3BAR | 10 | 2BAR | 3 | 3BAR | 6 | 1BAR | 11 | 2BAR | 35 |
| 13 | BLANK | 2 | BLANK | 3 | BLANK | 2 | BLANK | 4 | BLANK | 20 |
| 14 | BLUE7 | 6 | RED7 | 6 | RED7 | 5 | RED7 | 4 | BLUE7 | 20 |
| 15 | BLANK | 6 | BLANK | 6 | BLANK | 4 | BLANK | 4 | BLANK | 20 |
| 16 | RED7 | 6 | BLUE7 | 6 | BLUE7 | 5 | BLUE7 | 4 | RED7 | 20 |
| 17 | BLANK | 14 | BLANK | 7 | BLANK | 3 | BLANK | 16 | BLANK | 2 |
| 18 | BONUS | 21 | BONUS | 9 | BONUS | 5 | BONUS | 34 | BONUS | 1 |
| 19 | BLANK | 14 | BLANK | 8 | BLANK | 5 | BLANK | 46 | BLANK | 3 |
| 20 | 1BAR | 18 | 1BAR | 11 | 1BAR | 3 | 2BAR | 12 | 3BAR | 20 |
| 21 | BLANK | 9 | BLANK | 2 | BLANK | 6 | BLANK | 4 | BLANK | 20 |
| TOTAL | | 206 | | 100 | | 86 | | 192 | | 314 |

FIG.8 V03

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 11 | WILD1 | 2 | WILD1 | 2 | WILD1 | 2 | WILD1 | 2 |
| 1 | BLANK | 9 | WILD2 | 1 | WILD2 | 1 | WILD2 | 1 | WILD2 | 2 |
| 2 | 3BAR | 11 | WILD3 | 2 | WILD3 | 3 | WILD3 | 2 | WILD3 | 2 |
| 3 | BLANK | 9 | BLANK | 3 | BLANK | 6 | BLANK | 4 | BLANK | 2 |
| 4 | 1BAR | 11 | 3BAR | 5 | 2BAR | 8 | 3BAR | 10 | 1BAR | 20 |
| 5 | BLANK | 9 | BLANK | 8 | BLANK | 4 | BLANK | 4 | BLANK | 20 |
| 6 | RED7 | 5 | RED7 | 3 | RED7 | 3 | RED7 | 5 | RED7 | 10 |
| 7 | BLANK | 3 | BLANK | 2 | BLANK | 3 | BLANK | 3 | BLANK | 10 |
| 8 | BLUE7 | 4 | BLUE7 | 3 | BLUE7 | 3 | BLUE7 | 4 | BLUE7 | 10 |
| 9 | BLANK | 9 | BLANK | 2 | BLANK | 2 | BLANK | 4 | BLANK | 20 |
| 10 | 1BAR | 10 | 1BAR | 5 | 1BAR | 1 | 2BAR | 4 | 3BAR | 30 |
| 11 | BLANK | 9 | BLANK | 3 | BLANK | 6 | BLANK | 10 | BLANK | 25 |
| 12 | 3BAR | 10 | 2BAR | 3 | 3BAR | 6 | 1BAR | 11 | 2BAR | 35 |
| 13 | BLANK | 2 | BLANK | 3 | BLANK | 2 | BLANK | 4 | BLANK | 20 |
| 14 | BLUE7 | 6 | RED7 | 6 | RED7 | 5 | RED7 | 4 | BLUE7 | 20 |
| 15 | BLANK | 5 | BLANK | 5 | BLANK | 4 | BLANK | 4 | BLANK | 20 |
| 16 | RED7 | 6 | BLUE7 | 6 | BLUE7 | 5 | BLUE7 | 4 | RED7 | 20 |
| 17 | BLANK | 15 | BLANK | 8 | BLANK | 3 | BLANK | 16 | BLANK | 2 |
| 18 | BONUS | 21 | BONUS | 9 | BONUS | 5 | BONUS | 34 | BONUS | 1 |
| 19 | BLANK | 14 | BLANK | 8 | BLANK | 5 | BLANK | 46 | BLANK | 3 |
| 20 | 1BAR | 18 | 1BAR | 11 | 1BAR | 3 | 2BAR | 12 | 3BAR | 20 |
| 21 | BLANK | 9 | BLANK | 2 | BLANK | 6 | BLANK | 4 | BLANK | 20 |
| TOTAL | | 206 | | 100 | | 86 | | 192 | | 314 |

FIG.9 V04

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 11 | WILD1 | 2 | WILD1 | 3 | WILD1 | 2 | WILD1 | 2 |
| 1 | BLANK | 10 | WILD2 | 1 | WILD2 | 1 | WILD2 | 1 | WILD2 | 2 |
| 2 | 3BAR | 11 | WILD3 | 2 | WILD3 | 3 | WILD3 | 2 | WILD3 | 2 |
| 3 | BLANK | 10 | BLANK | 3 | BLANK | 6 | BLANK | 4 | BLANK | 2 |
| 4 | 1BAR | 11 | 3BAR | 5 | 2BAR | 8 | 3BAR | 10 | 1BAR | 20 |
| 5 | BLANK | 9 | BLANK | 8 | BLANK | 4 | BLANK | 4 | BLANK | 20 |
| 6 | RED7 | 5 | RED7 | 2 | RED7 | 3 | RED7 | 5 | RED7 | 10 |
| 7 | BLANK | 3 | BLANK | 3 | BLANK | 3 | BLANK | 3 | BLANK | 10 |
| 8 | BLUE7 | 4 | BLUE7 | 3 | BLUE7 | 3 | BLUE7 | 4 | BLUE7 | 10 |
| 9 | BLANK | 9 | BLANK | 2 | BLANK | 2 | BLANK | 4 | BLANK | 20 |
| 10 | 1BAR | 10 | 1BAR | 5 | 1BAR | 1 | 2BAR | 4 | 3BAR | 30 |
| 11 | BLANK | 9 | BLANK | 3 | BLANK | 6 | BLANK | 10 | BLANK | 25 |
| 12 | 3BAR | 10 | 2BAR | 3 | 3BAR | 5 | 1BAR | 11 | 2BAR | 35 |
| 13 | BLANK | 2 | BLANK | 3 | BLANK | 2 | BLANK | 4 | BLANK | 20 |
| 14 | BLUE7 | 6 | RED7 | 6 | RED7 | 5 | RED7 | 4 | BLUE7 | 20 |
| 15 | BLANK | 6 | BLANK | 5 | BLANK | 5 | BLANK | 4 | BLANK | 20 |
| 16 | RED7 | 6 | BLUE7 | 6 | BLUE7 | 5 | BLUE7 | 4 | RED7 | 20 |
| 17 | BLANK | 15 | BLANK | 8 | BLANK | 3 | BLANK | 16 | BLANK | 2 |
| 18 | BONUS | 21 | BONUS | 9 | BONUS | 5 | BONUS | 34 | BONUS | 1 |
| 19 | BLANK | 14 | BLANK | 8 | BLANK | 5 | BLANK | 46 | BLANK | 3 |
| 20 | 1BAR | 15 | 1BAR | 11 | 1BAR | 3 | 2BAR | 12 | 3BAR | 20 |
| 21 | BLANK | 9 | BLANK | 2 | BLANK | 5 | BLANK | 4 | BLANK | 20 |
| TOTAL | | 206 | | 100 | | 86 | | 192 | | 314 |

FIG.10 V05

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 11 | WILD1 | 2 | WILD1 | 3 | WILD1 | 2 | WILD1 | 2 |
| 1 | BLANK | 10 | WILD2 | 1 | WILD2 | 1 | WILD2 | 1 | WILD2 | 2 |
| 2 | 3BAR | 11 | WILD3 | 3 | WILD3 | 3 | WILD3 | 2 | WILD3 | 2 |
| 3 | BLANK | 10 | BLANK | 3 | BLANK | 6 | BLANK | 4 | BLANK | 2 |
| 4 | 1BAR | 11 | 3BAR | 4 | 2BAR | 8 | 3BAR | 10 | 1BAR | 20 |
| 5 | BLANK | 9 | BLANK | 8 | BLANK | 4 | BLANK | 4 | BLANK | 20 |
| 6 | RED7 | 4 | RED7 | 2 | RED7 | 3 | RED7 | 5 | RED7 | 10 |
| 7 | BLANK | 3 | BLANK | 3 | BLANK | 3 | BLANK | 3 | BLANK | 10 |
| 8 | BLUE7 | 5 | BLUE7 | 3 | BLUE7 | 3 | BLUE7 | 4 | BLUE7 | 10 |
| 9 | BLANK | 9 | BLANK | 2 | BLANK | 2 | BLANK | 4 | BLANK | 20 |
| 10 | 1BAR | 10 | 1BAR | 5 | 1BAR | 1 | 2BAR | 4 | 3BAR | 30 |
| 11 | BLANK | 9 | BLANK | 3 | BLANK | 6 | BLANK | 10 | BLANK | 25 |
| 12 | 3BAR | 10 | 2BAR | 4 | 3BAR | 5 | 1BAR | 11 | 2BAR | 35 |
| 13 | BLANK | 2 | BLANK | 3 | BLANK | 2 | BLANK | 4 | BLANK | 20 |
| 14 | BLUE7 | 6 | RED7 | 5 | RED7 | 5 | RED7 | 4 | BLUE7 | 20 |
| 15 | BLANK | 6 | BLANK | 5 | BLANK | 5 | BLANK | 4 | BLANK | 20 |
| 16 | RED7 | 6 | BLUE7 | 6 | BLUE7 | 5 | BLUE7 | 4 | RED7 | 20 |
| 17 | BLANK | 15 | BLANK | 8 | BLANK | 3 | BLANK | 16 | BLANK | 2 |
| 18 | BONUS | 21 | BONUS | 9 | BONUS | 5 | BONUS | 34 | BONUS | 1 |
| 19 | BLANK | 14 | BLANK | 8 | BLANK | 5 | BLANK | 46 | BLANK | 3 |
| 20 | 1BAR | 15 | 1BAR | 10 | 1BAR | 3 | 2BAR | 12 | 3BAR | 20 |
| 21 | BLANK | 9 | BLANK | 3 | BLANK | 5 | BLANK | 4 | BLANK | 20 |
| TOTAL | | 206 | | 100 | | 86 | | 192 | | 314 |

FIG.11 V06

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 11 | WILD1 | 2 | WILD1 | 3 | WILD1 | 2 | WILD1 | 2 |
| 1 | BLANK | 10 | WILD2 | 1 | WILD2 | 1 | WILD2 | 1 | WILD2 | 2 |
| 2 | 3BAR | 11 | WILD3 | 3 | WILD3 | 4 | WILD3 | 2 | WILD3 | 2 |
| 3 | BLANK | 10 | BLANK | 3 | BLANK | 6 | BLANK | 4 | BLANK | 2 |
| 4 | 1BAR | 11 | 3BAR | 4 | 2BAR | 6 | 3BAR | 10 | 1BAR | 20 |
| 5 | BLANK | 9 | BLANK | 8 | BLANK | 4 | BLANK | 4 | BLANK | 20 |
| 6 | RED7 | 4 | RED7 | 2 | RED7 | 3 | RED7 | 5 | RED7 | 10 |
| 7 | BLANK | 3 | BLANK | 3 | BLANK | 3 | BLANK | 3 | BLANK | 10 |
| 8 | BLUE7 | 5 | BLUE7 | 3 | BLUE7 | 3 | BLUE7 | 4 | BLUE7 | 10 |
| 9 | BLANK | 9 | BLANK | 2 | BLANK | 2 | BLANK | 4 | BLANK | 20 |
| 10 | 1BAR | 10 | 1BAR | 5 | 1BAR | 1 | 2BAR | 4 | 3BAR | 30 |
| 11 | BLANK | 9 | BLANK | 3 | BLANK | 6 | BLANK | 10 | BLANK | 25 |
| 12 | 3BAR | 10 | 2BAR | 4 | 3BAR | 5 | 1BAR | 11 | 2BAR | 35 |
| 13 | BLANK | 2 | BLANK | 3 | BLANK | 2 | BLANK | 4 | BLANK | 20 |
| 14 | BLUE7 | 6 | RED7 | 5 | RED7 | 5 | RED7 | 4 | BLUE7 | 20 |
| 15 | BLANK | 6 | BLANK | 5 | BLANK | 5 | BLANK | 4 | BLANK | 20 |
| 16 | RED7 | 6 | BLUE7 | 6 | BLUE7 | 5 | BLUE7 | 4 | RED7 | 20 |
| 17 | BLANK | 15 | BLANK | 8 | BLANK | 3 | BLANK | 16 | BLANK | 2 |
| 18 | BONUS | 21 | BONUS | 9 | BONUS | 5 | BONUS | 34 | BONUS | 1 |
| 19 | BLANK | 14 | BLANK | 8 | BLANK | 5 | BLANK | 46 | BLANK | 3 |
| 20 | 1BAR | 15 | 1BAR | 10 | 1BAR | 3 | 2BAR | 12 | 3BAR | 20 |
| 21 | BLANK | 9 | BLANK | 3 | BLANK | 6 | BLANK | 4 | BLANK | 20 |
| TOTAL | | 206 | | 100 | | 86 | | 192 | | 314 |

FIG.12 V07

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 12 | WILD1 | 2 | WILD1 | 4 | WILD1 | 3 | WILD1 | 2 |
| 1 | BLANK | 10 | WILD2 | 1 | WILD2 | 1 | WILD2 | 1 | WILD2 | 2 |
| 2 | 3BAR | 11 | WILD3 | 3 | WILD3 | 4 | WILD3 | 2 | WILD3 | 2 |
| 3 | BLANK | 10 | BLANK | 3 | BLANK | 6 | BLANK | 4 | BLANK | 2 |
| 4 | 1BAR | 11 | 3BAR | 4 | 2BAR | 5 | 3BAR | 10 | 1BAR | 20 |
| 5 | BLANK | 9 | BLANK | 8 | BLANK | 4 | BLANK | 4 | BLANK | 20 |
| 6 | RED7 | 4 | RED7 | 2 | RED7 | 3 | RED7 | 4 | RED7 | 10 |
| 7 | BLANK | 3 | BLANK | 3 | BLANK | 3 | BLANK | 3 | BLANK | 10 |
| 8 | BLUE7 | 5 | BLUE7 | 2 | BLUE7 | 3 | BLUE7 | 4 | BLUE7 | 10 |
| 9 | BLANK | 9 | BLANK | 2 | BLANK | 2 | BLANK | 4 | BLANK | 20 |
| 10 | 1BAR | 10 | 1BAR | 5 | 1BAR | 1 | 2BAR | 4 | 3BAR | 30 |
| 11 | BLANK | 9 | BLANK | 4 | BLANK | 6 | BLANK | 10 | BLANK | 25 |
| 12 | 3BAR | 10 | 2BAR | 3 | 3BAR | 5 | 1BAR | 11 | 2BAR | 35 |
| 13 | BLANK | 2 | BLANK | 3 | BLANK | 2 | BLANK | 4 | BLANK | 20 |
| 14 | BLUE7 | 6 | RED7 | 6 | RED7 | 5 | RED7 | 4 | BLUE7 | 20 |
| 15 | BLANK | 6 | BLANK | 5 | BLANK | 5 | BLANK | 4 | BLANK | 20 |
| 16 | RED7 | 6 | BLUE7 | 6 | BLUE7 | 5 | BLUE7 | 4 | RED7 | 20 |
| 17 | BLANK | 15 | BLANK | 8 | BLANK | 3 | BLANK | 16 | BLANK | 2 |
| 18 | BONUS | 21 | BONUS | 9 | BONUS | 5 | BONUS | 34 | BONUS | 1 |
| 19 | BLANK | 14 | BLANK | 8 | BLANK | 5 | BLANK | 46 | BLANK | 3 |
| 20 | 1BAR | 15 | 1BAR | 10 | 1BAR | 3 | 2BAR | 12 | 3BAR | 20 |
| 21 | BLANK | 8 | BLANK | 3 | BLANK | 6 | BLANK | 4 | BLANK | 20 |
| TOTAL | | 206 | | 100 | | 86 | | 192 | | 314 |

FIG.13 V01

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 8 | WILD1 | 9 | WILD1 | 5 | WILD1 | 1 | WILD1 | 6 |
| 1 | BLANK | 4 | WILD2 | 5 | WILD2 | 4 | WILD2 | 1 | WILD2 | 6 |
| 2 | 3BAR | 10 | WILD3 | 9 | WILD3 | 5 | WILD3 | 1 | WILD3 | 6 |
| 3 | BLANK | 14 | BLANK | 7 | BLANK | 5 | BLANK | 1 | BLANK | 10 |
| 4 | 1BAR | 17 | 3BAR | 1 | 2BAR | 5 | 3BAR | 3 | 1BAR | 6 |
| 5 | BLANK | 2 | BLANK | 8 | BLANK | 4 | BLANK | 1 | BLANK | 10 |
| 6 | RED7 | 4 | RED7 | 1 | RED7 | 1 | RED7 | 1 | RED7 | 11 |
| 7 | BLANK | 4 | BLANK | 2 | BLANK | 1 | BLANK | 1 | BLANK | 8 |
| 8 | BLUE7 | 4 | BLUE7 | 2 | BLUE7 | 1 | BLUE7 | 1 | BLUE7 | 11 |
| 9 | BLANK | 2 | BLANK | 3 | BLANK | 1 | BLANK | 1 | BLANK | 10 |
| 10 | 1BAR | 12 | 1BAR | 6 | 1BAR | 2 | 2BAR | 2 | 3BAR | 5 |
| 11 | BLANK | 8 | BLANK | 3 | BLANK | 1 | BLANK | 1 | BLANK | 8 |
| 12 | 3BAR | 14 | 2BAR | 6 | 3BAR | 1 | 1BAR | 3 | 2BAR | 5 |
| 13 | BLANK | 6 | BLANK | 3 | BLANK | 1 | BLANK | 1 | BLANK | 10 |
| 14 | BLUE7 | 3 | RED7 | 1 | RED7 | 5 | RED7 | 1 | BLUE7 | 10 |
| 15 | BLANK | 3 | BLANK | 1 | BLANK | 5 | BLANK | 1 | BLANK | 6 |
| 16 | RED7 | 3 | BLUE7 | 1 | BLUE7 | 8 | BLUE7 | 1 | RED7 | 10 |
| 17 | BLANK | 14 | BLANK | 7 | BLANK | 5 | BLANK | 10 | BLANK | 1 |
| 18 | BONUS | 14 | BONUS | 7 | BONUS | 5 | BONUS | 4 | BONUS | 2 |
| 19 | BLANK | 14 | BLANK | 7 | BLANK | 5 | BLANK | 10 | BLANK | 1 |
| 20 | 1BAR | 20 | 1BAR | 4 | 1BAR | 1 | 2BAR | 1 | 3BAR | 5 |
| 21 | BLANK | 12 | BLANK | 6 | BLANK | 5 | BLANK | 1 | BLANK | 10 |
| TOTAL | | 192 | | 99 | | 76 | | 48 | | 157 |

FIG.14 V02

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 8 | WILD1 | 9 | WILD1 | 5 | WILD1 | 1 | WILD1 | 6 |
| 1 | BLANK | 4 | WILD2 | 5 | WILD2 | 4 | WILD2 | 1 | WILD2 | 6 |
| 2 | 3BAR | 10 | WILD3 | 9 | WILD3 | 5 | WILD3 | 1 | WILD3 | 6 |
| 3 | BLANK | 14 | BLANK | 7 | BLANK | 5 | BLANK | 1 | BLANK | 10 |
| 4 | 1BAR | 17 | 3BAR | 1 | 2BAR | 5 | 3BAR | 3 | 1BAR | 6 |
| 5 | BLANK | 2 | BLANK | 8 | BLANK | 4 | BLANK | 1 | BLANK | 10 |
| 6 | RED7 | 4 | RED7 | 1 | RED7 | 1 | RED7 | 1 | RED7 | 11 |
| 7 | BLANK | 4 | BLANK | 2 | BLANK | 1 | BLANK | 1 | BLANK | 8 |
| 8 | BLUE7 | 4 | BLUE7 | 2 | BLUE7 | 1 | BLUE7 | 1 | BLUE7 | 11 |
| 9 | BLANK | 2 | BLANK | 3 | BLANK | 1 | BLANK | 1 | BLANK | 10 |
| 10 | 1BAR | 12 | 1BAR | 6 | 1BAR | 2 | 2BAR | 2 | 3BAR | 5 |
| 11 | BLANK | 8 | BLANK | 3 | BLANK | 1 | BLANK | 1 | BLANK | 8 |
| 12 | 3BAR | 14 | 2BAR | 6 | 3BAR | 1 | 1BAR | 3 | 2BAR | 5 |
| 13 | BLANK | 6 | BLANK | 3 | BLANK | 1 | BLANK | 1 | BLANK | 10 |
| 14 | BLUE7 | 3 | RED7 | 1 | RED7 | 5 | RED7 | 1 | BLUE7 | 10 |
| 15 | BLANK | 3 | BLANK | 1 | BLANK | 5 | BLANK | 1 | BLANK | 6 |
| 16 | RED7 | 3 | BLUE7 | 1 | BLUE7 | 8 | BLUE7 | 1 | RED7 | 10 |
| 17 | BLANK | 14 | BLANK | 7 | BLANK | 5 | BLANK | 10 | BLANK | 1 |
| 18 | BONUS | 14 | BONUS | 7 | BONUS | 5 | BONUS | 4 | BONUS | 2 |
| 19 | BLANK | 14 | BLANK | 7 | BLANK | 5 | BLANK | 10 | BLANK | 1 |
| 20 | 1BAR | 20 | 1BAR | 4 | 1BAR | 1 | 2BAR | 1 | 3BAR | 5 |
| 21 | BLANK | 12 | BLANK | 6 | BLANK | 5 | BLANK | 1 | BLANK | 10 |
| TOTAL | | 192 | | 99 | | 76 | | 48 | | 157 |

FIG.15 V03

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 8 | WILD1 | 9 | WILD1 | 5 | WILD1 | 1 | WILD1 | 6 |
| 1 | BLANK | 4 | WILD2 | 5 | WILD2 | 4 | WILD2 | 1 | WILD2 | 6 |
| 2 | 3BAR | 10 | WILD3 | 9 | WILD3 | 5 | WILD3 | 1 | WILD3 | 6 |
| 3 | BLANK | 14 | BLANK | 7 | BLANK | 5 | BLANK | 1 | BLANK | 10 |
| 4 | 1BAR | 17 | 3BAR | 1 | 2BAR | 5 | 3BAR | 3 | 1BAR | 6 |
| 5 | BLANK | 2 | BLANK | 8 | BLANK | 4 | BLANK | 1 | BLANK | 10 |
| 6 | RED7 | 4 | RED7 | 1 | RED7 | 1 | RED7 | 1 | RED7 | 11 |
| 7 | BLANK | 4 | BLANK | 2 | BLANK | 1 | BLANK | 1 | BLANK | 8 |
| 8 | BLUE7 | 4 | BLUE7 | 2 | BLUE7 | 1 | BLUE7 | 1 | BLUE7 | 11 |
| 9 | BLANK | 2 | BLANK | 3 | BLANK | 1 | BLANK | 1 | BLANK | 10 |
| 10 | 1BAR | 12 | 1BAR | 6 | 1BAR | 2 | 2BAR | 2 | 3BAR | 5 |
| 11 | BLANK | 8 | BLANK | 3 | BLANK | 1 | BLANK | 1 | BLANK | 8 |
| 12 | 3BAR | 14 | 2BAR | 6 | 3BAR | 1 | 1BAR | 3 | 2BAR | 5 |
| 13 | BLANK | 6 | BLANK | 3 | BLANK | 1 | BLANK | 1 | BLANK | 10 |
| 14 | BLUE7 | 3 | RED7 | 1 | RED7 | 5 | RED7 | 1 | BLUE7 | 10 |
| 15 | BLANK | 3 | BLANK | 1 | BLANK | 5 | BLANK | 1 | BLANK | 6 |
| 16 | RED7 | 3 | BLUE7 | 1 | BLUE7 | 8 | BLUE7 | 1 | RED7 | 10 |
| 17 | BLANK | 14 | BLANK | 7 | BLANK | 5 | BLANK | 10 | BLANK | 1 |
| 18 | BONUS | 14 | BONUS | 7 | BONUS | 5 | BONUS | 4 | BONUS | 2 |
| 19 | BLANK | 14 | BLANK | 7 | BLANK | 5 | BLANK | 10 | BLANK | 1 |
| 20 | 1BAR | 20 | 1BAR | 4 | 1BAR | 1 | 2BAR | 1 | 3BAR | 5 |
| 21 | BLANK | 12 | BLANK | 6 | BLANK | 5 | BLANK | 1 | BLANK | 10 |
| TOTAL | | 192 | | 99 | | 76 | | 48 | | 157 |

FIG.16 V04

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 8 | WILD1 | 9 | WILD1 | 5 | WILD1 | 1 | WILD1 | 6 |
| 1 | BLANK | 4 | WILD2 | 5 | WILD2 | 4 | WILD2 | 1 | WILD2 | 6 |
| 2 | 3BAR | 10 | WILD3 | 9 | WILD3 | 5 | WILD3 | 1 | WILD3 | 6 |
| 3 | BLANK | 14 | BLANK | 7 | BLANK | 5 | BLANK | 1 | BLANK | 10 |
| 4 | 1BAR | 17 | 3BAR | 1 | 2BAR | 5 | 3BAR | 3 | 1BAR | 6 |
| 5 | BLANK | 2 | BLANK | 8 | BLANK | 4 | BLANK | 1 | BLANK | 10 |
| 6 | RED7 | 4 | RED7 | 1 | RED7 | 1 | RED7 | 1 | RED7 | 11 |
| 7 | BLANK | 4 | BLANK | 2 | BLANK | 1 | BLANK | 1 | BLANK | 8 |
| 8 | BLUE7 | 4 | BLUE7 | 2 | BLUE7 | 1 | BLUE7 | 1 | BLUE7 | 11 |
| 9 | BLANK | 2 | BLANK | 3 | BLANK | 1 | BLANK | 1 | BLANK | 10 |
| 10 | 1BAR | 12 | 1BAR | 6 | 1BAR | 2 | 2BAR | 2 | 3BAR | 5 |
| 11 | BLANK | 8 | BLANK | 3 | BLANK | 1 | BLANK | 1 | BLANK | 8 |
| 12 | 3BAR | 14 | 2BAR | 6 | 3BAR | 1 | 1BAR | 3 | 2BAR | 5 |
| 13 | BLANK | 6 | BLANK | 3 | BLANK | 1 | BLANK | 1 | BLANK | 10 |
| 14 | BLUE7 | 3 | RED7 | 1 | RED7 | 5 | RED7 | 1 | BLUE7 | 10 |
| 15 | BLANK | 3 | BLANK | 1 | BLANK | 5 | BLANK | 1 | BLANK | 6 |
| 16 | RED7 | 3 | BLUE7 | 1 | BLUE7 | 8 | BLUE7 | 1 | RED7 | 10 |
| 17 | BLANK | 14 | BLANK | 7 | BLANK | 5 | BLANK | 10 | BLANK | 1 |
| 18 | BONUS | 14 | BONUS | 7 | BONUS | 5 | BONUS | 4 | BONUS | 2 |
| 19 | BLANK | 14 | BLANK | 7 | BLANK | 5 | BLANK | 10 | BLANK | 1 |
| 20 | 1BAR | 20 | 1BAR | 4 | 1BAR | 1 | 2BAR | 1 | 3BAR | 5 |
| 21 | BLANK | 12 | BLANK | 6 | BLANK | 5 | BLANK | 1 | BLANK | 10 |
| TOTAL | | 192 | | 99 | | 76 | | 48 | | 157 |

FIG.17 V05

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 8 | WILD1 | 9 | WILD1 | 5 | WILD1 | 1 | WILD1 | 6 |
| 1 | BLANK | 4 | WILD2 | 5 | WILD2 | 4 | WILD2 | 1 | WILD2 | 6 |
| 2 | 3BAR | 10 | WILD3 | 9 | WILD3 | 5 | WILD3 | 1 | WILD3 | 6 |
| 3 | BLANK | 14 | BLANK | 7 | BLANK | 5 | BLANK | 1 | BLANK | 10 |
| 4 | 1BAR | 17 | 3BAR | 1 | 2BAR | 5 | 3BAR | 3 | 1BAR | 6 |
| 5 | BLANK | 2 | BLANK | 8 | BLANK | 4 | BLANK | 1 | BLANK | 10 |
| 6 | RED7 | 4 | RED7 | 1 | RED7 | 1 | RED7 | 1 | RED7 | 11 |
| 7 | BLANK | 4 | BLANK | 2 | BLANK | 1 | BLANK | 1 | BLANK | 8 |
| 8 | BLUE7 | 4 | BLUE7 | 2 | BLUE7 | 1 | BLUE7 | 1 | BLUE7 | 11 |
| 9 | BLANK | 2 | BLANK | 3 | BLANK | 1 | BLANK | 1 | BLANK | 10 |
| 10 | 1BAR | 12 | 1BAR | 6 | 1BAR | 2 | 2BAR | 2 | 3BAR | 5 |
| 11 | BLANK | 8 | BLANK | 3 | BLANK | 1 | BLANK | 1 | BLANK | 8 |
| 12 | 3BAR | 14 | 2BAR | 6 | 3BAR | 1 | 1BAR | 3 | 2BAR | 5 |
| 13 | BLANK | 6 | BLANK | 3 | BLANK | 1 | BLANK | 1 | BLANK | 10 |
| 14 | BLUE7 | 3 | RED7 | 1 | RED7 | 5 | RED7 | 1 | BLUE7 | 10 |
| 15 | BLANK | 3 | BLANK | 1 | BLANK | 5 | BLANK | 1 | BLANK | 6 |
| 16 | RED7 | 3 | BLUE7 | 1 | BLUE7 | 8 | BLUE7 | 1 | RED7 | 10 |
| 17 | BLANK | 14 | BLANK | 7 | BLANK | 5 | BLANK | 10 | BLANK | 1 |
| 18 | BONUS | 14 | BONUS | 7 | BONUS | 5 | BONUS | 4 | BONUS | 2 |
| 19 | BLANK | 14 | BLANK | 7 | BLANK | 5 | BLANK | 10 | BLANK | 1 |
| 20 | 1BAR | 20 | 1BAR | 4 | 1BAR | 1 | 2BAR | 1 | 3BAR | 5 |
| 21 | BLANK | 12 | BLANK | 6 | BLANK | 5 | BLANK | 1 | BLANK | 10 |
| TOTAL | | 192 | | 99 | | 76 | | 48 | | 157 |

FIG.18 V06

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 8 | WILD1 | 9 | WILD1 | 5 | WILD1 | 1 | WILD1 | 6 |
| 1 | BLANK | 4 | WILD2 | 5 | WILD2 | 4 | WILD2 | 1 | WILD2 | 6 |
| 2 | 3BAR | 10 | WILD3 | 9 | WILD3 | 5 | WILD3 | 1 | WILD3 | 6 |
| 3 | BLANK | 14 | BLANK | 7 | BLANK | 5 | BLANK | 1 | BLANK | 10 |
| 4 | 1BAR | 17 | 3BAR | 1 | 2BAR | 5 | 3BAR | 3 | 1BAR | 6 |
| 5 | BLANK | 2 | BLANK | 8 | BLANK | 4 | BLANK | 1 | BLANK | 10 |
| 6 | RED7 | 4 | RED7 | 1 | RED7 | 1 | RED7 | 1 | RED7 | 11 |
| 7 | BLANK | 4 | BLANK | 2 | BLANK | 1 | BLANK | 1 | BLANK | 8 |
| 8 | BLUE7 | 4 | BLUE7 | 2 | BLUE7 | 1 | BLUE7 | 1 | BLUE7 | 11 |
| 9 | BLANK | 2 | BLANK | 3 | BLANK | 1 | BLANK | 1 | BLANK | 10 |
| 10 | 1BAR | 12 | 1BAR | 6 | 1BAR | 2 | 2BAR | 2 | 3BAR | 5 |
| 11 | BLANK | 8 | BLANK | 3 | BLANK | 1 | BLANK | 1 | BLANK | 8 |
| 12 | 3BAR | 14 | 2BAR | 6 | 3BAR | 1 | 1BAR | 3 | 2BAR | 5 |
| 13 | BLANK | 6 | BLANK | 3 | BLANK | 1 | BLANK | 1 | BLANK | 10 |
| 14 | BLUE7 | 3 | RED7 | 1 | RED7 | 5 | RED7 | 1 | BLUE7 | 10 |
| 15 | BLANK | 3 | BLANK | 1 | BLANK | 5 | BLANK | 1 | BLANK | 6 |
| 16 | RED7 | 3 | BLUE7 | 1 | BLUE7 | 8 | BLUE7 | 1 | RED7 | 10 |
| 17 | BLANK | 14 | BLANK | 7 | BLANK | 5 | BLANK | 10 | BLANK | 1 |
| 18 | BONUS | 14 | BONUS | 7 | BONUS | 5 | BONUS | 4 | BONUS | 2 |
| 19 | BLANK | 14 | BLANK | 7 | BLANK | 5 | BLANK | 10 | BLANK | 1 |
| 20 | 1BAR | 20 | 1BAR | 4 | 1BAR | 1 | 2BAR | 1 | 3BAR | 5 |
| 21 | BLANK | 12 | BLANK | 6 | BLANK | 5 | BLANK | 1 | BLANK | 10 |
| TOTAL | | 192 | | 99 | | 76 | | 48 | | 157 |

FIG.19 V07

| | 1st | | 2nd | | 3rd | | 4th | | 5th | |
|---|---|---|---|---|---|---|---|---|---|---|
| No. | SYMBOL | WEIGHT | SYMBOL | WEIGHT | SYMBOL | WEIGHT | SYMBOL | WEIGHT | SYMBOL | WEIGHT |
| 0 | 2BAR | 8 | WILD1 | 9 | WILD1 | 5 | WILD1 | 1 | WILD1 | 6 |
| 1 | BLANK | 4 | WILD2 | 5 | WILD2 | 4 | WILD2 | 1 | WILD2 | 6 |
| 2 | 3BAR | 10 | WILD3 | 9 | WILD3 | 5 | WILD3 | 1 | WILD3 | 6 |
| 3 | BLANK | 14 | BLANK | 7 | BLANK | 5 | BLANK | 1 | BLANK | 10 |
| 4 | 1BAR | 17 | 3BAR | 1 | 2BAR | 5 | 3BAR | 3 | 1BAR | 6 |
| 5 | BLANK | 2 | BLANK | 8 | BLANK | 4 | BLANK | 1 | BLANK | 10 |
| 6 | RED7 | 4 | RED7 | 1 | RED7 | 1 | RED7 | 1 | RED7 | 11 |
| 7 | BLANK | 4 | BLANK | 2 | BLANK | 1 | BLANK | 1 | BLANK | 8 |
| 8 | BLUE7 | 4 | BLUE7 | 2 | BLUE7 | 1 | BLUE7 | 1 | BLUE7 | 11 |
| 9 | BLANK | 2 | BLANK | 3 | BLANK | 1 | BLANK | 1 | BLANK | 10 |
| 10 | 1BAR | 12 | 1BAR | 6 | 1BAR | 2 | 2BAR | 2 | 3BAR | 5 |
| 11 | BLANK | 8 | BLANK | 3 | BLANK | 1 | BLANK | 1 | BLANK | 8 |
| 12 | 3BAR | 14 | 2BAR | 6 | 3BAR | 1 | 1BAR | 3 | 2BAR | 5 |
| 13 | BLANK | 6 | BLANK | 3 | BLANK | 1 | BLANK | 1 | BLANK | 10 |
| 14 | BLUE7 | 3 | RED7 | 1 | RED7 | 5 | RED7 | 1 | BLUE7 | 10 |
| 15 | BLANK | 3 | BLANK | 1 | BLANK | 5 | BLANK | 1 | BLANK | 6 |
| 16 | RED7 | 3 | BLUE7 | 1 | BLUE7 | 8 | BLUE7 | 1 | RED7 | 10 |
| 17 | BLANK | 14 | BLANK | 7 | BLANK | 5 | BLANK | 10 | BLANK | 1 |
| 18 | BONUS | 14 | BONUS | 7 | BONUS | 5 | BONUS | 4 | BONUS | 2 |
| 19 | BLANK | 14 | BLANK | 7 | BLANK | 5 | BLANK | 10 | BLANK | 1 |
| 20 | 1BAR | 20 | 1BAR | 4 | 1BAR | 1 | 2BAR | 1 | 3BAR | 5 |
| 21 | BLANK | 12 | BLANK | 6 | BLANK | 5 | BLANK | 1 | BLANK | 10 |
| TOTAL | | 192 | | 99 | | 76 | | 48 | | 157 |

FIG.23

191

(NORMAL GAME PAYOUT TABLE)

| SYMBOL | 3 | 4 | 5 |
|---|---|---|---|
| RED7 | 50 | 100 | 500 |
| BLUE7 | 30 | 80 | 250 |
| ANY7 | 15 | 40 | 80 |
| 3BAR | 20 | 45 | 200 |
| 2BAR | 15 | 30 | 150 |
| 1BAR | 10 | 20 | 100 |
| ANYBAR | 5 | 10 | 30 |
| WILD | 0 | 0 | 0 |
| BONUS | 1 | 2 | 5 |
| | 10 TIMES OF FREE GAME (*1) | | |
| BONUS AWARD(※2) | 0 | 0 | 200000 |

(*1) RIGHT TO PLAY FREE GAME 10 TIMES IS AWARDED WHEN AT LEAST ONE BONUS SYMBOL IS REARRANGED ON EACH OF 1ST REEL, 2ND REEL, AND 3RD REEL (FREE GAME TRIGGER)

(*2) ・BONUS AWARD ONLY OCCURS IN NORMAL GAME (DOES NOT OCCUR IN FREE GAME)

・BONUS AWARD OCCURS ONLY WHEN FIVE BONUS SYMBOLS ARE ARRANGED ON PAYLINE 1 (DOES NOT OCCUR WHEN ARRANGED ON PAYLINE OTHER THAN PAYLINE 1)

FIG.24

192

(FREE GAME PAYOUT TABLE)

| SYMBOL | 3 | 4 | 5 |
|---|---|---|---|
| RED7 | 50 | 100 | 500 |
| BLUE7 | 30 | 80 | 250 |
| ANY7 | 15 | 40 | 80 |
| 3BAR | 20 | 45 | 200 |
| 2BAR | 15 | 30 | 150 |
| 1BAR | 10 | 20 | 100 |
| ANYBAR | 5 | 10 | 30 |
| WILD | 0 | 0 | 0 |
| BONUS | 1 | 2 | 5 |
| | 5 TIMES OF FREE GAME (RETRIGGER) | | |

FIG.25

(FREE GAME PAYOUT RATE RANDOM DETERMINATION COUNT DETERMINATION TABLE)

193

| NUMBER OF BONUS SYMBOLS | NUMBER OF TIMES OF RANDOM DETERMINATION |
|---|---|
| 5 | THREE TIMES |
| 4 | TWICE |
| 3 | ONCE |

FIG.26

194

(FREE GAME PAYOUT RATE RANDOM DETERMINATION TABLE)

| AREA NO. | PAYOUT RATE | WEIGHT |
|---|---|---|
| 0 | 10 | 1 |
| 1 | 2 | 98 |
| 2 | 5 | 5 |
| 3 | 2 | 100 |
| 4 | 3 | 52 |
| 5 | 4 | 50 |
| 6 | 2 | 92 |
| 7 | 7 | 2 |
| 8 | 3 | 100 |
| TOTAL | – | 500 |

FIG.27 (EFFECT COMBINATION TABLE) 195

| No. | EFFECT COMBINATION | | | | COMBINATION CONDITION | | | | | | | |
|---|---|---|---|---|---|---|---|---|---|---|---|---|
| | EFFECT BEFORE START OF ROTATION (1) | EFFECT BEFORE START OF ROTATION (2) | EFFECTS DURING ROTATION TILL STOPPING | EFFECT AFTER STOPPING | TABLE A | TABLE B | TABLE C | TABLE D | TABLE E | TABLE F | TABLE G | TABLE H |
| 0 | – | – | – | – | 1400 | 110 | 1902 | 1 | 1686 | 1636 | 3000 | 3000 |
| 1 | – | – | LOW SPEED | – | 30 | 200 | 105 | 200 | 121 | 373 | 0 | 0 |
| 2 | – | – | HIGH SPEED | – | 30 | 5 | 151 | 5 | 151 | 377 | 0 | 0 |
| 3 | – | – | FRAME ADVANCE | – | 30 | 150 | 0 | 250 | 0 | 43 | 0 | 0 |
| 4 | – | – | HIGH SPEED2 | – | 30 | 5 | 45 | 5 | 50 | 42 | 0 | 0 |
| 5 | – | – | DESIGN ALIGNMENT | – | 50 | 5 | 25 | 5 | 4 | 0 | 0 | 0 |
| 6 | FLASH 1 | – | – | – | 30 | 5 | 30 | 5 | 30 | 40 | 0 | 0 |
| 7 | FLASH 1 | – | LOW SPEED | – | 20 | 200 | 5 | 200 | 25 | 55 | 0 | 0 |
| 8 | FLASH 1 | – | HIGH SPEED | – | 20 | 5 | 51 | 5 | 57 | 48 | 0 | 0 |
| 9 | FLASH 1 | – | FRAME ADVANCE | – | 20 | 200 | 0 | 200 | 0 | 18 | 0 | 0 |
| 10 | FLASH 1 | – | HIGH SPEED2 | – | 20 | 5 | 45 | 1 | 50 | 17 | 0 | 0 |
| 11 | FLASH 1 | – | DESIGN ALIGNMENT | – | 50 | 5 | 22 | 1 | 4 | 0 | 0 | 0 |
| 12 | FLASH 2 | – | – | – | 30 | 30 | 30 | 30 | 30 | 16 | 0 | 0 |
| 13 | FLASH 2 | – | LOW SPEED | – | 20 | 200 | 5 | 200 | 55 | 28 | 0 | 0 |
| 14 | FLASH 2 | – | HIGH SPEED | – | 20 | 5 | 51 | 5 | 88 | 26 | 0 | 0 |
| 15 | FLASH 2 | – | FRAME ADVANCE | – | 20 | 200 | 0 | 200 | 0 | 13 | 0 | 0 |
| 16 | FLASH 2 | – | HIGH SPEED2 | – | 20 | 5 | 45 | 5 | 45 | 13 | 0 | 0 |
| 17 | FLASH 2 | – | DESIGN ALIGNMENT | – | 150 | 5 | 32 | 1 | 6 | 0 | 0 | 0 |
| 18 | FLASH 3 | – | – | – | 40 | 5 | 40 | 5 | 40 | 0 | 0 | 0 |
| 19 | FLASH 3 | – | LOW SPEED | – | 70 | 280 | 38 | 280 | 38 | 0 | 0 | 0 |
| 20 | FLASH 3 | – | HIGH SPEED | – | 70 | 10 | 91 | 10 | 83 | 0 | 0 | 0 |
| 21 | FLASH 3 | – | FRAME ADVANCE | – | 70 | 280 | 0 | 280 | 0 | 0 | 0 | 0 |
| 22 | FLASH 3 | – | HIGH SPEED2 | – | 70 | 10 | 45 | 85 | 45 | 0 | 0 | 0 |

FIG.28

(EFFECT COMBINATION TABLE) 195

| No. | EFFECT COMBINATION | | | | COMBINATION CONDITION | | | | | | | |
|---|---|---|---|---|---|---|---|---|---|---|---|---|
| | EFFECT BEFORE START OF ROTATION (1) | EFFECT BEFORE START OF ROTATION (2) | EFFECTS DURING ROTATION TILL STOPPING | EFFECT AFTER STOPPING | TABLE A | TABLE B | TABLE C | TABLE D | TABLE E | TABLE F | TABLE G | TABLE H |
| 23 | FLASH 3 | – | DESIGN ALIGNMENT | – | 400 | 5 | 37 | 1 | 5 | 0 | 0 | 0 |
| 24 | – | STOPPING 1 AND 2 FIRST | LOW SPEED | – | 5 | 220 | 5 | 195 | 55 | 83 | 0 | 0 |
| 25 | – | STOPPING 1 AND 2 FIRST | HIGH SPEED | – | 5 | 25 | 50 | 5 | 85 | 74 | 0 | 0 |
| 26 | – | STOPPING 1 AND 2 FIRST | FRAME ADVANCE | – | 5 | 200 | 0 | 195 | 0 | 13 | 0 | 0 |
| 27 | – | STOPPING 1 AND 2 FIRST | HIGH SPEED2 | – | 5 | 5 | 5 | 5 | 65 | 13 | 0 | 0 |
| 28 | FLASH 1 | STOPPING 1 AND 2 FIRST | LOW SPEED | – | 15 | 200 | 5 | 200 | 45 | 22 | 0 | 0 |
| 29 | FLASH 1 | STOPPING 1 AND 2 FIRST | HIGH SPEED | – | 15 | 5 | 50 | 5 | 62 | 20 | 0 | 0 |
| 30 | FLASH 1 | STOPPING 1 AND 2 FIRST | FRAME ADVANCE | – | 15 | 200 | 0 | 200 | 0 | 9 | 0 | 0 |
| 31 | FLASH 1 | STOPPING 1 AND 2 FIRST | HIGH SPEED2 | – | 15 | 5 | 45 | 5 | 45 | 10 | 0 | 0 |
| 32 | FLASH 2 | STOPPING 1 AND 2 FIRST | LOW SPEED | – | 25 | 100 | 1 | 100 | 1 | 5 | 0 | 0 |
| 33 | FLASH 2 | STOPPING 1 AND 2 FIRST | HIGH SPEED | – | 25 | 5 | 22 | 5 | 15 | 4 | 0 | 0 |
| 34 | FLASH 2 | STOPPING 1 AND 2 FIRST | FRAME ADVANCE | – | 25 | 100 | 0 | 100 | 0 | 1 | 0 | 0 |
| 35 | FLASH 2 | STOPPING 1 AND 2 FIRST | HIGH SPEED2 | – | 25 | 5 | 22 | 5 | 14 | 1 | 0 | 0 |
| 36 | FLASH 3 | STOPPING 1 AND 2 FIRST | LOW SPEED | – | 0 | 0 | 0 | 0 | 0 | 0 | 0 | 0 |
| 37 | FLASH 3 | STOPPING 1 AND 2 FIRST | HIGH SPEED | – | 0 | 0 | 0 | 0 | 0 | 0 | 0 | 0 |
| 38 | FLASH 3 | STOPPING 1 AND 2 FIRST | FRAME ADVANCE | – | 0 | 0 | 0 | 0 | 0 | 0 | 0 | 0 |
| 39 | FLASH 3 | STOPPING 1 AND 2 FIRST | HIGH SPEED2 | 0 | 0 | 0 | 0 | 0 | 0 | 0 | 0 | 0 |
| 40 | – | – | ROTATING ALL | 0 | 10 | 0 | 0 | 0 | 0 | 0 | 0 | 0 |
| 41 | FLASH 1 | – | ROTATING ALL | 0 | 20 | 0 | 0 | 0 | 0 | 0 | 0 | 0 |
| 42 | FLASH 2 | – | ROTATING ALL | 0 | 30 | 0 | 0 | 0 | 0 | 0 | 0 | 0 |
| 43 | FLASH 3 | 0 | ROTATING ALL | 0 | 50 | 0 | 0 | 0 | 0 | 0 | 0 | 0 |
| TOTAL | | | | | 3000 | 3000 | 3000 | 3000 | 3000 | 3000 | 3000 | 3000 |

FIG.29

(ROULETTE STOP PATTERN)

196

| No. | STOP PATTERN | LONGEST RANDOM DETERMINATION PERIOD | | 1ST ROUND | | | | | | | | | 2ND ROUND | | | | | | | | |
|---|---|---|---|---|---|---|---|---|---|---|---|---|---|---|---|---|---|---|---|---|---|
| | | [f] | [sec] | No.0 | No.1 | No.2 | No.3 | No.4 | No.5 | No.6 | No.7 | No.8 | No.0 | No.1 | No.2 | No.3 | No.4 | No.5 | No.6 | No.7 | No.8 |
| a | SLOWING DOWN AFTER 2ND ROUND | 598 | 9.97 | 5 | 5 | 5 | 5 | 5 | 5 | 5 | 5 | 5 | 5 | 5 | 5 | 5 | 5 | 5 | 5 | 7 | 12 |
| b | SLOWING DOWN AFTER 2ND ROUND | 630 | 10.50 | 5 | 5 | 5 | 5 | 5 | 5 | 5 | 5 | 5 | 5 | 5 | 5 | 5 | 5 | 5 | 5 | 7 | 12 |
| c | SLOWING DOWN AFTER 2 AND 1/4 ROUND | 571 | 9.52 | 5 | 5 | 5 | 5 | 5 | 5 | 5 | 5 | 5 | 5 | 5 | 5 | 5 | 5 | 5 | 5 | 5 | 5 |
| d | SLOWING DOWN AFTER 2 AND 1/4 ROUND | 620 | 10.33 | 5 | 5 | 5 | 5 | 5 | 5 | 5 | 5 | 5 | 5 | 5 | 5 | 5 | 5 | 5 | 5 | 5 | 5 |
| e | SLOWING DOWN AFTER 2 AND 1/2 ROUND | 610 | 10.17 | 5 | 5 | 5 | 5 | 5 | 5 | 5 | 5 | 5 | 5 | 5 | 5 | 5 | 5 | 5 | 5 | 5 | 5 |
| f | SLOWING DOWN AFTER 2 AND 1/2 ROUND | 643 | 10.72 | 5 | 5 | 5 | 5 | 5 | 5 | 5 | 5 | 5 | 5 | 5 | 5 | 5 | 5 | 5 | 5 | 5 | 5 |
| g | SLOWING DOWN AFTER 2 AND 3/4 ROUND | 639 | 10.65 | 5 | 5 | 5 | 5 | 5 | 5 | 5 | 5 | 5 | 5 | 5 | 5 | 5 | 5 | 5 | 5 | 5 | 5 |
| h | SLOWING DOWN AFTER 2 AND 3/4 ROUND | 719 | 11.98 | 5 | 5 | 5 | 5 | 5 | 5 | 5 | 5 | 5 | 5 | 5 | 5 | 5 | 5 | 5 | 5 | 5 | 5 |

| No. | 3RD ROUND | | | | | | | | | 4TH ROUND | | | | | | | | | 5TH ROUND | | | | | | | | |
|---|---|---|---|---|---|---|---|---|---|---|---|---|---|---|---|---|---|---|---|---|---|---|---|---|---|---|---|
| | No.0 | No.1 | No.2 | No.3 | No.4 | No.5 | No.6 | No.7 | No.8 | No.0 | No.1 | No.2 | No.3 | No.4 | No.5 | No.6 | No.7 | No.8 | No.0 | No.1 | No.2 | No.3 | No.4 | No.5 | No.6 | No.7 | No.8 |
| a | 16 | 21 | 27 | 34 | 42 | 51 | 56 | 60 | 62 | 64 | 66 | | | | | | | | | | | | | | | | |
| b | 16 | 21 | 26 | 31 | 37 | 43 | 49 | 56 | 60 | 62 | 64 | 66 | | | | | | | | | | | | | | | |
| c | 5 | 7 | 9 | 12 | 16 | 21 | 27 | 34 | 42 | 56 | 60 | 62 | 64 | 66 | | | | | | | | | | | | | |
| d | 5 | 7 | 9 | 12 | 16 | 21 | 27 | 34 | 42 | 49 | 56 | 60 | 62 | 64 | 66 | | | | | | | | | | | | |
| e | 5 | 5 | 5 | 5 | 7 | 9 | 12 | 16 | 21 | 34 | 42 | 51 | 56 | 60 | 62 | 64 | 66 | | | | | | | | | | |
| f | 5 | 5 | 5 | 5 | 7 | 9 | 12 | 16 | 21 | 31 | 37 | 43 | 49 | 56 | 60 | 62 | 64 | 66 | | | | | | | | | |
| g | 5 | 5 | 5 | 5 | 5 | 7 | 9 | 9 | 16 | 31 | 27 | 34 | 42 | 51 | 56 | 60 | 62 | 64 | 66 | | | | | | | | |
| h | 5 | 5 | 5 | 5 | 7 | 9 | 12 | 16 | 21 | 26 | 31 | 36 | 41 | 46 | 54 | 58 | 60 | 62 | 64 | 66 | | | | | | | |

FIG.30

197

(STOP PATTERN RANDOM DETERMINATION TABLE)

| PAYOUT RATE | x10 | x2 | x5 | x2 | x3 | x4 | x2 | x7 | x3 |
|---|---|---|---|---|---|---|---|---|---|
| STOP PATTERN | STOP POSITION | | | | | | | | |
| | No.0 | No.1 | No.2 | No.3 | No.4 | No.5 | No.6 | No.7 | No.8 |
| a | 1 | 1 | 0 | 0 | 0 | 0 | 0 | 1 | 1 |
| b | 1 | 1 | 1 | 0 | 0 | 0 | 0 | 0 | 1 |
| c | 0 | 1 | 1 | 1 | 1 | 0 | 0 | 0 | 0 |
| d | 0 | 0 | 1 | 1 | 1 | 1 | 0 | 0 | 0 |
| e | 0 | 0 | 0 | 0 | 1 | 1 | 1 | 1 | 0 |
| f | 0 | 0 | 0 | 0 | 0 | 1 | 1 | 1 | 1 |
| g | 1 | 0 | 0 | 0 | 0 | 0 | 1 | 1 | 1 |
| h | 1 | 1 | 0 | 0 | 0 | 0 | 0 | 1 | 1 |
| TOTAL WEIGHT | 4 | 4 | 3 | 2 | 3 | 3 | 3 | 5 | 5 |

STOP AT 3RD ROUND

STOP AT 4TH ROUND

STOP AT 5TH ROUND

GAMING MACHINE FOR RUNNING NORMAL GAME AND FREE GAME

CROSS REFERENCE TO RELATED APPLICATION

This application claims the benefit of Japanese Patent Application No. 2014-098131, filed on May 9, 2014, which application is incorporated herein by reference in its entirety.

FIELD OF THE INVENTION

The present invention relates to a gaming machine configured to run a normal game and a free game which develops from the normal game.

BACKGROUND OF THE INVENTION

As an example of gaming machines, a slot machine that rearranges symbols on a symbol display device each time a player presses a button on a control panel has been known.

When the symbols rearranged on the symbol display device form a winning combination, the gaming machine awards benefit such as payout to the player.

A slot machine recited in U.S. Pat. No. 4,097,048 is an example of the gaming machine above. This slot machine has various symbol patterns, game scenarios, effects such as sound effects, and display patterns, in consideration of diverse tastes of players.

In the meanwhile, U.S. Pat. No. 4,508,345 recites a slot machine configured to execute a bonus game. Furthermore, U.S. Pat. No. 7,942,733 recites a slot machine which allows a player to play a free game under a specific condition.

There are various regulations depending on the countries or regions where the gaming machine is installed. For example, there are regulations on the maximum payout and the winning chance. Therefore, even if the program data is designed and completed including a random determination table in which the maximum payout and the winning chance are set so as to comply with the regulations of a particular country or region, the program data may not comply with the regulations of another country or region, in which case the designing of the program data needs to be done from the beginning. This will result in a significant load of work for modification, since there are a large number of different types of prizes which are based on the sum or the combination of a plurality of types of symbols. Given the situation, there is a need for a gaming machine with a convenience in designing, which allows adjustment of the maximum payout and the winning chance as needed.

CITATION LIST

Patent Document

[PTL 1] Specification of U.S. Pat. No. 4,097,048
[PTL 2] Specification of U.S. Pat. No. 4,508,345
[PTL 3] Specification of U.S. Pat. No. 7,942,733

SUMMARY OF THE INVENTION

Technical Problem

As such, there have been various attempts to broaden the applicability and to enhance the enjoyment in playing with gaming machines by not only allowing players to play basic games but also adding various factors. To broaden the applicability and enhance the enjoyment, what kinds of elements are added to games is therefore important in gaming machines.

An object of the present invention is to provide a gaming machine that offers wider applicability and more enjoyment.

Technical Solution

An aspect of the present invention is a gaming machine configured to run a normal game and a free game which develops from the normal game, the gaming machine comprising a storage device configured to store a payout table for a free game and a payout table for a normal game, wherein a maximum payout obtainable in the normal game is higher than a maximum payout obtainable in the free game, and a chance of winning the maximum payout in the normal game is higher than a chance of winning the maximum payout in the free game.

The above structure makes the normal game more valuable (causes higher expectation for the maximum payout) than the free game, by setting the maximum payout and the chance of winning the maximum payout higher in the normal game than those in the free game.

The gaming machine of the above aspect of the present invention is adapted so that:

the gaming machine further comprises a symbol display device having a plurality of paylines and configured to display results of the normal game and the free game by varying a plurality of symbols arranged to rearrange them in a matrix, wherein the payout table for the normal game is set so that the maximum payout obtainable in the normal game is awarded when a predetermined symbol is rearranged on a predetermined payline in the normal game.

In the above structure, the maximum payout obtainable in the normal game is awarded only when the predetermined symbol is rearranged on a predetermined payline in the normal game. Therefore, it is possible to easily and freely set the maximum payout.

Another aspect of the present invention is a gaming machine configured to run a normal game and a free game which develops from the normal game, the gaming machine further comprises a symbol display device configured to variably display and rearrange a plurality of symbols including one or more trigger symbols;

the controller being programmed to execute the steps of:

(a1) running a normal game in which the symbols are rearranged on the symbol display device;

(a2) determining whether or not a trigger condition which is a condition for rearranging a predetermined number or more of the trigger symbols on the symbol display device is established, in the normal game;

(a3) if the trigger condition is determined as to be established, awarding a right to play the free game a predetermined number of times and randomly determining a payout rate for payouts obtainable in the free games;

(a4) running the free game a predetermined number of times; and (a5) awarding a payout which is a product of a payout obtained in the free game of the step (a4) multiplied by the payout rate randomly determined in step (a3).

In the above structure, the payout rate for the payout obtainable in the free game is randomly determined, when the trigger condition is established and the right to play the free game is awarded. This random determination of the payout rate for the payout obtainable in the free game provides enjoyment, every time the right to play the free game is awarded.

The gaming machine of the above aspect of the present invention is adapted so that:

in the step (a3), preliminary payout rate random determination is executed a certain number of times according to the number of trigger symbols rearranged on the symbol display device in the step (a2), and a value resulting from multiplication involving each preliminary payout rate determined by the preliminary payout rate random determination is determined as the payout rate for the payout obtainable in the free game.

In the above structure, the payout rate for the payout obtained in the free game is determined through multiplication involving each preliminary payout rate determined by the preliminary payout rate random determination executed a certain number of times according to the number of trigger symbols rearranged on the symbol display device in the normal game. The number of times the preliminary payout rate random determination is executed increases with an increase in the number of trigger symbols rearranged on the symbol display device in the normal game. This way, the player will be interested in the number of trigger symbols rearranged on the symbol display device, and enjoy the normal game.

The gaming machine of the above aspect of the present invention, further comprising:

a storage device, wherein in the step (a3), the payout rate random determination is a roulette random determination such that a pointer moves on a plurality of areas circularly arranged, each corresponding to a payout rate and stops on a random area, and a payout rate corresponding to the area where the pointer has stopped is determined as the payout rate for the payout obtainable in the free game, the storage device stores a roulette effect table specifying a plurality of speeds and the timings of stopping, for the pointer which moves on the plurality of areas circularly arranged, each corresponding to a payout rate, and effect random determination is executed based on the roulette effect table, to determine the speed and the timing of stopping the pointer which moves on the plurality of areas circularly arranged, each corresponding to a payout rate.

In the above described roulette random determination which determines the payout rate for the payout obtainable in the free game, the motion of the pointer (speed, timing of stopping) which indicates the result is randomly determined based on the roulette effect table. This causes the player to enjoy and be interested in the roulette random determination which determines the payout rate for the payout obtainable in the free game.

The gaming machine of the above aspect of the present invention is adapted so that:

an area where the pointer stopped once is excluded from subsequent free game payout rate random determination.

The gaming machine of the above aspect of the present invention is adapted so that:

the areas corresponding to the plurality of payout rates are capable of being illuminated by the display device; and the areas are sequentially and repetitively turned on and turned off, so as to provide an effect such that the pointer moves among the circularly arranged areas corresponding to the plurality of payout rates, respectively.

The gaming machine of the above aspect of the present invention is adapted so that:

effects are given to the way of stopping the roulette by varying the period of lighting each area.

The gaming machine of the above aspect of the present invention is adapted so that:

when the pointer stops at any of the circularly arranged areas corresponding to the plurality of payout rates, respectively, a visual effect is provided such that a Ninja star sticks on to the area where the pointer stopped, and the payout rate corresponding to that area where the pointer stopped is displayed on the display device.

The gaming machine of the above aspect of the present invention is adapted so that:

preliminary payout rates to be determined by the preliminary payout rate random determination includes ×0.

The gaming machine of the above aspect of the present invention is adapted so that:

in the step (a3), preliminary payout rate random determination is executed a certain number of times according to the number of trigger symbols rearranged on the symbol display device in the step (a2), and a value resulting from addition involving each preliminary payout rate determined by the preliminary payout rate random determination is determined as the payout rate for the payout obtainable in the free game.

Another aspect of the present invention is a control method for a gaming machine configured to run a normal game and a free game which develops from the normal game, a symbol display device configured to variably display and rearrange a plurality of symbols including one or more trigger symbols; and a controller, the controller executing the following steps of:

(a1) running a normal game in which the symbols are rearranged on the symbol display device;

(a2) determining whether or not a trigger condition which is a condition for rearranging a predetermined number or more of the trigger symbols on the symbol display device is established, in the normal game;

(a3) if the trigger condition is determined as to be established, awarding a right to play the free game a predetermined number of times and randomly determining a payout rate for payouts obtainable in the free games;

(a4) running the free game a predetermined number of times; and (a5) awarding a payout which is a product of a payout obtained in the free game of the step (a4) multiplied by the payout rate randomly determined in step (a3).

Advantageous Effects

There is provided a gaming machine that offers wider applicability and more enjoyment.

BRIEF DESCRIPTION OF THE DRAWINGS

The nature and mode of operation of the present invention will now be more fully described in the following detailed description of the invention taken with the accompanying drawing figures, in which:

FIG. 6 is an explanatory diagram showing a set of weights for symbol arrays in a normal game.

FIG. 7 is an explanatory diagram showing another set of weights for symbol arrays in the normal game.

FIG. 8 is an explanatory diagram showing another set of weights for symbol arrays in the normal game.

FIG. 9 is an explanatory diagram showing another set of weights for symbol arrays in the normal game.

FIG. 10 is an explanatory diagram showing another set of weights for symbol arrays in the normal game.

FIG. 11 is an explanatory diagram showing another set of weights for symbol arrays in the normal game.

FIG. 12 is an explanatory diagram showing another set of weights for symbol arrays in the normal game.

FIG. 13 is an explanatory diagram showing a set of weights for symbol arrays in a free game.

FIG. 14 is an explanatory diagram showing another set of weights for symbol arrays in the free game.

FIG. 15 is an explanatory diagram showing another set of weights for symbol arrays in the free game.

FIG. 16 is an explanatory diagram showing another set of weights for symbol arrays in the free game.

FIG. 17 is an explanatory diagram showing another set of weights for symbol arrays in the free game.

FIG. 18 is an explanatory diagram showing another set of weights for symbol arrays in the free game.

FIG. 19 is an explanatory diagram showing another set of weights for symbol arrays in the free game.

FIG. 23 is an explanatory diagram of a normal game payout table.

FIG. 24 is an explanatory diagram of a free game payout table.

FIG. 25 is an explanatory diagram of a free game payout rate random determination count determination table.

FIG. 26 is an explanatory diagram of a free game payout rate random determination table.

FIG. 27 is an explanatory diagram of an effect combination table.

FIG. 28 is an explanatory diagram of an effect combination table.

FIG. 29 is an explanatory diagram of a roulette stop pattern.

FIG. 30 is an explanatory diagram of a stop pattern random determination table.

DESCRIPTION OF THE PREFERRED EMBODIMENTS (Overview of Slot Machine)

Figure 1:
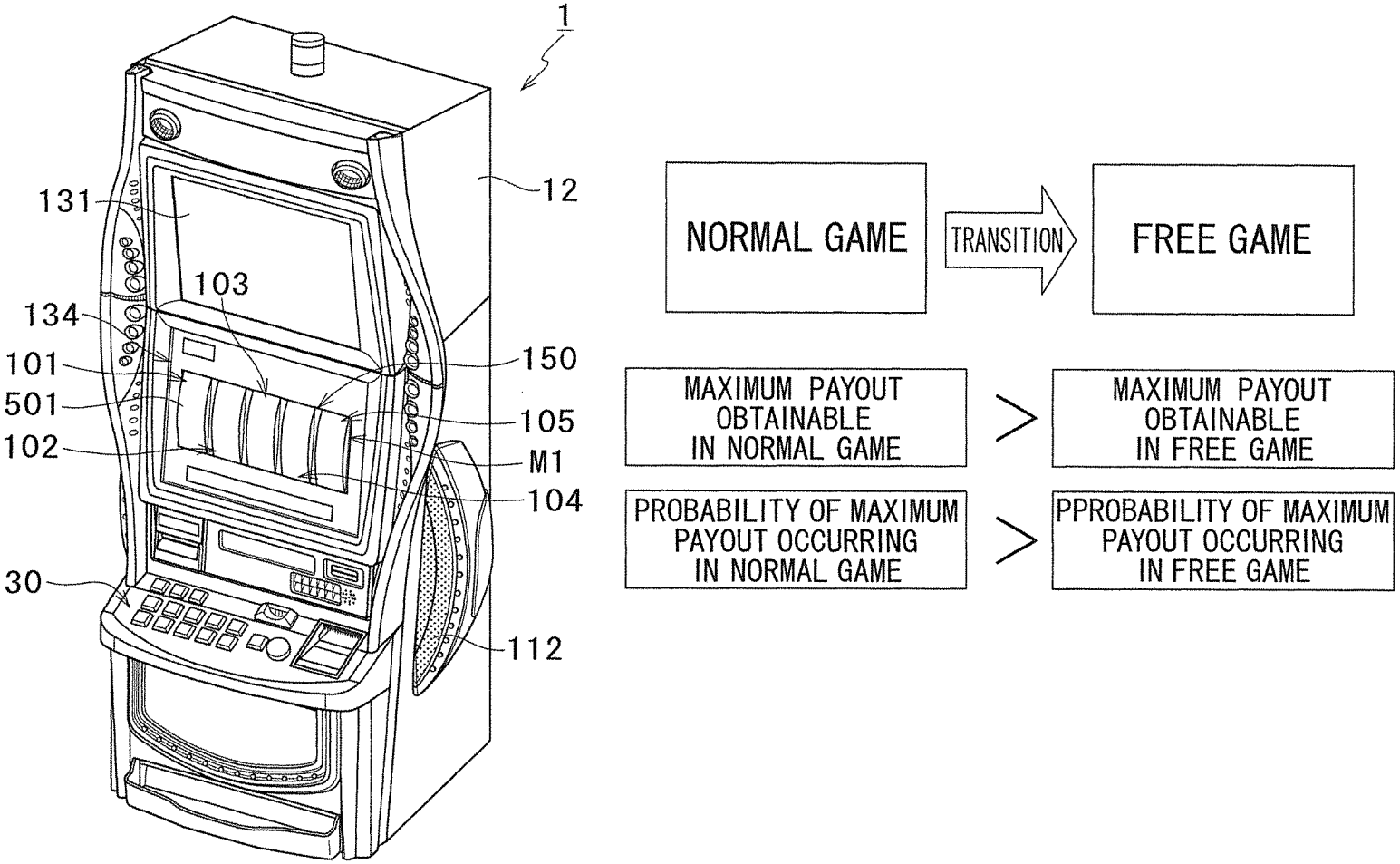
FIG. 1 is an explanatory diagram showing the outline of a game of a slot machine.

The following will describe an embodiment of the present invention with reference to figures. As shown in FIG. 1, a slot machine 1 is a type of gaming machine configured to run a normal game and a free game which develops from the normal game. Such a slot machines 1 includes a storage device (RAM 73) storing a free game payout table 192 and a normal game payout table 191, wherein a maximum payout obtainable in the normal game is higher than a maximum payout obtainable in the free game, and a chance of winning the maximum payout in the normal game is higher than a chance of winning the maximum payout in the free game. Further, the normal game and the free game, and the like are controlled by a controller (main CPU 71, and the like) built in the slot machines 1.

Figure 20:
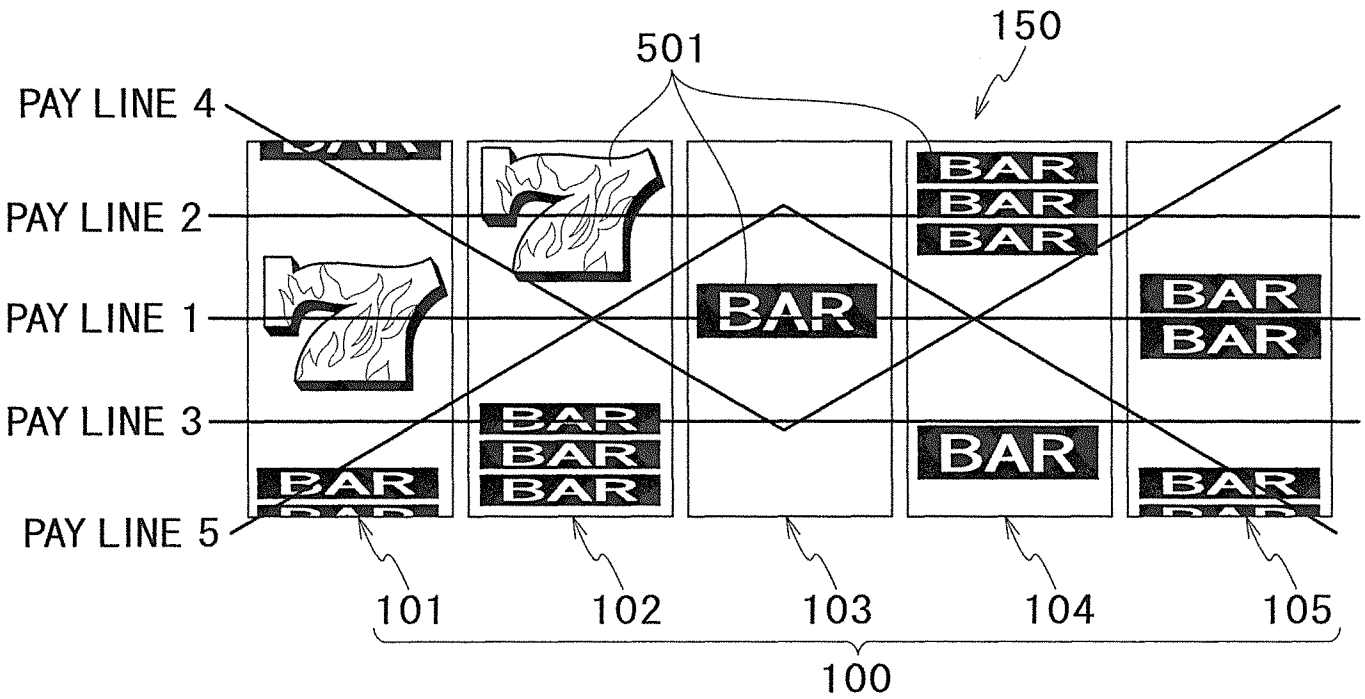
FIG. 20 is an explanatory diagram of display windows of the slot machine.
Figure 21:
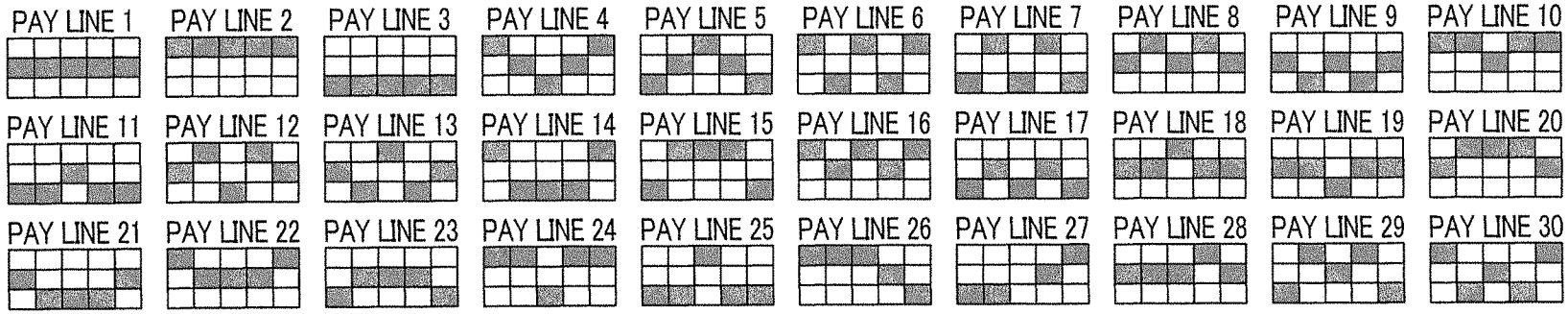
FIG. 21 is an explanatory diagram showing paylines related to an embodiment.

Further, the in the normal game and the free game, paylines (payline 1 to payline 30) are set in the display windows 150 (see FIG. 20 and FIG. 21). A benefit such as a payout and the like is awarded to the player, according to a combination of symbols 501 rearranged on a payline activated by betting placed by the player.

(Definitions and the Like)

The above described slot machines 1 is a type of gaming machine. The present embodiment deals with a case where the slot machine 1 is the gaming machine; however, the present invention is not limited to this, and is applicable to any given gaming machine configured to independently run any type of normal game and a free game which develops from the normal game.

The normal game in the present embodiment is run by the slot machines 1, in the present embodiment. The normal game is a slot game where a plurality of symbols 501 (see FIG. 6 and the like) are rearranged. It should be noted that the normal game is a concept which is different from the free game, bonus game, roulette game.

The rearrangement of the symbols in the slot game is conducted on the reel unit M1. The slot game includes processes of: running a normal game on condition that a gaming value is bet, in which normal game the symbols are rearranged by the reel unit M1 on the display window 150, and awarding a normal payout according to the symbols rearranged; and when the symbols are rearranged to meet a predetermined condition, running a free game where the symbols are rearranged under a condition different from that of the normal game, and awarding a payout according to the symbols rearranged.

The symbols here collectively means a "RED 7", "BLUE 7", "3BAR", "2BAR", "1BAR", "WILD1", "WILD2", "WILD3", "BLANK", and "BONUS".

A coin, a bill, or electrically valuable information corresponding to these is used as a gaming value. Note that the gaming value in the present invention is not particularly limited. Examples of the gaming value include game media such as medals, tokens, cyber money, tickets, and the like. A ticket is not particularly limited, and a later-mentioned barcoded ticket may be adopted for example.

In the present embodiment, the free game may be any type of game, provided that the free game provides a player with a different gaming mode from that of the normal game. The "free game" is a game runnable with a bet of fewer gaming values than the normal game. Note that "bet of fewer amounts of gaming values" encompasses a bet of zero (0) gaming value. In the present embodiment, the "free game" is a game runnable without a condition of betting a gaming value, and yet awards a gaming value according to the symbols rearranged. In other words, the "free game" may be a game which is started without consumption of a gaming value. To the contrary, the "normal game" is a game runnable on condition that a gaming value is bet, which normal game awards an amount of gaming value based on the symbols rearranged. In other words, the "normal game" is a game which starts with consumption of a gaming value. It should be noted that the name of the free game may be "bonus game".

The expression rearrange in this specification means dismissing an arrangement of symbols, and arranging symbols once again. Arrangement means a state where the symbols can be visibly confirmed by a player.

(Function Flow)

Figure 2:
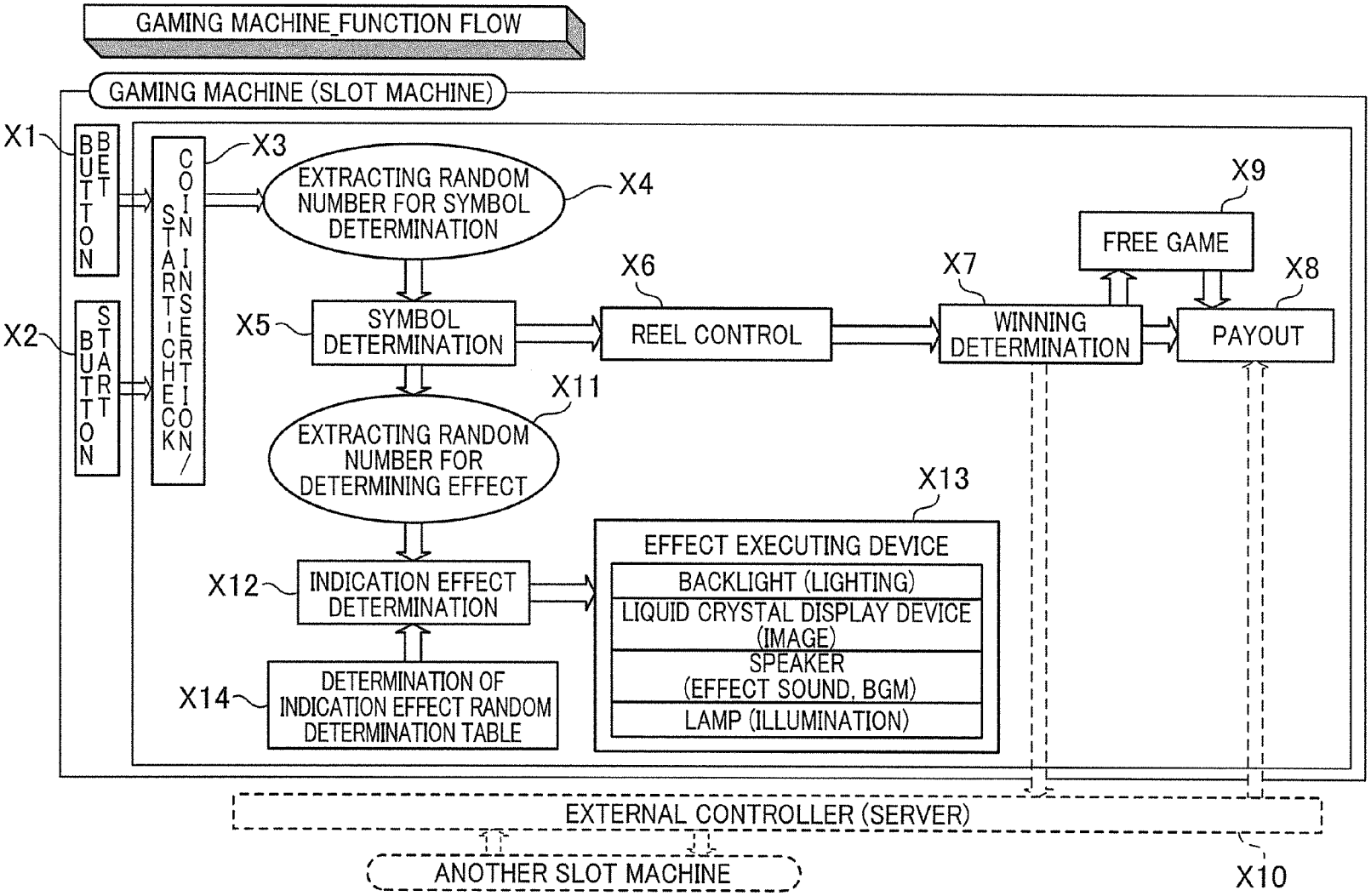
FIG. 2 is a functional flow of the gaming machine related to the present invention.

To begin with, the basic functions of the slot machine (gaming machine) of the present invention will be described with reference to FIG. 2.

(Coin-Insertion/Start-Check)

First, the slot machine checks whether or not a BET button X1 has been pressed by a player, and subsequently checks whether or not a start button X2 has been pressed by the player (X3).

(Symbol Determination)

Next, when the start button X2 has been pressed by the player, the slot machine extracts a random number for symbol determination (X4), and determines symbols to be displayed (rearranged) for the player at the time of stopping the scroll of reels, for respective reels (X5).

(Reel Control)

Thereafter, the slot machine starts the rotation of each reel and stops the rotation of each reel so that the determined symbols are displayed for the player (X6).

(Winning Determination)

Subsequently, as the rotation of each reel is stopped, the slot machine determines whether the combination of the symbols displayed for the player is a combination related to winning (X7).

(Payout)

When the combination of symbols displayed for the player is a combination related to winning, the slot machine offers, to the player, prize (benefit) according to the combination (X8). For example, when a combination of symbols related to a payout of coins has been displayed, the slot machine pays out coins of the number corresponding to the combination of symbols to the player.

(Free Game)

When it is determined in X7 that a free game trigger is established, the slot machine starts a free game (X9). In such a case, the benefit resulting from the free game is awarded to the player (X8). Alternatively, in each game, the slot machine may calculate the amount (amount for accumulation) to be accumulated to the amount of jackpot and transmit to an external controller X10. In such a case, as indicated by dotted lines in FIG. 2, a plurality of slot machines are connected to the external controller X10. The external controller X10 adds the amount of accumulation sent from each slot machine to the amount of jackpot, and the amount of accumulation (or a part thereof) is paid out to the player of the slot machine having obtained the jackpot.

(Indication Effect)

The slot machine extracts an effect random number (X11), and selects one indication effect random determination table from a plurality of indication effect random determination tables based on the randomly-determined symbols or the like (X14). Using the selected indication effect random determination table, the content of the indication effect is determined (X12). Based on the determined content of the indication effect, the slot machine conducts the indication effect by illuminating each symbol on the reels by the backlight, displaying images on the liquid crystal display device, outputting light from a lamp, and/or outputting sound from a speaker (X13).

(Overall Structure of Slot Machine 1)

The following describes an overall structure of a slot machine 1.

A coin, a bill, or electrically valuable information corresponding to these is used as game media in the slot machines 1. Further, in the present embodiment, a later-described ticket with a barcode is also used. It is to be noted that the game media are not limited to these, and for example a medal, a token, electric money or the like can be adopted.

Figure 3:
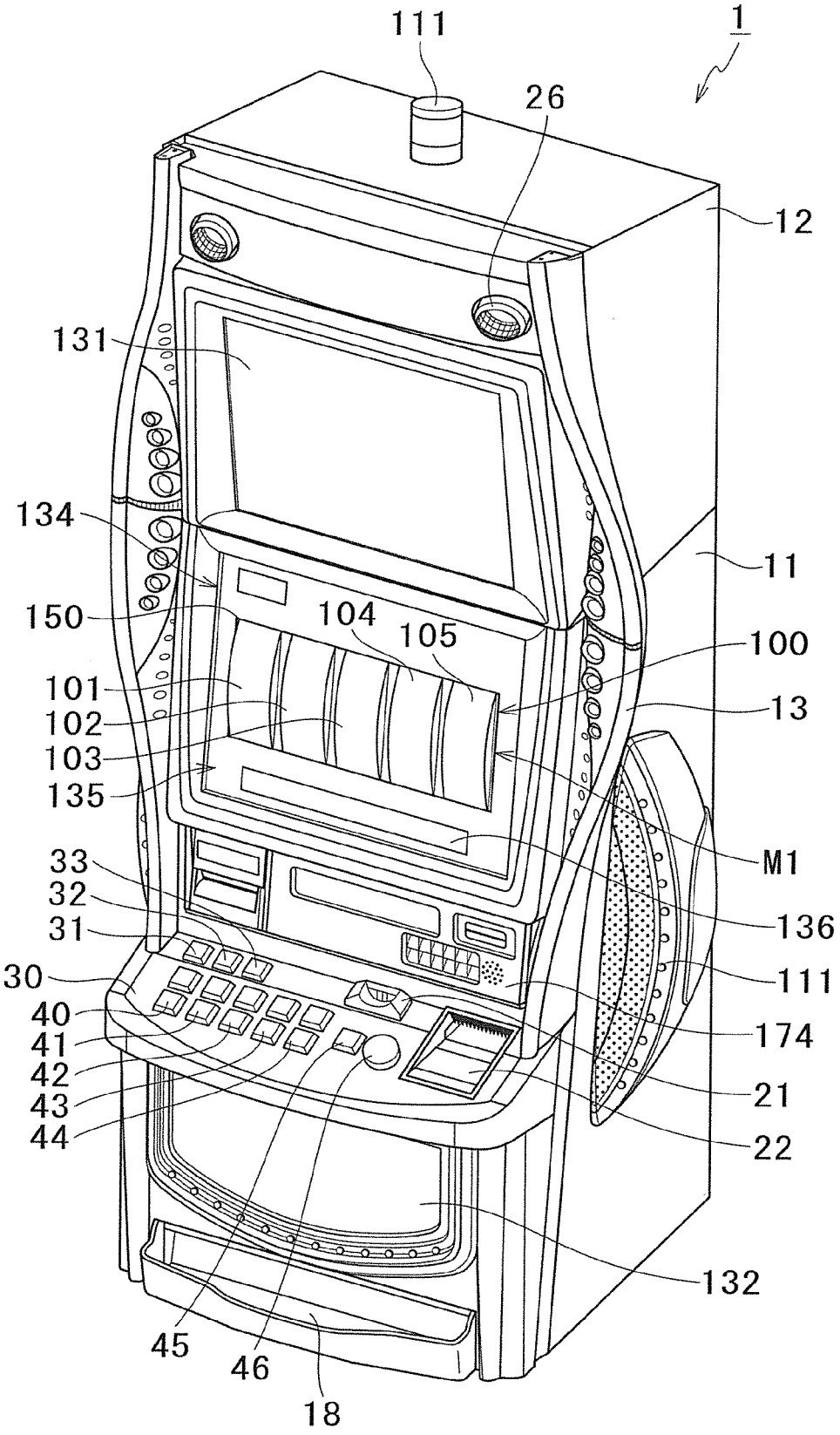
FIG. 3 is a diagram showing the entire structure of the slot machine.
Figure 4:
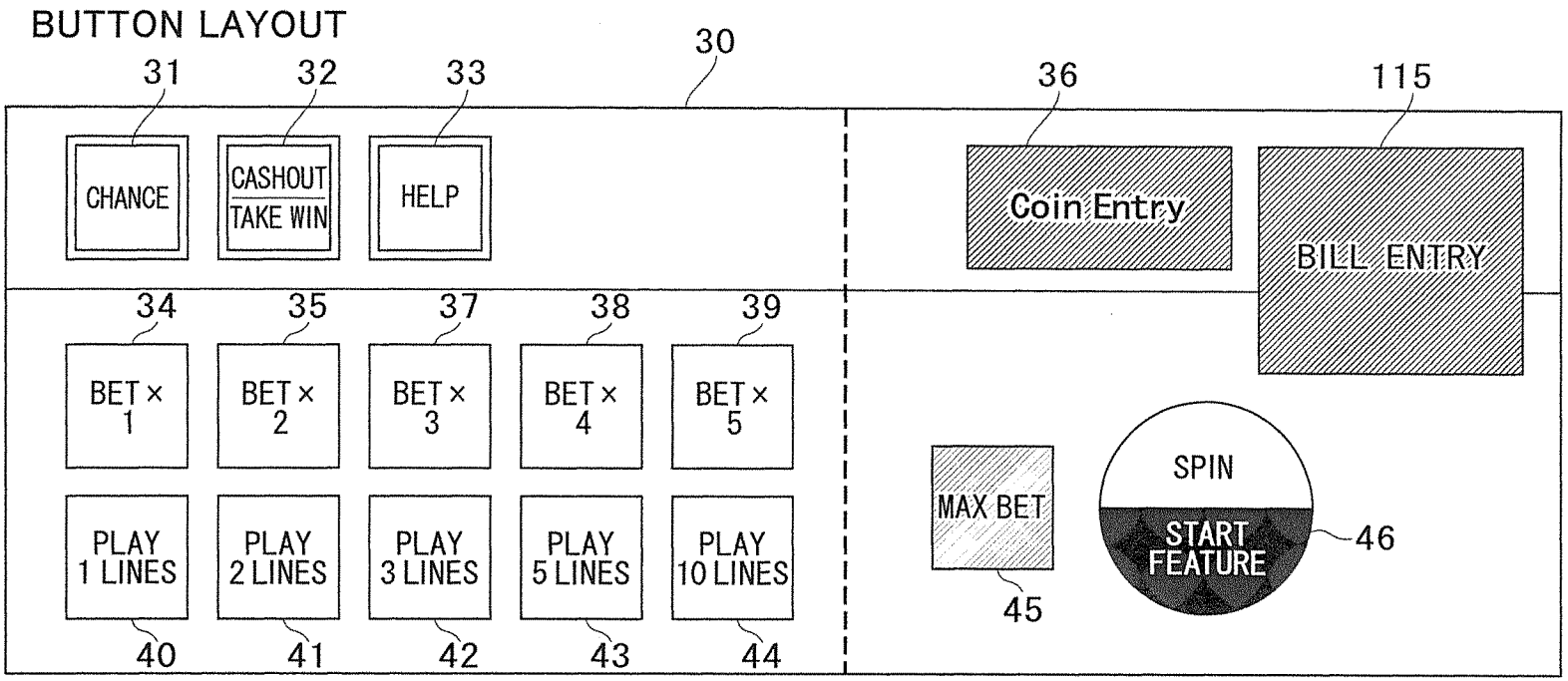
FIG. 4 is a diagram showing a control panel of the slot machine.

As shown in FIG. 3, the slot machine 1 has a cabinet 11, a top box 12 provided above the cabinet 11, and a main door 13 provided on the front face of the cabinet 11. The cabinet 11 is provided with a speaker 112 and a lamp 111.

The main door 13 is provided with a reel unit M1 (corresponding to symbol display device) constituted by five reels 101, 102, 103, 104, and 105 (see FIG. 20). On the front surface of the reel unit M1 is provided a reel cover 135. On the front surface of the reel cover 135 are provided a liquid crystal display device 134 and a transparent panel. Each of the liquid crystal display device 134 and the transparent panel may be provided with a touch panel. The reel cover 135 has a display window 150 at the central portion. Further, the reel cover 135 has a VFD display device 136 configured to indicate the gaming status to the player. The display windows 150 allow 15 symbols 501 forming a matrix of three rows and five columns to be viewable from the outside (see FIG. 20). On the outer circumferential surface of each of the reels 101, 102, 103, 104, and 105, twelve symbols shown in FIG. 6 are depicted. These twelve symbols 501 are lined up along the rotational direction of the reels 101, 102, 103, 104, and 105 to form a symbol array. Each of the symbol arrays is a combination of "RED 7", "BLUE 7", "3BAR", "2BAR", "1BAR", "WILD1", "WILD2", "WILD3", "BLANK", and "BONUS".

As show in FIG. 20 and FIG. 21, paylines are arranged in the slot machine 1, for determining a win or lose based on the symbols 501 rearranged on the display windows 150. In the present embodiment, there are a total of thirty (30) paylines 1 to 30 are formed, as shown in FIG. 21. It should be noted that FIG. 20 only shows paylines 1 to 5 for the sake of convenience.

The number of active paylines out of the paylines 1 to 30 is determined based on operations of a 1-bet button 34, a 2-bet button 35, a 3-bet button 37, a 4-bet button 38, a 5-bet button 39, a max-bet button 45, a play-1-line button 40, a play-2-line button 41, a play-3-line button 42, a play-5-line button 43, and a play-10-line button 44 on the later-described control panel 30. A win or loss is determined based on a combination of symbols 501 rearranged on activated paylines out of the paylines 1 to 30.

In the descriptions below, winning achieved according to a payline will be referred to as line winning, whereas winning achieved by a scattered symbol will be referred to as scattered winning. Furthermore, to achieve winning may be simply referred to as WIN. Furthermore, credits obtained as a result of achieving winning may be referred to as WIN credits.

As shown in FIG. 20, the reel unit M1 rearranges the symbols 501 on the display windows 150 by drivingly rotating the reels 101, 102, 103, 104, and 105 each having the symbols 501 on the outer circumferential surface. In the descriptions below, the reels may be referred to as a 1st reel 101, a 2nd reel 102, a 3rd reel 103, a 4th reel 104, and a 5th reel 105 from the left end in front elevation.

On the inner circumferential side of each of the reels 101, 102, 103, 104, and 105 arranged as above, the backlight unit M7 is provided. The backlight unit M7 is arranged so that illuminating light is emitted from the inner circumferential side of the reels 101, 102, 103, 104, and 105 toward the outer circumferential surface side of the reels so that the illumination light passing through the outer circumferential surfaces of the reels is viewable from the outside of the display windows 150.

The backlight unit M7 is configured to be able to change the amount of illumination light in multiple stages. The degree of freedom in the effects using illumination light is therefore high.

Furthermore, as descried above, the backlight unit M7 is able to emit light in multiple colors. The symbols are illuminated with the illumination light of the following colors. For example, the symbol of "RED 7" is illuminated in red. In the case of winning, the symbol of "RED 7" is illuminated in flame scarlet.

It should be noted that the present embodiment deals with a case where the slot machine 1 employs the reel device M1 in the form of mechanical reels; however, the slot machine 1 of the present invention may adopt video reels that display pseudo reels, or adopt a combination of the video reels and the mechanical reels. Furthermore, the slot machines 1 may be provided with a touch panel. In such a case, a player is able to input instructions through the touch panel. Input signals are sent from the touch panel to the main CPU 71.

Figure 22:
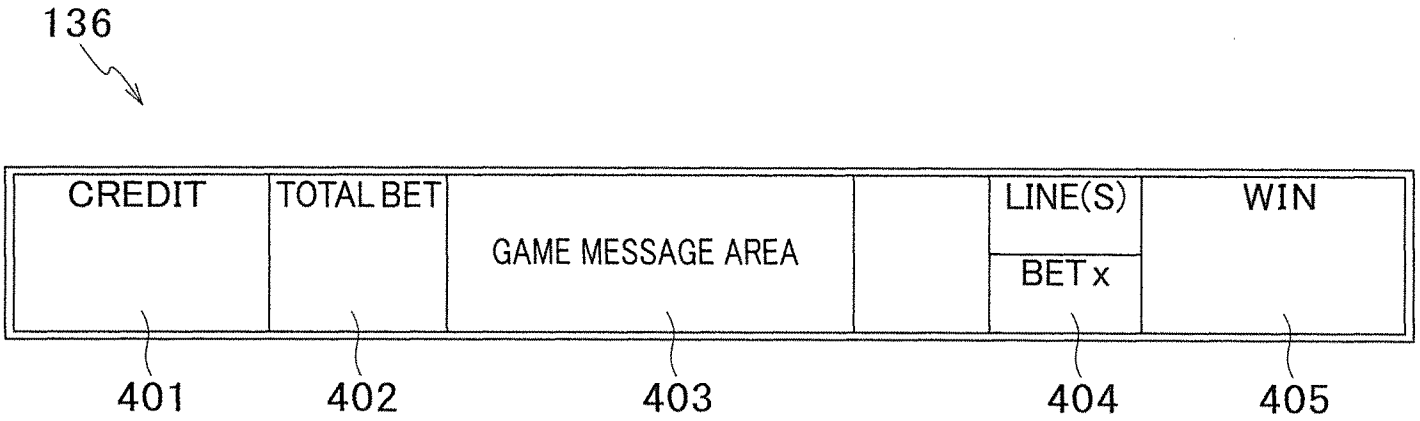
FIG. 22 is an explanatory diagram of a screen displayed on a VFD display device of the slot machine.

As shown in FIG. 22, on the VFD display device 136 is displayed meters indicating the conditions of the game. A credit meter 401 indicates the total amount of credit at the time. The initial value is zero. The numerical value is increased or decreased according to the gaming value input, the bet, and the game result. Further, a total bet meter 402 indicates a "Total bet (=bet×lines)". The numerical value is re-calculated at every game play. A game message area 403 indicates a message explaining the current gaming status. A line bet meter 404 indicates the number of paylines bet and a bet amount. A win meter 405 increments and displays the total credit of the prizes having been won.

(Structure of Control Panel 30)

Below the reel unit M1 is provided various buttons arranged on the control panel 30, a coin entry 36 which accepts coins into the cabinet 11, and a bill entry 115.

On the control panel 30, a change button 31, a cashout/take win button 32, a help button 33 are arranged in the upper stage of the left side area, while the 1-bet button 34, the 2-bet button 35, the 3-bet button 37, the 4-bet button 38, the 5-bet button 39, the play-1-line button 40, the play-2-line button 41, the play-3-line button 42, the play-5-line button 43, and the play-10-line button 44 are arranged in the lower stage on the left side area. Further, the coin entry 36 and the bill entry 115 for accepting bills and the like are arranged in the upper stage on the right side area, and the max-bet button 45 and the spin button 46 are arranged in the lower stage on the right side area.

The change button 31 is an operation button used when a player leaves the machine or when the player requests a staff person of the gaming facility to exchange money. The cashout/take win button 32 is an operation button used when checking out coins (credit) reserved in the slot machine 1 is discharged. The help button 33 is pressed when, for example, it is unclear how to play a game. As the help button 33 is pressed, various help information is displayed on a later-described upper image display panel 131.

The 1-bet button 34 is used for placing, on an active payline, a bet of 1 credit out of the credits owned by the player, every time it is pressed. The 2-BET button 35 is used for starting the game with a bet of 2 credits on an active payline. The 3-bet button 37 is used for starting the game with a bet of 3 credits on an active payline. The 4-bet button 38 is used for starting the game with a bet of 4 credits on an active payline. The 5-bet button 39 is used for starting the game with a bet of 5 credits on an active payline. The max-bet button 45 is used for starting the game with a bet of 10 credits on an active payline. As such, the bet amount on each active payline is determined by pressing the 1-bet button 34, the 2-bet button 35, the 3-bet button 37, the 4-bet button 38, the 5-bet button 39, and the max-bet button 45.

The play-1-line button 40, when pressed, activates a payline. Pressing this button increases the number of paylines activated by "1". The play-2-line button 41, when pressed, activates paylines. Pressing this button increases the number of paylines activated by "2". The play-3-line button 42, when pressed, activates paylines. Pressing this button increases the number of paylines activated by "3". The play-5-line button 43, when pressed, activates paylines. Pressing this button increases the number of paylines activated by "5". The play-10-line button 44, when pressed, activates paylines. Pressing this button increases the number of paylines activated by "10".

The spin button 46 is used to start the scroll of the reels 101, 102, 103, 104, and 105.

The coin entry 36 is used for receiving coins into the cabinet 11. The bill entry 115 validate bills and receives genuine bills into the cabinet 11.

(Other Arrangements)

On the lower front surface of the main door 13, i.e., below the control panel 30, a coin outlet 18 for paying out coins, and a belly glass 132 on which a character of the slot machine 1 or the like is depicted are provided.

On the front surface of the top box 12 is provided an upper image display panel 131. The upper image display panel 131 is made up of a liquid crystal panel and constitutes a display. The upper image display panel 131 displays image concerning effects, an introduction to games, images for explaining rules of games, or the like.

Below the upper image display panel 131 is provided a data displayer 174. The data displayer 174 is made up of a VFD (Vacuum Fluorescent Display) 177, a LED, or the like and displays, for example, member data read out from an inserted IC card, the status of a game, or the like.

(Symbol Array)

Next, with reference to FIG. 6, the following describes arrays of symbols 501 on the 1st reel 101, the 2nd reel 102, the 3rd reel 103, the 4th reel 104, and the 5th reel 105 of the slot machine 1.

A symbol table shown in FIG. 6 shows arrays of symbols 501 which are displayed on the outer circumferential surfaces of the reels. To each of the 1st reel 101, the 2nd reel 102, the 3rd reel 103, the 4th reel 104, the 5th reel 105 is assigned a symbol array including 22 symbols 501 respectively corresponding to code numbers 0 to 21.

As shown in FIG. 6, the types of symbols include "RED 7", "BLUE 7", "3BAR", "2BAR", "1BAR", "WILD1", "WILD2", "WILD3", "BLANK", and "BONUS". It should be noted that the "WILD1", "WILD2", and "WILD3" are all illustrated only on the outer circumferential surfaces of the reels 102 to 105.

Further, as shown in FIG. 6, weight values corresponding to the normal game are set to the 22 symbols corresponding to the code numbers 0 to 21. The weight values are each a probability of having the corresponding symbols 501 rearranged in the middle stage of the display window 150. For example, as shown in FIG. 6, the "2BAR" corresponding to the code number 0 of the 1st reel 101 is rearranged in the middle stage of the display window 150 at a probability of 10/206. Further, the "WILD1" corresponding to the code number 0 of the 2nd reel 102 is rearranged in the middle stage of the display window 150 at a probability of 2/100.

Although the description above is provided based on the symbol table shown in FIG. 6, it is possible to use symbol tables of FIG. 7 to FIG. 12, so as to meet the regulations of the country or area.

In the free game of the present embodiment, a symbol table shown in FIG. 13 is used, and weight values corresponding to the free game are set. In the free game too, symbol tables shown in FIG. 14 to FIG. 19 may be used so as to meet the regulations of the country or the area.

(Circuit Configuration in Slot Machine 1)

Figure 5:
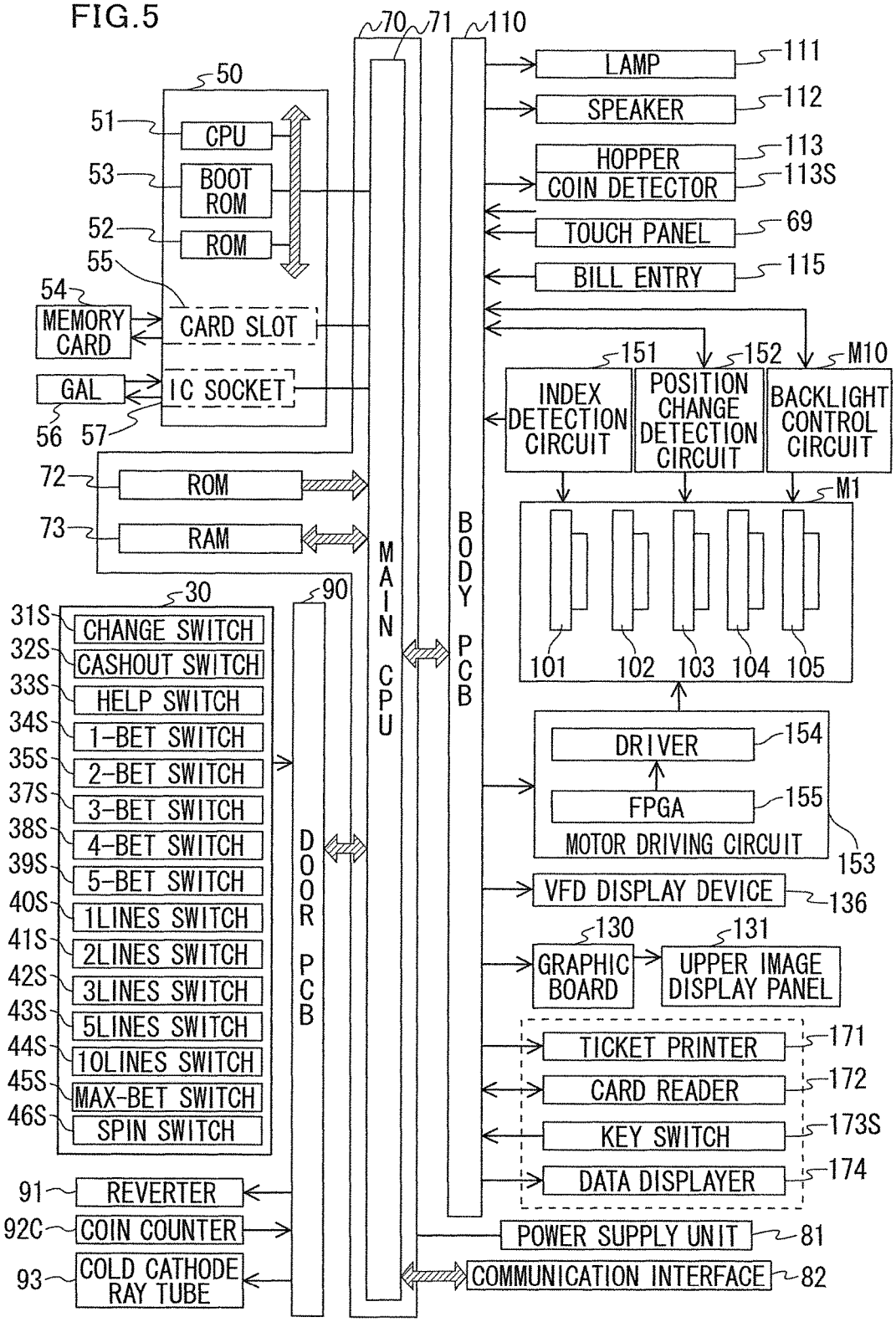
FIG. 5 is a block diagram of the internal structure of the slot machine.

The following describes a circuitry structure of the slot machine 1, with reference to FIG. 5. A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a nonvolatile memory, and stores a game program and a game system program. The game program includes a program related to game progression, a random determination program, various tables, and a program for producing effects by images and sounds.

Further, the card slot 55 is configured so that the memory card 54 can be inserted thereinto and removed therefrom, and is connected to a motherboard 70 by an IDE bus.

The GAL 56 is a type of PLD (Programmable Logic Device) having a fixed OR array structure. The GAL 56 is provided with a plurality of input ports and output ports, and a predetermined input into the input port causes output of the corresponding data from the output port.

Further, the IC socket 57 is configured so that the GAL 56 can be inserted thereinto and removed therefrom, and is connected to the motherboard 70 by a PCI bus. The contents of the game to be played on the slot machine 1 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the preliminary authentication program, and the like.

The authentication program is a program (falsification check program) for authenticating the game program and the game system program. The pre-authentication program is a program for authenticating the aforementioned preliminary authentication program. The authentication program and the preliminary authentication program are written along a procedure (authentication procedure) for proving that the program to be the subject has not been falsified.

The motherboard 70 is provided with a main CPU 71, a ROM 72, a RAM 73, and a communication interface 82.

The ROM 72 includes a memory device such as a flash memory, and stores a program such as BIOS to be executed by the main CPU 71, and permanent data. When the BIOS is executed by the main CPU 71, processing for initializing predetermined peripheral devices is conducted; Further, through the gaming board 50, processing of loading the game program and the game system program stored in the memory card 54 is started.

The RAM 73 stores data and programs which are used in operation of the main CPU 71. For example, when the processing of loading the aforementioned game program, game system program or authentication program is conducted, the RAM 73 can store the program. The RAM 73 is provided with working areas used for operations in execution of these programs. Examples of the areas include: an area that stores the number of games, the number of BETs, the number of payouts, the number of credits and the like; and an area that stores symbols (code numbers) randomly determined.

The communication interface 82 is for communicating with an external controller such as a server, through a communication line. Further, the motherboard 70 is connected with a later-described door PCB (Printed Circuit Board) 90 and a body PCB 110 by respective USBs. The motherboard 70 is also connected with a power supply unit 81.

When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the body PCB 110 are connected with input devices such as a switch and a sensor, and peripheral devices the operations of which are controlled by the main CPU 71.

The door PCB 90 is connected with a control panel 30, a reverter 91, a coin counter 92C and a cold cathode tube 93.

On the control panel 30 are a change switch 31S, a cashout switch 32S, a help switch 33S, a 1-bet switch 34S, a 2-bet switch 35S, a 3-bet switch 37S, a 4-bet switch 38S, a 5-bet switch 39S, a play-1-line switch 40S, a play-2-line switch 41S, a play-3-line switch 42S, a play-4-line switch 43S, a play-10-line switch 44S, a max-bet switch 45S, and a spin switch 46S which correspond to the above mentioned buttons, respectively. Each switch detects that the corresponding button has been pressed by a player, and outputs a signal to the main CPU 71.

The coin counter 92C validates an inserted coin based on its material, shape and the like, and outputs a signal to the main CPU 71 upon detection of a valid coin. Invalid coins are discharged from a coin outlet 18.

The reverter 91 operates based on a control signal outputted from the main CPU 71, and distributes valid coins validated by the coin counter 92C into a hopper 113 or a cash box (not illustrated). That is, coins are distributed into the hopper 113 when the hopper 113 is not filled with coins, while coins are distributed into the cash box when the hopper 113 is filled with coins.

The cold cathode tube 93 functions as a backlight installed on the rear face side of the upper image display panel 131, and lights up based on a control signal output from the main CPU 71.

The body PCB 110 is connected with the lamp 111, the speaker 112, the hopper 113, a coin detector 1135, a touch panel 69, the bill entry 115, a graphic board 130, a VFD display device 136, an index detection circuit 151, a position change detection circuit 152, a backlight control circuit M10, a motor driving circuit 153, a ticket printer 171, a card reader 172, a key switch 173S, and the data displayer 174. The index detection circuit 151, the position change detection circuit 152, the motor driving circuit 153, and the backlight control circuit M10 are connected to the reel unit M1.

The lamp 111 is turned on based on a control signal output from the main CPU 71. The speaker 112 outputs sounds such as BGM, based on a control signal outputted from the main CPU 71.

The hopper 113 operates based on a control signal outputted from the main CPU 71, and pays out coins of the specified number of payouts to the coin outlet 18. The coin detector 1135 outputs a signal to the main CPU 71 upon detection of coins paid out by the hopper 113.

The touch panel 69 detects a place touched by the player's finger or the like, and outputs to the main CPU 71 a signal corresponding to the detected place. Upon acceptance of a valid bill, the bill entry 115 outputs to the main CPU 71 a signal corresponding to the face amount of the bill.

The graphic board 130 controls display of images conducted by the lower image display panel 141, based on a control signal outputted from the main CPU 71. The graphic board 130 is provided with a VDP generating image data, a video RAM temporarily storing the image data generated by the VDP, and the like.

The VFD display device 136 displays an image based on a control signal output from the main CPU 71.

The motor driving circuit 153 is provided with a FPGA (Field Programmable Gate Array) 155 and a driver 154. The motor driving circuit 153 is connected to a stepper motor that rotates the reels 101, 102, 103, 104, and 105.

The FPGA 155 is a programmable electronic circuit such as LSI and functions as a control circuit of the stepper motor. The driver 154 functions as an amplifying circuit for amplifying a pulse input to the stepper motor.

The index detection circuit 151 detects the positions of the rotating reels 101, 102, 103, 104, and 105 and is able to detect the step out of the reels 101, 102, 103, 104, and 105.

The position change detection circuit 152 detects a change in the stop positions of the reels 101, 102, 103, 104, and 105 after the rotation of the reels 101, 102, 103, 104, and 105 is stopped. The position change detection circuit 152 detects a change in the stop positions of the reels 101, 102, 103, 104, and 105 when, for example, a stop position is changed to achieve a winning combination of the symbols 501 by an illicit way when no winning combination of the symbols 501 is achieved. The position change detection circuit 152 is configured to be able to detect a change in the stop positions of the reels 101, 102, 103, 104, and 105 by, for example, detecting unillustrated fins attached at predetermined intervals to the inner circumferential part of each of the reels 101, 102, 103, 104, and 105.

The method of magnetic excitation of the stepper motor is not particularly limited; 1-2 phase excitation or 2 phase excitation may be employed. Furthermore, a DC motor may be used in place of the stepper motor. When a DC motor is used, an error counter, a D/A converter, and a servo amplifier are connected to the body PCB 110 in this order, and the servo amplifier is connected to the DC motor. The rotational position of the DC motor is detected by a rotary encoder, and a current rotational position of the DC motor is supplied as data from the rotary encoder to the error counter.

The backlight control circuit M10 is connected to the backlight units M7 to individually supply driving power thereto. Upon receiving an instruction from the main CPU 71, the backlight control circuit M10 changes the amount of light emitted in multiple stages. The five backlight units M7 provided on the inner circumference surfaces of the reels 101, 102, 103, 104, and 105 are able to individually illuminate 15 symbols 501 having stopped on the display windows 150 by means of the backlight control circuit M10.

Based on a control signal output from the main CPU 71, the ticket printer 171 prints on a ticket a barcode representing encoded data of the number of credits stored in the RAM 73, date, the identification number of the slot machine 1, and the like, and then outputs the ticket as the ticket 175 with a barcode.

The card reader 172 reads data stored in a card inserted into the card slot 176 and transmits the data to the main CPU 71, or writes data into the card based on a control signal outputted from the main CPU 71.

The key switch 173S is provided to the keypad 173. The key switch 173 outputs a predetermined signal to the main CPU 71 when the player operates the keypad 173.

Based on a control signal output from the main CPU 71, the data displayer 174 displays data read by the card reader 172, or data input through the keypad 173 by the player.

(Normal Game Payout Table)

The following describes a normal game payout table 191 with reference to FIG. 23.

The normal game payout table 191 shows a relation an amount of credit to be paid out for the type and the number of symbols 501 rearranged on an active payline out of the paylines 1 to 30. It should be noted that the normal game payout table 191 is read in the process of a later-described program process and is used as reference. In the present embodiment, a win is determined based on a combination of symbols "RED 7", "BLUE 7", "3BAR", "2BAR", "1BAR", "WILD1", "WILD2", "WILD3", "BLANK", and "BONUS", rearranged on an active payline out of paylines 1 to 30. For example, when three of "RED 7" are arranged in succession on an active payline, on the 1st reel 101 to the 3rd reel 103, the win is determined and 50 credits are paid out. Further, when four of "RED 7" are arranged in succession on an active payline, on the 1st reel 101 to the 4th reel 104, the win is determined and 100 credits are paid out. It should be noted that in determination of winning of the present embodiment, the symbols arranged on the payline are successively checked from the 1st reel 101 to the 5th reel 105 (Left to Right).

Further, when one or more "BONUS" symbols each serving as a trigger symbol for the free game are rearranged on the display windows 150 of the 1st reel 101, the 2nd reel 102, and the 3rd reel 103, a winning combination of "free game trigger" is determined, and the game transits to the free game (in the present embodiment, the free game is runnable 10 times). Specifically, the symbol of "BONUS" displayed on the 1st reel 101 to the 3rd reel 103 may be rearranged in any of the upper stage, the middle state, and the lower stage of each display window (paylines do not matter). For example, when the "BONUS" is rearranged in the lower stage of the 1st reel 101, in the middle stage of the 2nd reel 102, and in the lower stage of the 3rd reel 103, this is regarded as to be a winning combination of the "free game trigger". On the other hand, when the "BONUS" is rearranged in the upper stage of the 1st reel 101, in the upper stage of the 2nd reel 102, and in the middle stage of the 4th reel 104, this is not considered as a winning combination of "free game trigger" (because no symbol combination of "BONUS" is rearranged on the display windows 150 of the 3rd reel 103).

Further, in the present embodiment, when five "BONUS" symbols are rearranged on the payline 1, a winning combination of bonus award is established and 200000 credits are paid out. This winning combination of bonus award is a benefit obtainable only in the normal game, and is not obtainable in the free game. Further, the winning combination of bonus award is an award that occurs only when five "BONUS" symbols are rearranged on the payline 1. The bonus award is not considered as to be established when five "BONUS" symbols are rearranged on any of paylines 2 to 30, other than the payline 1.

As described, the normal game payout table 191 is set so that the maximum payout obtainable in the normal game (200000 credits) are awarded, when five "BONUS" symbols (predetermined symbols) are rearranged on a payline (predetermined payline) during the normal game. With this, the maximum payout obtainable in the normal game is awarded only when the predetermined symbol is rearranged on a predetermined payline in the normal game. Therefore, it is possible to easily and freely set the maximum payout.

(Free Game Payout Table)

The following describes a free game payout table 192 with reference to FIG. 24.

The free game payout table 192 shows a relation an amount of credit to be paid out for the type and the number of symbols 501 rearranged on a payline activated in the free game, out of the paylines 1 to 30. It should be noted that the free game payout table 192 is read in the process of a later-described program process and is used as reference. In the present embodiment, a win is determined based on a combination of symbols "RED 7", "BLUE 7", "3BAR", "2BAR", "1BAR", "WILD1", "WILD2", "WILD3", "BLANK", and "BONUS", rearranged on an active payline out of paylines 1 to 30. For example, when three of "RED 7" are arranged in succession on an active payline, on the 1st reel 101 to the 3rd reel 103, the win is determined and 50 credits are paid out. Further, when four of "RED 7" are arranged in succession on an active payline, on the 1st reel 101 to the 4th reel 104, the win is determined and 100 credits are paid out.

Further, in the free game, when one or more "BONUS" symbols each serving as a trigger symbol for the free game are rearranged on the display windows 150 of the 1st reel 101, the 2nd reel 102, and the 3rd reel 103, a winning combination of "retrigger" is determined, and five rounds of free game are added in the present embodiment.

As described, the winning combination of bonus award in the normal game is set to be the maximum payout in the normal game. Therefore, the maximum payout in the normal game is freely set simply by modifying the amount of payout for the winning combination of bonus award. If there is no winning combination of bonus award, the maximum payout of the normal game occurs when five "RED 7" symbols are rearranged (500 credits). Raising or lowering this maximum payout causes changes in the ranking of the winning combinations including symbols of "RED 7", "BLUE 7", "3BAR", and the like, consequently necessitating modification the entire payout pattern, e.g., payout when five "BLUE 7" symbols are arranged, a payout when five "3BAR" symbols are arranged, and the like. That is, when the maximum payout is to be modified due to the regulations of the country or the area, the entire normal game payout table 191 and the entire free game payout table 192 need to be modified, which ruins the flexibility. With the above structure however, the maximum payout in the normal game is freely set simply by modifying the amount of payout for the winning combination of bonus award, thus improving the flexibility.

Further, in the normal game payout table 191 and the free game payout table 192, the amounts of payouts other than the one for the winning combination of the bonus award are set to be the same. Therefore, by setting the winning combination of bonus award to "0 (none)", the maximum payout in the normal game is made the same as that in the free game. This way, it is easily possible to meet the regulation of the country or the area, even if the regulation requires that the maximum payout in the normal game be the same as that in the free game.

(Free Game Payout Rate Random Determination Count Determination Table)

Next, the following describes a free game payout rate random determination count determination table 193 with reference to FIG. 25.

The free game payout rate random determination count determination table 193 is a table used for determining how many times a random determination process is repeated to determine the free game payout rate. This random determination process determines the rate for the payout obtainable in the free game which is run when the winning combination of "free game trigger" occurs in the normal game and transition to the free game occurs. Specifically, if three "BONUS" symbols are rearranged on the display windows 150 when the winning combination of the "free game trigger" occurs, the free game payout rate random determination is executed once. Further, if four "BONUS" symbols are rearranged on the display windows 150 when the winning combination of the "free game trigger" occurs, the free game payout rate random determination is executed twice. Further, if five "BONUS" symbols are rearranged on the display windows 150 when the winning combination of the "free game trigger" occurs, the free game payout rate random determination is executed three times.

(Free Game Payout Rate Random Determination Table)

Next, the following describes a free game payout rate random determination table 194 with reference to FIG. 26.

Figure 36:
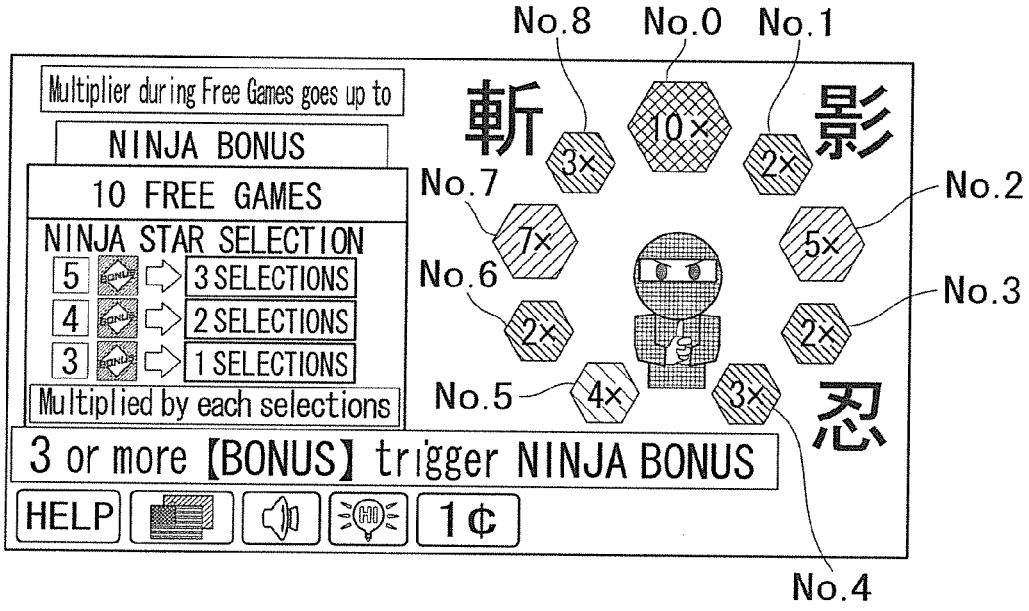
FIG. 36 is a diagram showing an example image displayed in the free game payout rate random determination process.

The free game payout rate random determination table 194 is a table used for determining the rate of payout obtainable based on the free game payout table 192 in the free game. The free game payout rate random determination table 194 includes settings of nine areas No. 0 to No. 8 each corresponds to a payout rate (see FIG. 36), respectively. As shown in FIG. 26 and FIG. 36, in the present embodiment, a payout rate of "×10" is associated with the area No. 0. A payout rate of "×2" is associated with the area No. 1. A payout rate of "×5" is associated with the area No. 2. A payout rate of "×2" is associated with the area No. 3. A payout rate of "×3" is associated with the area No. 4. A payout rate of "×4" is associated with the area No. 5. A payout rate of "×2" is associated with the area No. 6. A payout rate of "×7" is associated with the area No. 7. A payout rate of "×3" is associated with the area No. 8.

Further, to each of the nine areas No. 0 to No. 8 each corresponding to a payout rate, a weight value is set. The weight value is a probability of the corresponding one of the areas No. 0 to No. 8 of payout rates being resulting from the free game payout rate random determination. For example, as shown in FIG. 26, the probability of a payout rate of "×10" associated with the area No. 0 resulting from the free game payout rate random determination is 1/500. Further, the probability of a payout rate of "×2" associated with the area No. 1 resulting from the free game payout rate random determination is 98/500. The probability of a payout rate of "×5" associated with the area No. 2 resulting from the free game payout rate random determination is 5/500. The probability of a payout rate of "×2" associated with the area No. 3 resulting from the free game payout rate random determination is 100/500. The probability of a payout rate of "×3" associated with the area No. 4 resulting from the free game payout rate random determination is 52/500. The probability of a payout rate of "×4" associated with the area No. 5 resulting from the free game payout rate random determination is 50/500. The probability of a payout rate of "×2" associated with the area No. 6 resulting from the free game payout rate random determination is 92/500. The probability of a payout rate of "×7" associated with the area No. 7 resulting from the free game payout rate random determination is 2/500. The probability of a payout rate of "×3" associated with the area No. 8 resulting from the free game payout rate random determination is 100/500.

In the present embodiment, there are cases of executing a plurality of number of times the free game payout rate random determination based on the free game payout rate random determination table 194, according to the number of times of executing the random determination, which is determined based on the free game payout rate random determination count determination table 193. For example, where the free game payout rate random determination is determined as to be executed three times, and where the payout rate of "×10" is resulted in the free game payout rate random determination of the first time, the payout rate of "×5" in the second time, and the payout rate of "×7" in the third time, the payout rate for the payout obtainable in the free game is determined as to be ×350 which is the product of multiplication of the payout rates resulting from each of the free game payout rate random determinations (i.e., 10×5×7=350).

It should be noted that a payout rate having been resulted once from the random determination is excluded from the free game payout rate random determination thereafter. Therefore, if the payout rate of "×10" results in the free game payout rate random determination of the first time, the payout rate of "×10" will not result in the free game random determination of the second time and thereafter. Therefore, if the payout rate of "×5" results in the free game payout rate random determination of the second time, the payout rate of "×5" will not result in the free game random determination of the third time and thereafter.

In the present embodiment, the maximum payout obtainable in the free game occurs when five "RED 7" symbols are rearranged on an active payline (500 credits; see free game payout table 192 of FIG. 24), and the payout rate is x (10×7×5) as the result of executing three times the free game payout rate random determination. Therefore, the maximum payout in the free game is 175,000 credits (10×7×5×500=175,000). Meanwhile, the maximum payout obtainable in the normal game is 200,000 credits, which occurs when the winning combination of bonus award is established. Therefore, the maximum payout obtainable in the normal game (200,000 credits) is set higher than the maximum payout obtainable in the free game (175,000 credits). Further, the probability of obtaining the maximum payout obtainable in the normal game is set to be higher than the probability of obtaining the maximum payout obtainable in the free game (see FIG. 6, FIG. 13, FIG. 23, FIG. 24, FIG. 25, and FIG. 26).

The above structure makes the normal game more valuable (causes higher expectation for the maximum payout) than the free game, by setting the maximum payout and the chance of winning the maximum payout higher in the normal game than those in the free game.

(Effect Combination Table)

The effect combination tables 195 shown in FIG. 27 and FIG. 28 define the probabilities of effect combinations each constituted by indication effects for each combination condition of rearranged symbols. In the effect combination table 195, each combination number (No. fields: 0 to 43) of effects is associated with at least one indication effect, and the weights of respective combination conditions are associated with each combination number. The "Table A" to "Table H" indicate the tables from which a table is selected based on rearranged symbols. After any of the "Table A" to "Table H" is selected based on the combination condition, such as the number of "BONUS" symbols rearranged, one of the effect combinations is selected based on the weight.

In the effect combination tables 195 shown in FIG. 27 and FIG. 28, the items in the effect combination field, that is, "Before Start of Rotation (1)", "Before Start of Rotation (2)", "During Rotation till Stopping", and "After stopping" are types of effects mainly related to timings.

Details of contents of effect in the effect combination field are as follow.

Flash 1: Flashing Effect 1 by the backlight units M7.

Flash 2: Flashing Effect 2 by the backlight units M7.

Flash 3: Flashing Effect 3 by the backlight units M7.

Stopping 1 and 2 first: Effect of stopping the 1st reel 101 and the 2nd reel 102 first.

Low speed: Rotating the reels 101 to 105 at a low speed.

High speed: Rotating the reels 101 to 105 at a high speed.

High speed 2: Rotating the reels 101 to 105 at a higher speed.

Frame advance: Frame advancing the reels 101 to 105.
Design alignment: Effect of showing aligned designs of symbols on reels 101 to 105.
Rotating all: Rotating all the reels 101 to 105.
0: Resetting the reels 101 to 105.

For example, when the "Table A" of the combination condition in the effect combination table 195 is selected, the combination is randomly determined based on the "Table A". When the combination No. 28 is selected as the effect combination, the Flash 1 (Flashing Effect 1 by the backlight units M7) is executed for the "Before Start of Rotation (1)". Then, the Stopping 1 and 2 first (Effect of stopping the 1st reel 101 and the 2nd reel 102 first) is executed for the "Before Start of Rotation (2)". For the "During Rotation till Stopping", the Low speed (Rotating the reels 101 to 105 at a low speed) is executed. Then, no effect is executed for the "After stopping".

(Roulette Stop Pattern)

FIG. 29 is a table (roulette effect table) showing roulette stop patterns 196, i.e., stop patterns (effect types) of a roulette (see FIG. 36) displayed as an effect at the time of executing the free game payout rate random determination. There are eight types "a" to "h" of roulette stop patterns 196.

In the free game payout rate random determination of the present embodiment, nine areas (areas No. 0 to No. 8) of a roulette shown in FIG. 36 are sequentially lighted (which functions as the pointer) so as to provide an effect looking as if random determination is performed by the roulette. This effect more specifically is an effect in which the areas No. 0 to No. 8 looks like sequentially lighting, by repeating turning on and turning off of each area; e.g., turning off the area No. 0 while turning on the area No. 1→turning off the area No. 1 while turning on the area No. 2→ . . . . In this process, effects are given to the way of stopping the roulette by varying the period of lighting each area.

Specifically, as shown in FIG. 29, in a stop pattern "a", the period of lighting the each area is 5 frames (5/60 seconds) for the area No. 0 in the 1st round to the area No. 6 in the 2nd round. For the area No. 7 in the 2nd round, the period of lighting is 7 frames (7/60 seconds). For the area No. 8 in the 2nd round, the period of lighting is 12 frames (12/60 seconds). For the area No. 0 in the 3rd round, the period of lighting is 16 frames (16/60 seconds). For the area No. 1 in the 3rd round, the period of lighting is 21 frames (21/60 seconds). For the area No. 2 in the 3rd round, the period of lighting is 27 frames (27/60 seconds). For the area No. 3 in the 3rd round, the period of lighting is 34 frames (34/60 seconds). For the area No. 4 in the 3rd round, the period of lighting is 42 frames (42/60 seconds). For the area No. 5 in the 3rd round, the period of lighting is 51 frames (51/60 seconds). For the area No. 6 in the 3rd round, the period of lighting is 56 frames (56/60 seconds). For the area No. 7 in the 3rd round, the period of lighting is 60 frames (60/60 seconds). For the area No. 8 in the 3rd round, the period of lighting is 62 frames (62/60 seconds). For the area No. 0 in the 4th round, the period of lighting is 64 frames (64/60 seconds). For the area No. 1 in the 4th round, the period of lighting is 66 frames (66/60 seconds).

This way, the period of lighting gradually becomes longer, which provides an effect of gradually slowing down and stopping the movement of the lighting area.

It should be noted that the stop pattern and where the roulette stops are determined based on the result of the above described free game payout rate random determination (i.e., payout rate) and a stop pattern resulting from random determination based on a later described stop pattern random determination table 197. Further, stoppable areas are limited to areas encircled by the dotted line in FIG. 29. Therefore, for example, when the stop pattern "a" is selected, the roulette stops only at any of the areas No. 7, No. 8, No. 0, and No. 1.

(Stop Pattern Random Determination Table)

A stop pattern random determination table 197 shown in FIG. 30 is a table used for determining a stop pattern of the roulette (see FIG. 36) displayed as an effect, when the free game payout rate random determination is executed based on the result of the free game payout rate random determination (i.e., payout rate) and the total weight value.

For example, when the payout rate resulting from the free game payout rate random determination is "×10: No. 0", the stop pattern "a" is selected at the probability of 1/4, the stop pattern "b" is selected at the probability of 1/4, the stop pattern "g" is selected at the probability of 1/4, and the stop pattern "h" is selected at the probability of 1/4, as shown in FIG. 30. Then, when the stop pattern "a" is selected, the roulette stops at the area No. 0 in the 4th round (in this case, the area No. 1 does not turn on in the 4th round) according to the stop pattern "a" of the roulette stop patterns of FIG. 29.

Further, for example, when the payout rate resulting from the free game payout rate random determination is "×2: No. 1", the stop pattern "a" is selected at the probability of 1/4, the stop pattern "b" is selected at the probability of 1/4, the stop pattern "c" is selected at the probability of 1/4, and the stop pattern "h" is selected at the probability of 1/4, as shown in FIG. 30. When the stop pattern "h" is selected, the roulette stops at the area No. 1 in the 5th round according to the stop pattern "h" of the roulette stop patterns of FIG. 29.

(Contents of Program)

Next, programs executed by the slot machine 1 will be described.

(Main Control Process: Normal Game)

Figure 31:
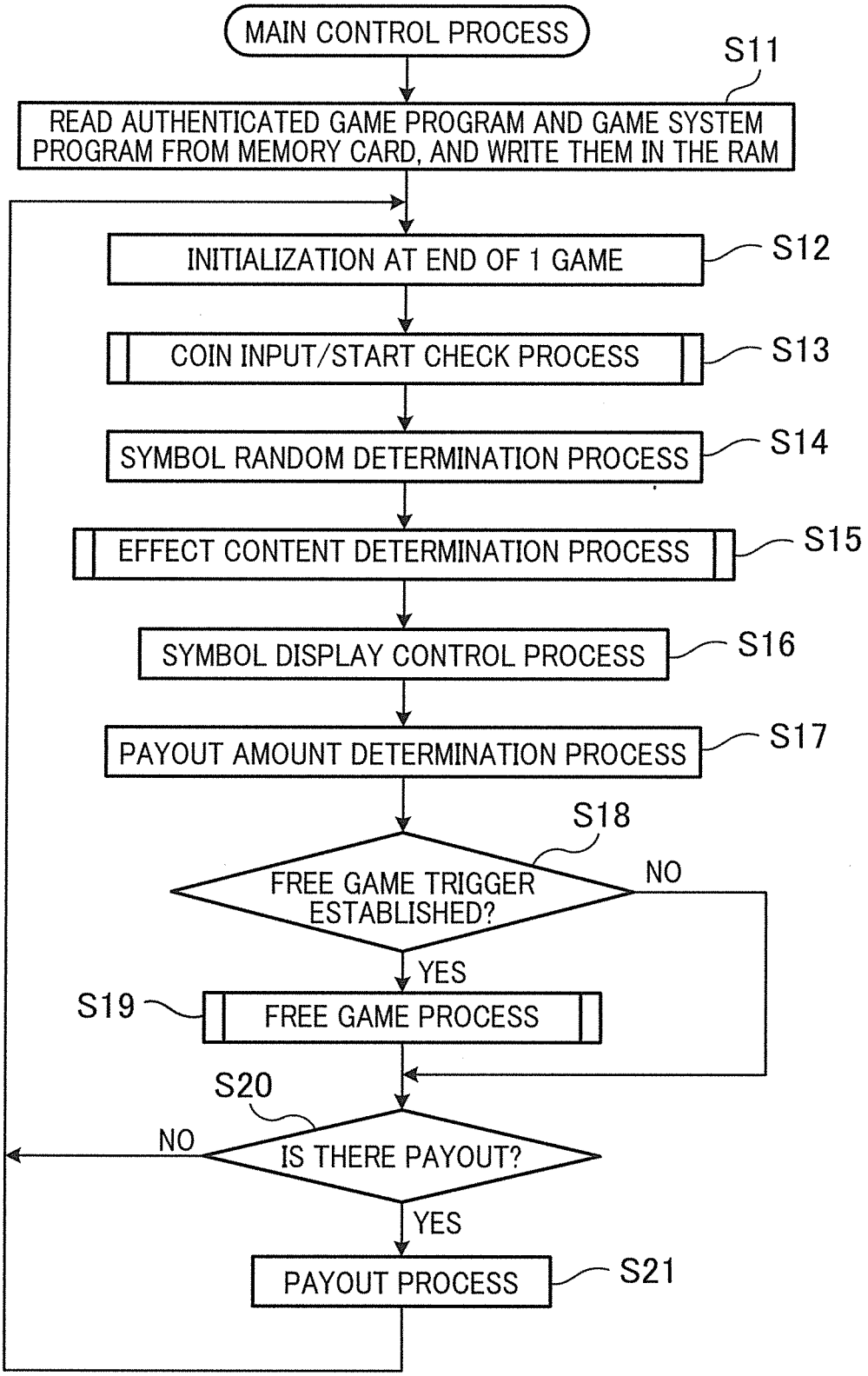
FIG. 31 is a flowchart of a main control process of the slot machine.

Referring to FIG. 31, a main control process will be described.

First, when the slot machine 1 is powered on, the main CPU 71 reads an authenticated game program and a game system program from a memory card 54 via a gaming board 50, and then write them in the RAM 73 (Step S11).

Next, the main CPU 71 executes an initializing process at the end of each round of the game (Step S12). This process clears data in a working area of the RAM 73, which becomes unnecessary at the end of each round of game, e.g., the amount of bet, symbols randomly determined, and the like.

Next, the main CPU 71 executes a coin input/start check process described later with reference to FIG. 32 (step S13). This process checks, for example, an input from the 1-bet switch 34S, the 2-bet switch 35S, the 3-bet switch 37S, the 4-bet switch 38S, the 5-bet switch 39S, the play-1-line switch 40S, the play-2-line switch 41S, the play-3-line switch 42S, the play-4-line switch 43S, the play-10-line switch 44S, the max-bet switch 45S, the spin switch 46S, and the like.

Next, the main CPU 71 executes a symbol random determination process (S14). In this process, symbols to be stopped are determined based on random numbers for symbol determination. In the present embodiment, symbols to be stopped on each of the reels 101 to 105 are determined according to the weight values of the 22 symbols corresponding to code numbers 0 to 21, shown in FIG. 6.

Figure 35:
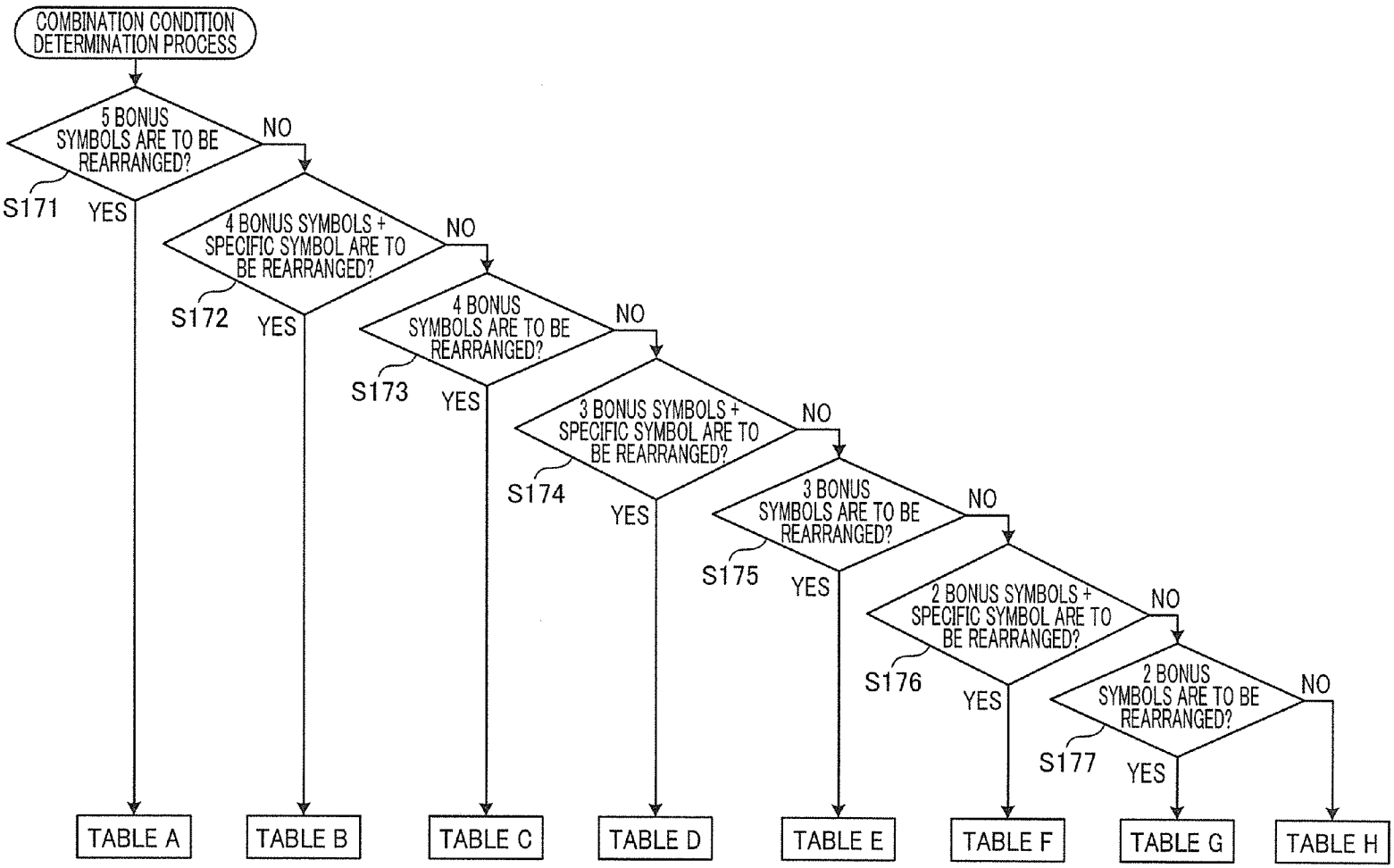
FIG. 35 is a flowchart of a combination condition determination process of the slot machine.

Next, the main CPU 71 executes an effect content determination process (step S15). In the effect content determination process, the combination condition determination process is first executed as shown in FIG. 35.

In the combination condition determination process, the main CPU 71 determines whether or not a total of five "BONUS" symbols are to be rearranged on the display windows 150 (one on each of the reels 101 to 105) as the result of symbol random determination process executed in S14 (S171). If it is determined that a total of five "BONUS" symbols are to be rearranged on the display windows 150 (one on each of the reels 101 to 105) (S171: Yes), The "Table A" is selected as the combination condition.

On the other hand, if it is determined that there will not be five "BONUS" symbols rearranged on the display windows 150 (S171: No), the CPU 71 determines whether or not a total of four "BONUS" symbols are to be rearranged on the display windows 150 (one on each of the reels 101 to 104), and whether or not any specific symbol out of "RED 7: No. 16", "3BAR: No. 20", and "BLANK: No. 21" is to be rearranged on the reel 105 (S172). In cases of (S172: Yes), the "Table B" is selected as the combination condition.

On the other hand, in cases of (S172: No), the CPU 71 determines whether or not a total of four "BONUS" symbols are to be rearranged on the display windows 150 (one on each of the reels 101 to 104) (S173). If it is determined that a total of four "BONUS" symbols are to be rearranged on the display windows 150 (one on each of the reels 101 to 104) (S173: Yes), The "Table C" is selected as the combination condition.

On the other hand, if it is determined that there will not be four "BONUS" symbols rearranged on the display windows 150 (S173: No), the CPU 71 determines whether or not a total of three "BONUS" symbols are to be rearranged on the display windows 150 (one on each of the reels 101 to 103), and whether or not any specific symbol out of "BLUE 7: No. 16", "2BAR: No. 20", and "BLANK: No. 21" is to be rearranged on the reel 104 (S174). In cases of (S174: Yes), the "Table D" is selected as the combination condition.

On the other hand, in cases of (S174: No), the CPU 71 determines whether or not a total of three "BONUS" symbols are to be rearranged on the display windows 150 (one on each of the reels 101 to 103) (S175). If it is determined that a total of three "BONUS" symbols are to be rearranged on the display windows 150 (one on each of the reels 101 to 103) (S175: Yes), The "Table E" is selected as the combination condition.

On the other hand, if it is determined that there will not be three "BONUS" symbols rearranged on the display windows 150 (S175: No), the CPU 71 determines whether or not a total of two "BONUS" symbols are to be rearranged on the display windows 150 (one on each of the reels 101 to 102), and whether or not any specific symbol out of "BLUE 7: No. 16", "1BAR: No. 20", and "BLANK: No. 21" is to be rearranged on the reel 103 (S176). In cases of (S176: Yes), the "Table F" is selected as the combination condition.

On the other hand, in cases of (S176: No), the CPU 71 determines whether or not a total of two "BONUS" symbols are to be rearranged on the display windows 150 (one on each of the reels 101 to 102) (S177). If it is determined that a total of two "BONUS" symbols are to be rearranged on the display windows 150 (one on each of the reels 101 to 102) (S177: Yes), The "Table G" is selected as the combination condition. On the other hand, if it is determined that a total of two "BONUS" symbols will not be rearranged on the display windows 150 (one on each of the reels 101 to 102) (S177: No), The "Table H" is selected as the combination condition.

Next, an effect combination number (No. fields: 0 to 43) is randomly determined based on the effect combination table 195 shown in FIG. 27 and FIG. 28, and the table selected out of "Table A" to "Table H" in the combination condition determination process. Then, the "Before Start of Rotation (1)", the "Before Start of Rotation (2)", the "During Rotation till Stopping", and "After stopping" are selected according to the effect combination number determined.

Next, the main CPU 71 executes a symbol display control process (step S16). In this process, scrolling of the reels 101 to 105 is started as shown in (39-1) of FIG. 39, and the symbols to be stopped, which are determined in the symbol random determination process of S14, are stopped in predetermined positions (e.g., areas in the upper stage of the display windows 150). That is, 15 symbols including the symbols to be stopped are displayed on the display windows 150. Further, the "Before Start of Rotation (1)", the "Before Start of Rotation (2)", the "During Rotation till Stopping", and "After stopping" executed according to the effect combination number determined in the effect content determination process in S15.

For example, when the combination No. 28 is selected as the effect combination, the Flash 1 (Flashing Effect 1 by the backlight units M7) is executed for the "Before Start of Rotation (1)". Then, the Stopping 1 and 2 first (Effect of stopping the 1st reel 101 and the 2nd reel 102 first) is executed for the "Before Start of Rotation (2)". For the "During Rotation till Stopping", the Low speed (Rotating the reels 101 to 105 at a low speed) is executed. Then, no effect is executed for the "After stopping".

Next, the main CPU 71 executes a payout amount determination process (step S17). In this process, an amount of payout is determined with reference to the normal game payout table 191 stored in the RAM 73, based on a combination of symbols displayed on an active payline, and the amount determined is stored in a payout storage area provided in the RAM 73.

Figure 39:
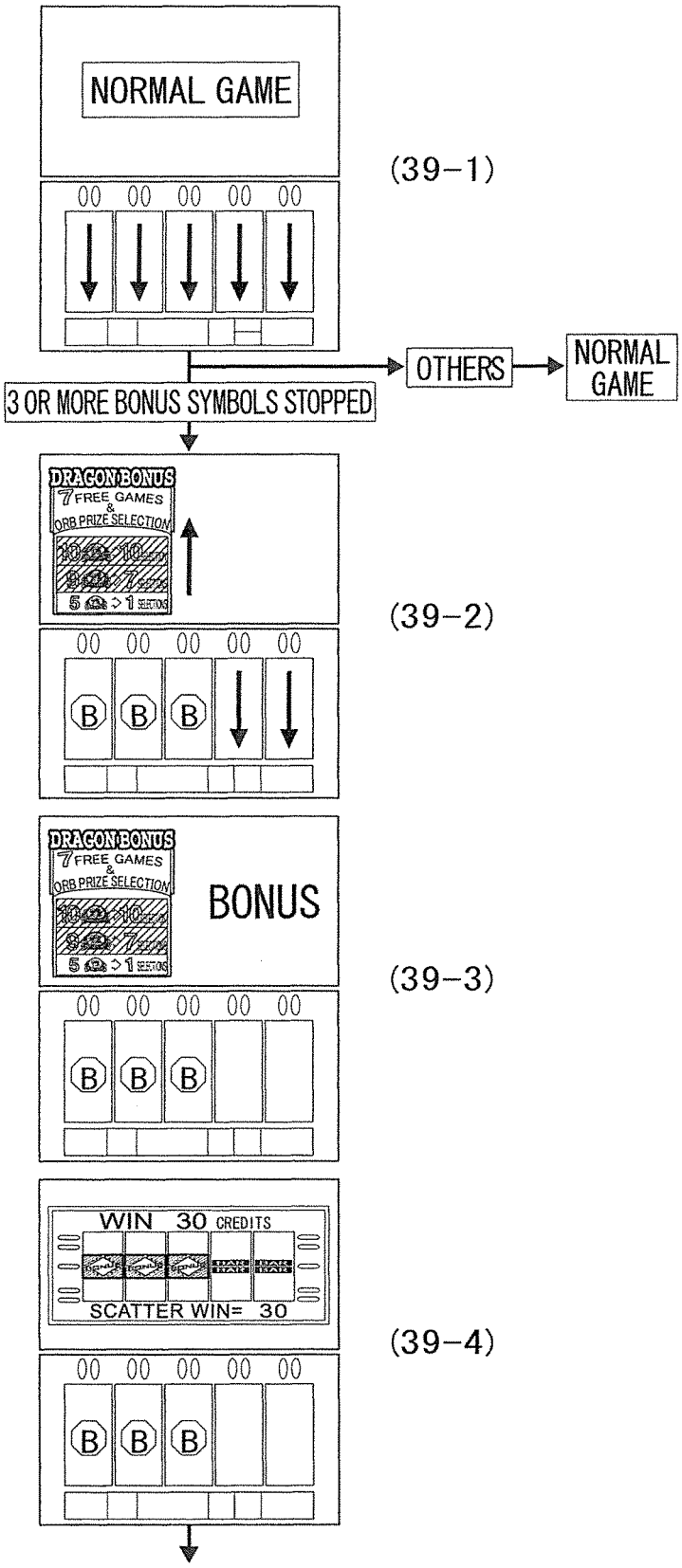
FIG. 39 is an explanatory diagram showing an effect provided in a free game process.
Figure 40:
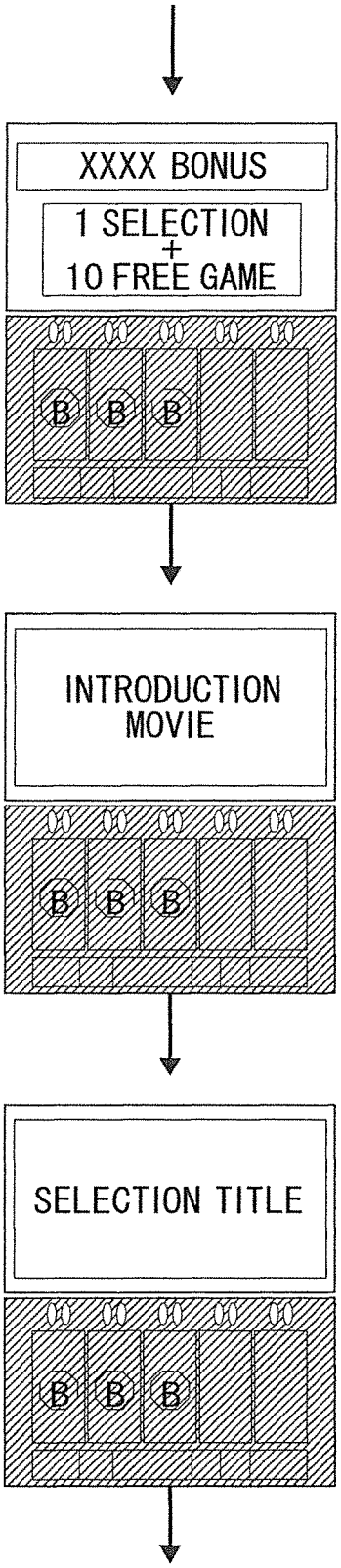
FIG. 40 is an explanatory diagram showing an effect provided in a free game process.

Next, the main CPU 71 determines whether or not a free game trigger has been established (step S18). As shown in FIG. 39, in the present embodiment, when one or more "BONUS" symbols each serving as a trigger symbol for the free game are rearranged on the display windows 150 of the 1st reel 101, the 2nd reel 102, and the 3rd reel 103, a winning combination of "free game trigger" is determined, and the game transits to the free game (in the present embodiment, the free game is runnable 10 times). The main CPU 71, when determining that the free game trigger has been established (S18: Yes), executes a later described free game process (step S19)

Next, after step S19 or in step S18, when the main CPU 71 determines that the free game trigger is not established (S18: No), the main CPU 71 determines if there is a payout (S20). This determines whether or not a payout is awarded in S17 or S19. When it is determined that there is a payout (S20: Yes), a payout process is executed (step S21). The main CPU 71 adds a value stored in the payout storage area to a value stored in the credit amount storage area provided in the RAM 73. It should be noted that the hopper 113 may be controlled based on an input of the cashout switch 32S, and output coins according to the value stored in the payout storage area to the coin tray 18. After this process, or in S20, if it is determined that there is no payout (S20: No), the process moves on to step S12.

(Coin Input/Start Check Process)

Figure 32:
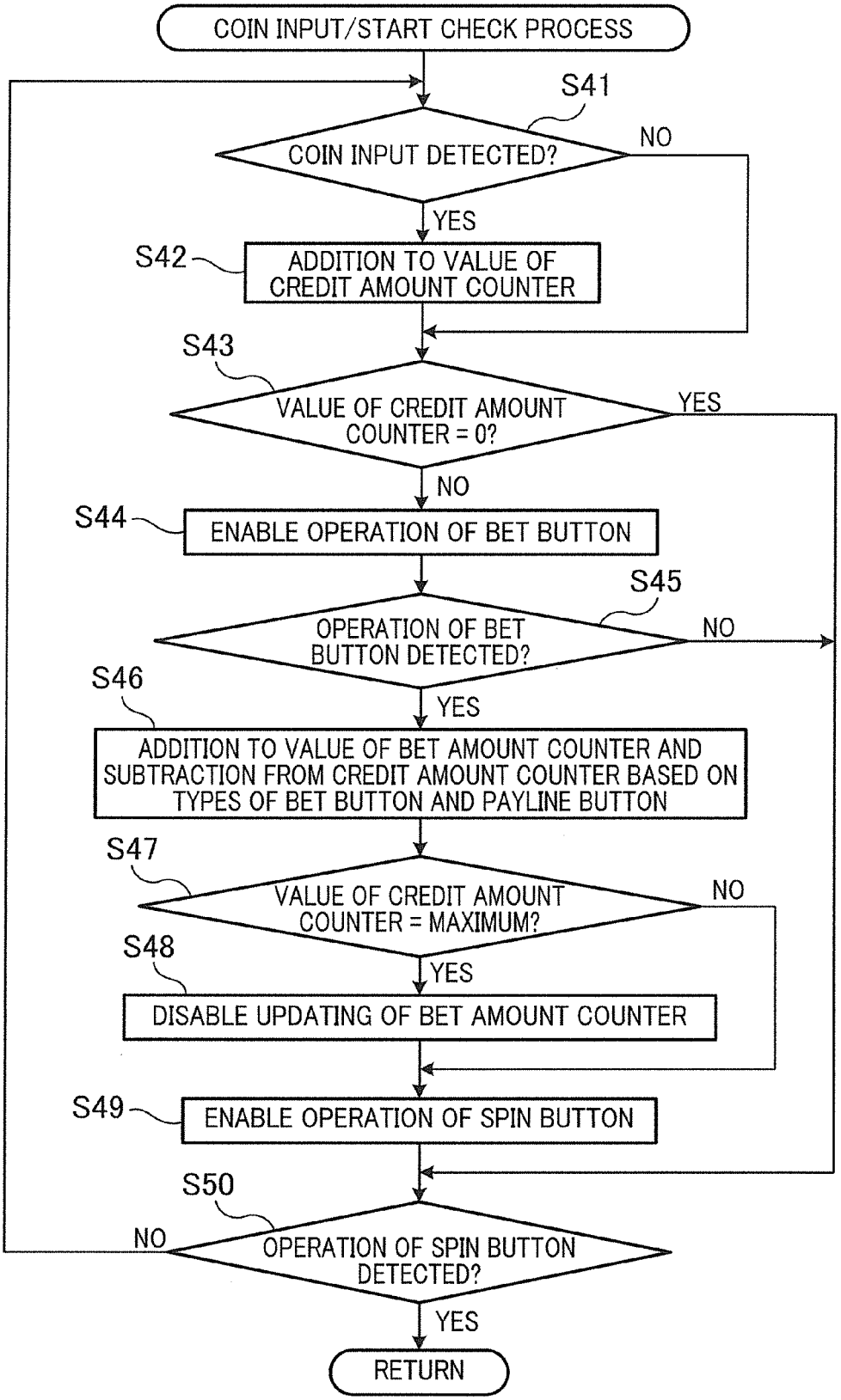
FIG. 32 is a flowchart of a coin input/start check process of the slot machine.

Next, the coin input/start check process is described reference to FIG. 32.

First, the main CPU 71 determines whether or not an input of coin is detected by the coin counter 92C (step S41). The main CPU 71, when determining that an input of coin is detected, performs addition to the value stored in the credit amount storage area (step S42). It should be noted that whether or not a bill is input is determined by the bill entry 115, and when an input of a bill is detected, a value corresponding to the bill is added to the value stored in the credit amount storage area.

When an input of coin is determined as not to be detected, after the step S42 or in step S41, the main CPU 71 determines whether or not the value stored in the credit amount storage area is 0 (step S43). When the main CPU 71 determines that the value stored in the credit amount storage area is not 0, the main CPU 71 enables operation of the bet button (1-Bet button 34, 2-bet button 35, 3-bet button 37, 4-bet button 38, 5-bet button 39, max-bet button 45)(step S44). It should be noted that in step S44, operations of the payline button (play-1-line button 40, play-2-line button 41, play-3-line button 42, play-5-line button 43, play-10-line button 44) are also enabled. Enabling the operation of the payline buttons allows the player to activate a desirable number of paylines 1 to 30.

Next, the main CPU 71 determines whether or not an operation of the bet button is detected (step S45). When an operation of the bet button by a player is detected by the bet switch (1-bet switch 34S, 2-bet switch 35S, 3-bet switch 37S, 4-bet switch 38S, 5-bet switch 39S, max-bet switch 45S), the main CPU 71 performs addition to the value stored in a bet amount storage area provided to the RAM 73, and performs reduction from the value stored in the credit amount storage area, based on the type of the bet button and the type of payline (step S46).

Next, the main CPU 71 determines whether or not the value stored in the bet amount storage area is a maximum value (step S47). The main CPU 71, when determining that the value stored in the bet amount storage area is a maximum value, prohibits updating of the value stored in the bet amount storage area (step S48). The main CPU 71, when determining that the value stored in the bet amount storage area is not a maximum value after the step S48 or in the step S47, enables operation of the spin button 46 (step S49).

When the main CPU 71 determines that an operation of the bet button is not detected after the step S49 or in the step S45, or when the main CPU 71 determines that the value stored in the credit amount storage area is 0 in the step S43, the main CPU 71 determines whether or not an operation of the spin button 46 is detected (step S50). When the main CPU 71 determines that an operation of the spin button 46 is not detected, the process moves to the step S41.

When the main CPU 71 determines that an operation of the spin button 46 is detected, the coin input/start check process ends.

(Free Game Process)

Figure 33:
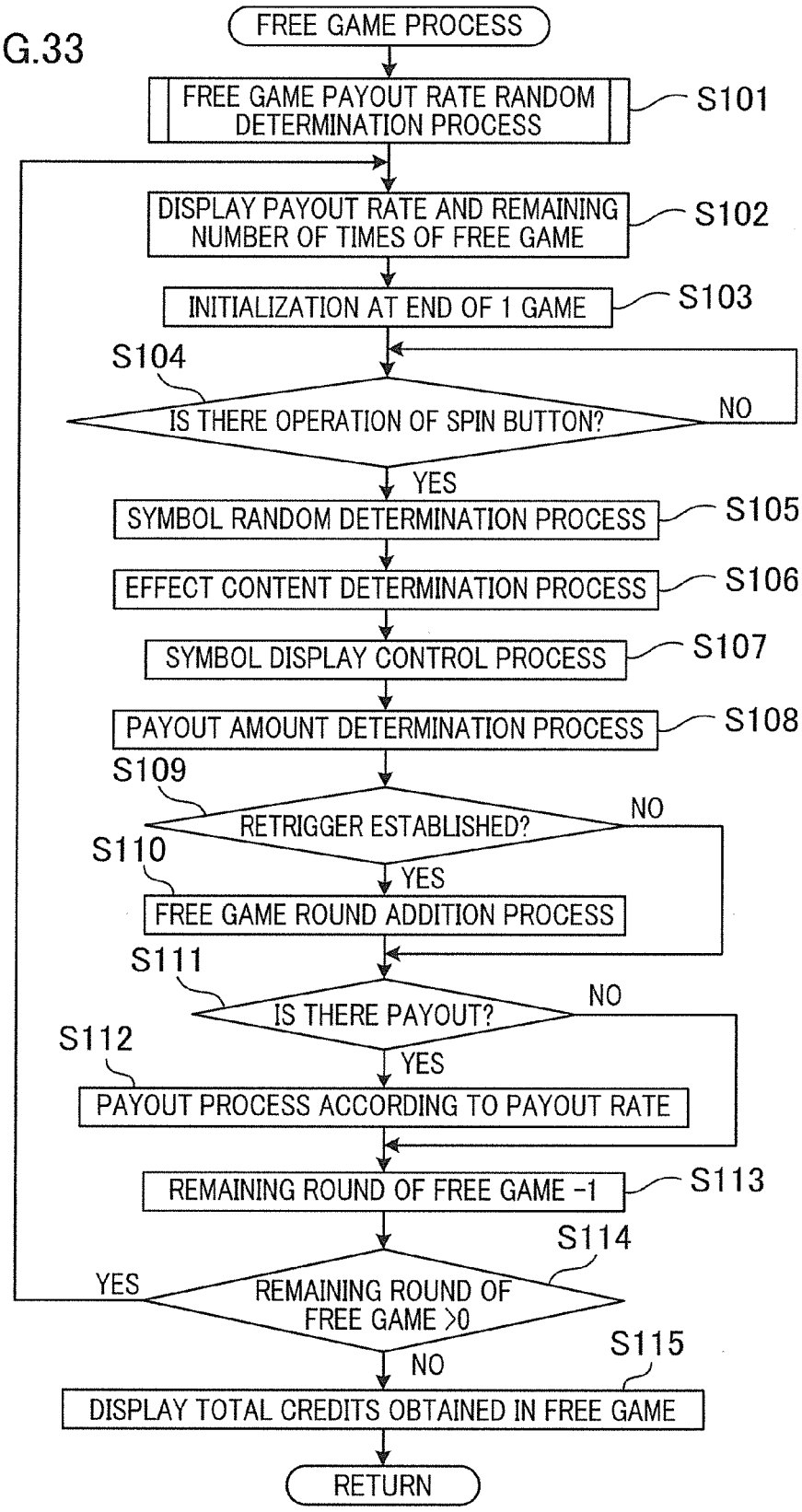
FIG. 33 is a flowchart of a free game process of the slot machine.

The following describes a free game process with reference to FIG. 33. The free game process is a process executed when the free game trigger is established in the main control process as shown in FIG. 31 (S19). It should be noted that in the free game of the present embodiment, a slot game is run as in the normal game.

First, the main CPU 71 executes a later described free game payout rate random determination process (S101). This is a process for determining the payout rate for the payout obtainable in the free game (corresponding to roulette random determination), after transition to the free game occurs.

Figure 38:
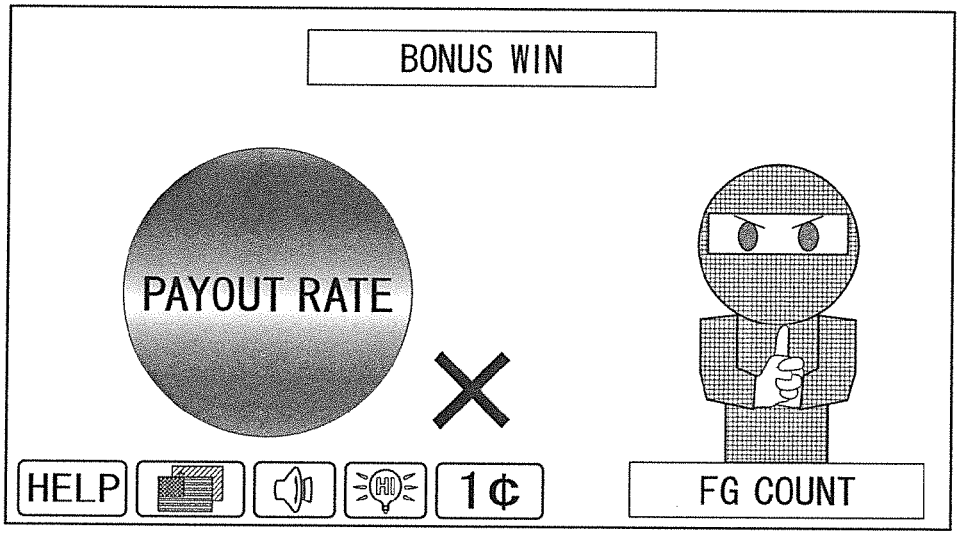
FIG. 38 is a diagram showing an example image displayed in the free game payout rate random determination process.
Figure 44:
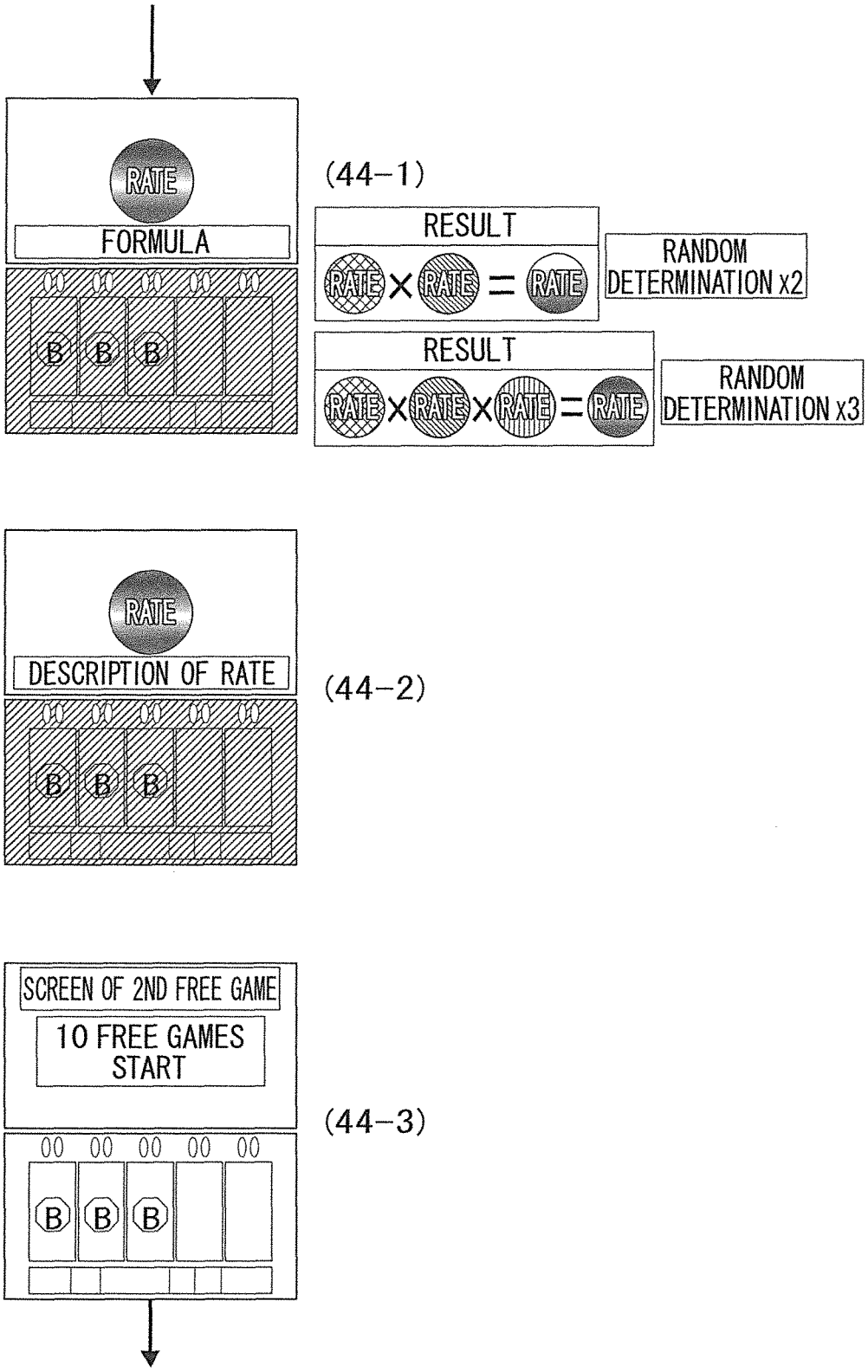
FIG. 44 is an explanatory diagram showing an effect provided in a free game process.

Next, as shown in FIG. 38, the payout rate determined in S101 is indicated on the upper image display panel 131 (S102). Subsequently, as shown in 44-3 in FIG. 44, the upper image display panel 131 further indicates the remaining number of rounds of the free game (S102). It should be noted that, in the present embodiment, when the winning combination of the "free game trigger" is determined, and the transition to the free game occurs, 10 rounds of the free game is given. It should be further noted that the number of remaining rounds of free game is stored in the RAM 73.

Next, the main CPU 71 executes an initializing process at the end of each round of the game (Step S103). This process clears data in a working area of the RAM 73, which becomes unnecessary at the end of each round of game, e.g., symbols randomly determined, and the like.

Next, the main CPU 71 determines whether or not an operation of the spin button 46 is detected (step S104). A standby mode occurs if no operation of the spin button 46 is detected (S104: No).

On the other hand, if an operation of the spin button 46 is detected (S104: Yes), the main CPU 71 executes a symbol random determination process (S105). In this process, symbols to be stopped are determined based on random numbers for symbol determination. In the present embodiment, symbols to be stopped on each of the reels 101 to 105 are determined according to the weight values of the 22 symbols corresponding to code numbers 0 to 21, shown in FIG. 13.

Next, the main CPU 71 executes an effect content determination process (step S106). The main CPU 71 samples an effect-use random number and randomly determines any of a plurality of predetermined contents of effect.

It should be noted that in the free game too, the combination condition determination process may be executed as in the normal game. An effect combination number (No. fields: 0 to 43) may be randomly determined based on the effect combination table 195 shown in FIG. 27 and FIG. 28, and the table selected out of "Table A" to "Table H" in the combination condition determination process. Then, the "Before Start of Rotation (1)", the "Before Start of Rotation (2)", the "During Rotation till Stopping", and "After stopping" may be executed according to the effect combination number determined.

Figure 45:
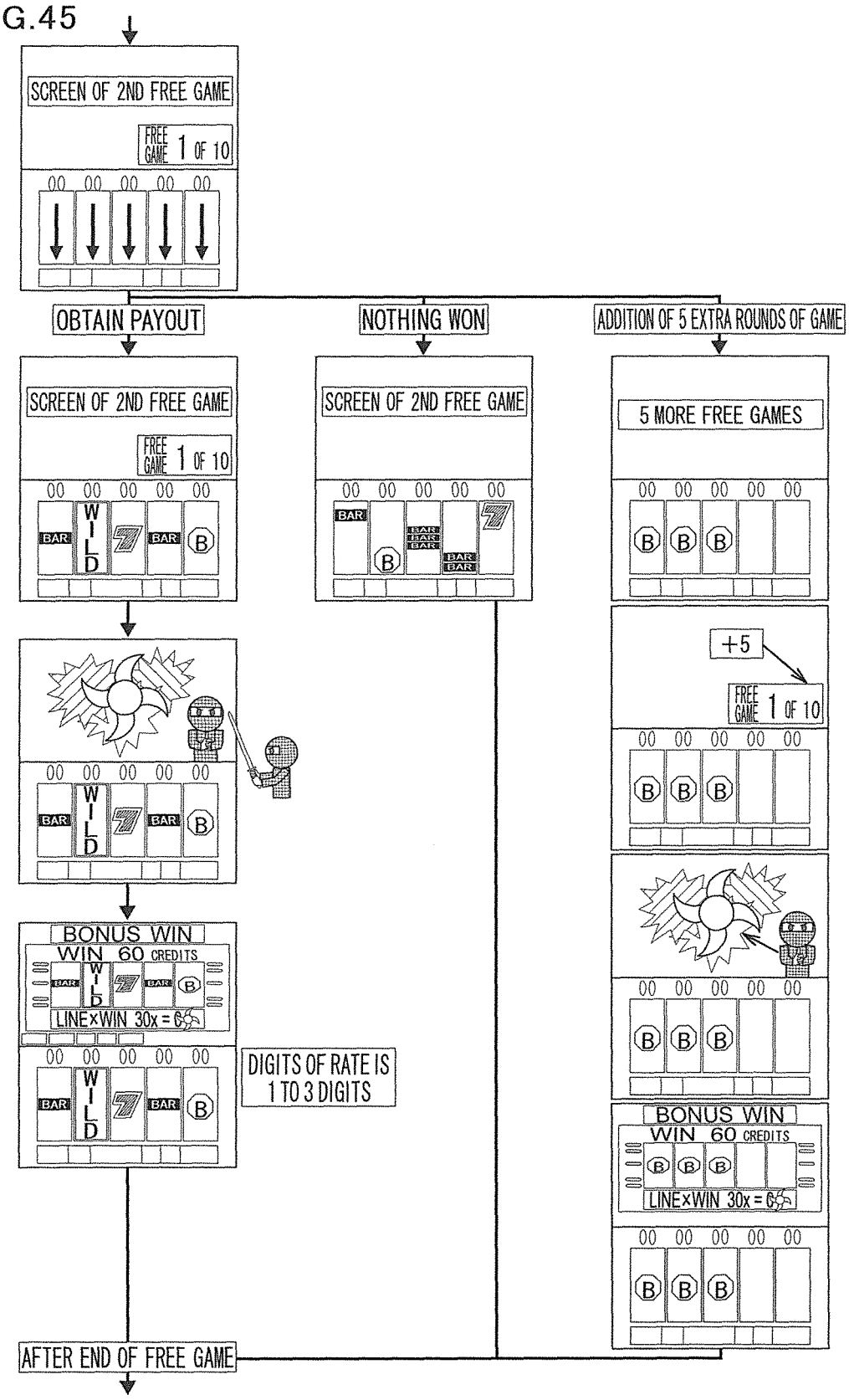
FIG. 45 is an explanatory diagram showing an effect provided in a free game process.

Next, the main CPU 71 executes a symbol display control process (step S107). In this process, scrolling of the reels 101 to 105 is started as shown in FIG. 45, and the symbols to be stopped, which are determined in the symbol random determination process of S105, are stopped in predetermined positions (e.g., areas in the upper stage of the display windows 150). That is, 15 symbols including the symbols to be stopped are displayed on the display windows 150.

Next, the main CPU 71 executes a payout amount determination process (step S108). In this process, an amount of payout is determined with reference to the free game payout table 192 stored in the RAM 73, based on a combination of symbols displayed on an active payline, and the amount determined is stored in a payout storage area provided in the RAM 73.

Next, the main CPU 71 determines whether or not a retrigger has been established (step S109). Further, as shown in FIG. 45, when one or more "BONUS" symbols each serving as a retrigger symbol for the free game are rearranged on the display windows 150 of the 1st reel 101, the 2nd reel 102, and the 3rd reel 103, a winning combination of "retrigger" is determined, and five rounds of free game are added in the present embodiment.

The main CPU 71, when determining that the retrigger has been established (S109: Yes), executes a free game round addition process (S110) In this process, the upper image display panel 131 indicates that a retrigger has been established and 5 rounds of the free game is added. Further, the number of remaining rounds of the free game, which number is stored in the RAM 73, is updated by adding there to 5 additional rounds of free game.

Next, after step S110 or in step S109, when the main CPU 71 determines that the retrigger is not established (S109: No), the main CPU 71 determines if there is a payout (S111). This determines whether or not a payout is awarded in S108.

When it is determined that there is a payout (S111: Yes), an amount of payout stored in the RAM 73 in S108 is multiplied by the payout rate determined in the free game payout rate random determination process (S101), and the resulting value is awarded to the player as a payout of a single round of the free game (payout process based on the payout rate: S112). For example, the payout determined in the process of S108 is 100 credits, and the payout rate determined in the process of S101 is ×350 (i.e., 10×5×7), a payout of 35,000 credits (100×350=35,000) is awarded to the player as a payout of the single round of free game.

Next, if it is determined that there is no payout after the process of S112 or in the process of S111 (S111: No), the main CPU 71 subtracts 1 from the remaining number of rounds of free game stored in the RAM 73 and update the same (S113). For example, if the number of remaining rounds of free game stored in the RAM 73 is 10, the number of rounds of free game is updated to a value "9" which is the result of subtracting 1 from 10.

Next, the main CPU 71 determines if the remaining rounds of free game updated in S113 is greater than 0 (S114). If it is determined that the number of remaining rounds of free game is greater than 0 (S114: Yes), the process of S102 is executed.

Figure 46:
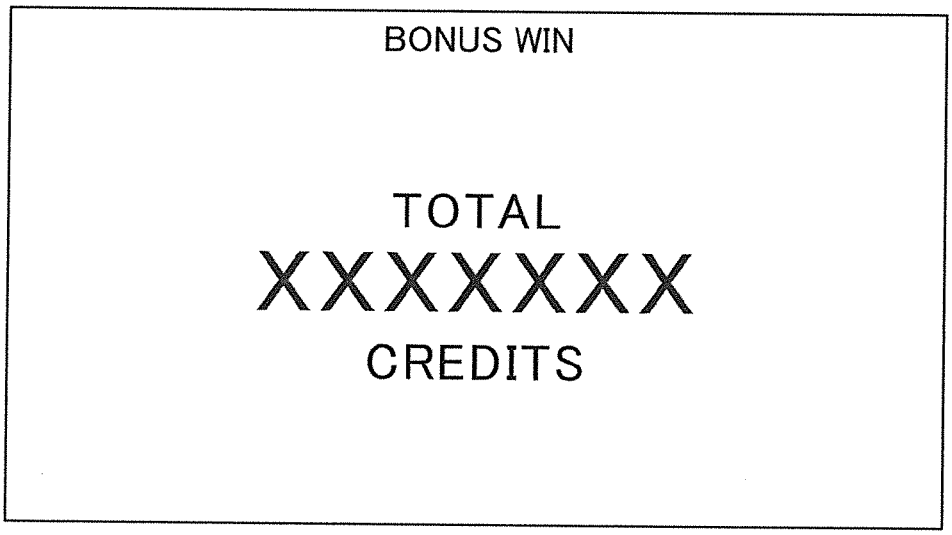
FIG. 46 is an explanatory diagram showing an effect provided in a free game process.

On the other hand, if it is determined that the remaining number of rounds of free game is not greater than 0 (S114: No), a total amount of credits obtained in the given rounds of free game is displayed on the upper image display panel 131, as shown in FIG. 46. (S115). Then, this process ends.

(Free Game Payout Rate Random Determination Process)

Figure 34:
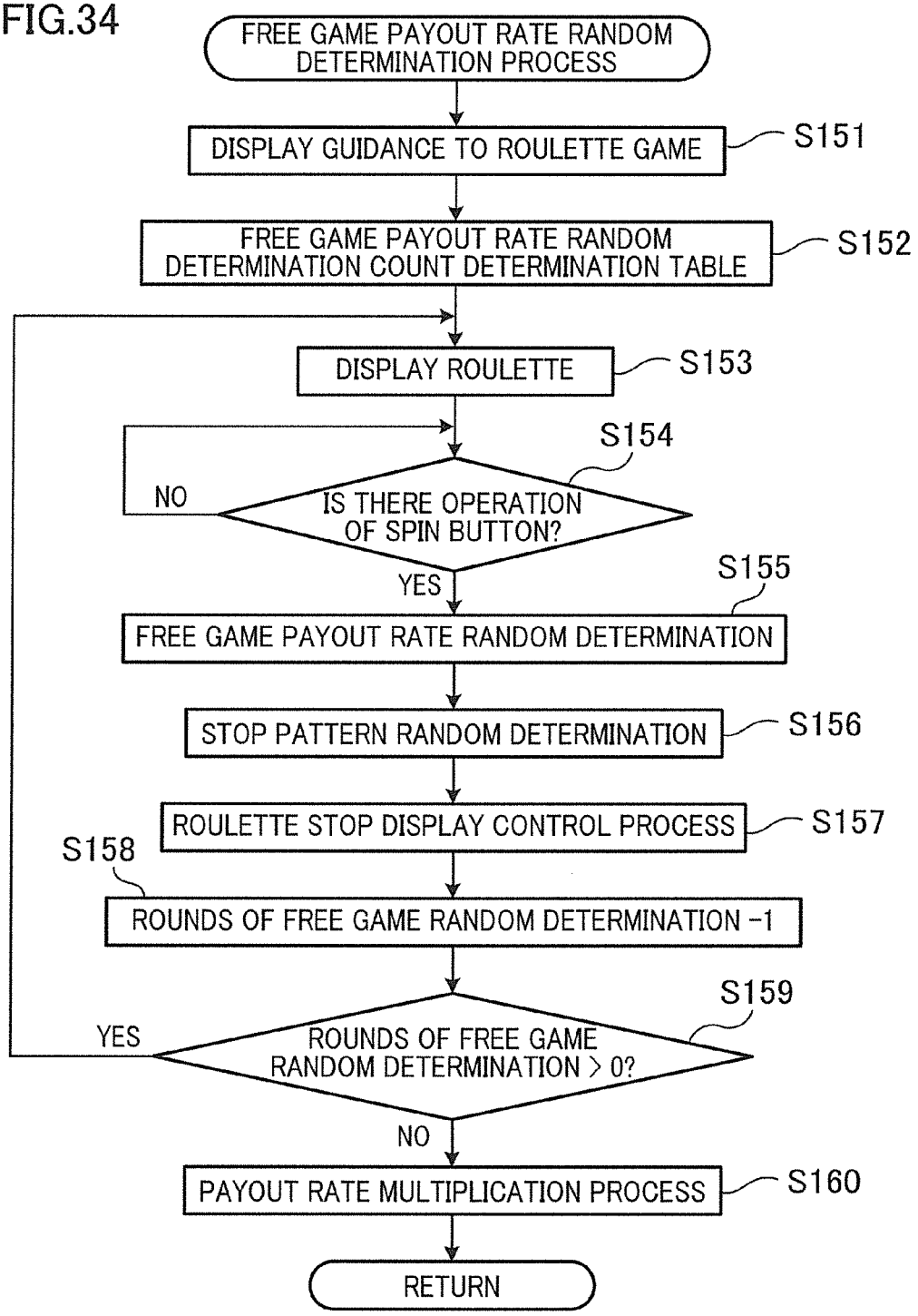
FIG. 34 is a flowchart of a free game payout rate random determination process of the slot machine.

The following describes a free game payout rate random determination process with reference to FIG. 34. The free game payout rate random determination process is a process executed in the process of free game process, as shown in FIG. 33 (S101).

Figure 41:
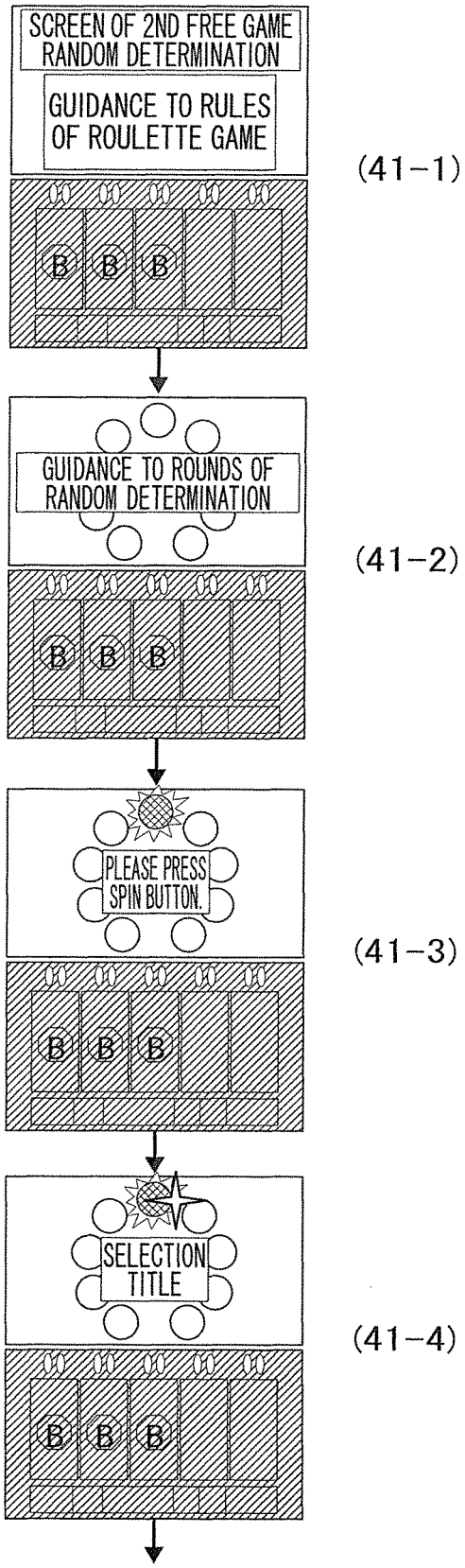
FIG. 41 is an explanatory diagram showing an effect provided in a free game process.

First, the main CPU 71 displays a screen providing guidance to the roulette game on the upper image display panel 131 (S151: roulette guidance display) (41-1 of FIG. 41).

Next, the main CPU 71 executes a later described free game payout rate random determination count determination process (S152). The free game payout rate random determination count determination process refers to a free game payout rate random determination count determination table 193 to determine how many times the free game payout rate random determination is to be executed, according to the number of "BONUS" symbols rearranged on the display windows 150 when the winning combination of "free game trigger" is determined in S18, the free game payout rate random determination determining the payout rate of the payout obtainable in the free game. It should be noted that the free game payout rate random determination execution count is stored in the RAM 73. Further, the free game payout rate random determination execution count determined is indicated and explained on the upper image display panel 131 (see 4-2 of FIG. 41).

Figure 37:
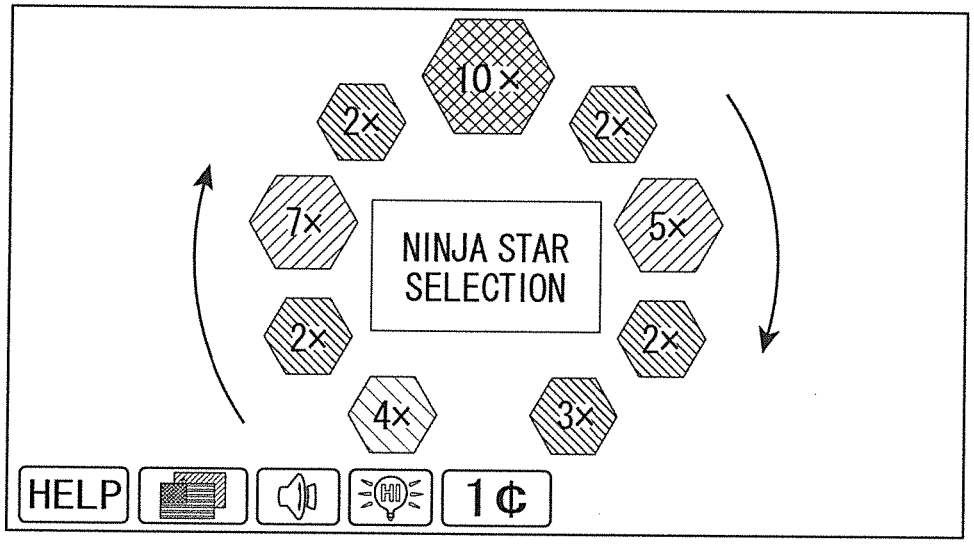
FIG. 37 is a diagram showing an example image displayed in the free game payout rate random determination process.

Next, as shown in FIG. 36 and FIG. 37, the nine areas No. 0 to No. 8 each corresponding to a payout rate are circularly arranged and displayed on the upper image display panel 131 (S153: roulette display). In each of these areas No. 0 to No. 8, a payout credit is associated and displayed as hereinabove described (see FIG. 26 and FIG. 36). It should be noted that in the process of S153, there is an indication on the upper image display panel 131 which prompts a player to press the spin button 46 (see 41-3 of FIG. 41).

Next, the main CPU 71 determines whether or not an operation of the spin button 46 is detected (step S154). A standby mode occurs if no operation of the spin button 46 is detected (S154: No).

On the other hand, if an operation of the spin button 46 is detected (S154: Yes), the main CPU 71 executes a free game payout rate random determination (S155). This process refers to the free game payout rate random determination table 194 (see FIG. 26) to randomly determine by using a random number where to stop out of the areas No. 0 to No. 8. This way, a payout rate (corresponding to preliminary payout rate) is determined.

Next, the main CPU 71 executes a stop pattern random determination process (S156). In this process, any of the roulette stop patterns "a" to "h" to be used as an effect is determined by using a random number, based on the payout rate determined in the process of S155 and the stop pattern random determination table 197 (see FIG. 30).

Figure 42:
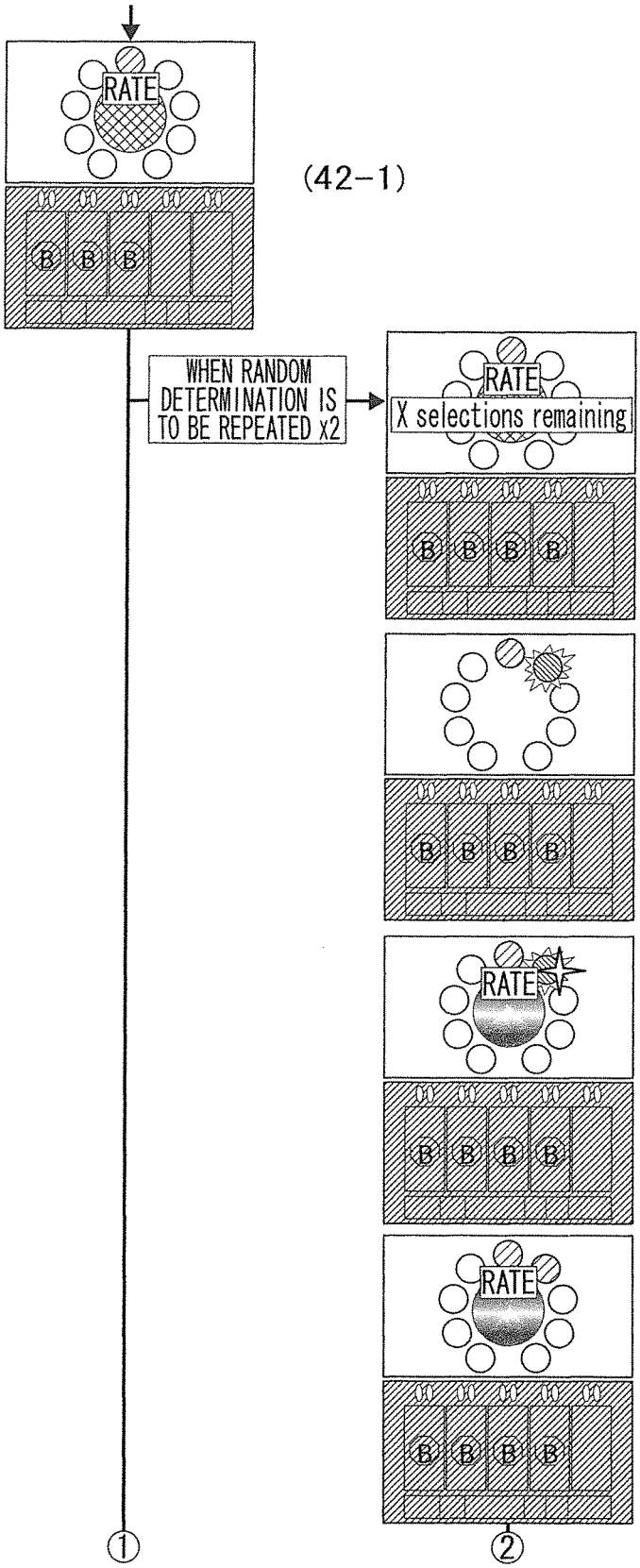
FIG. 42 is an explanatory diagram showing an effect provided in a free game process.
Figure 43:
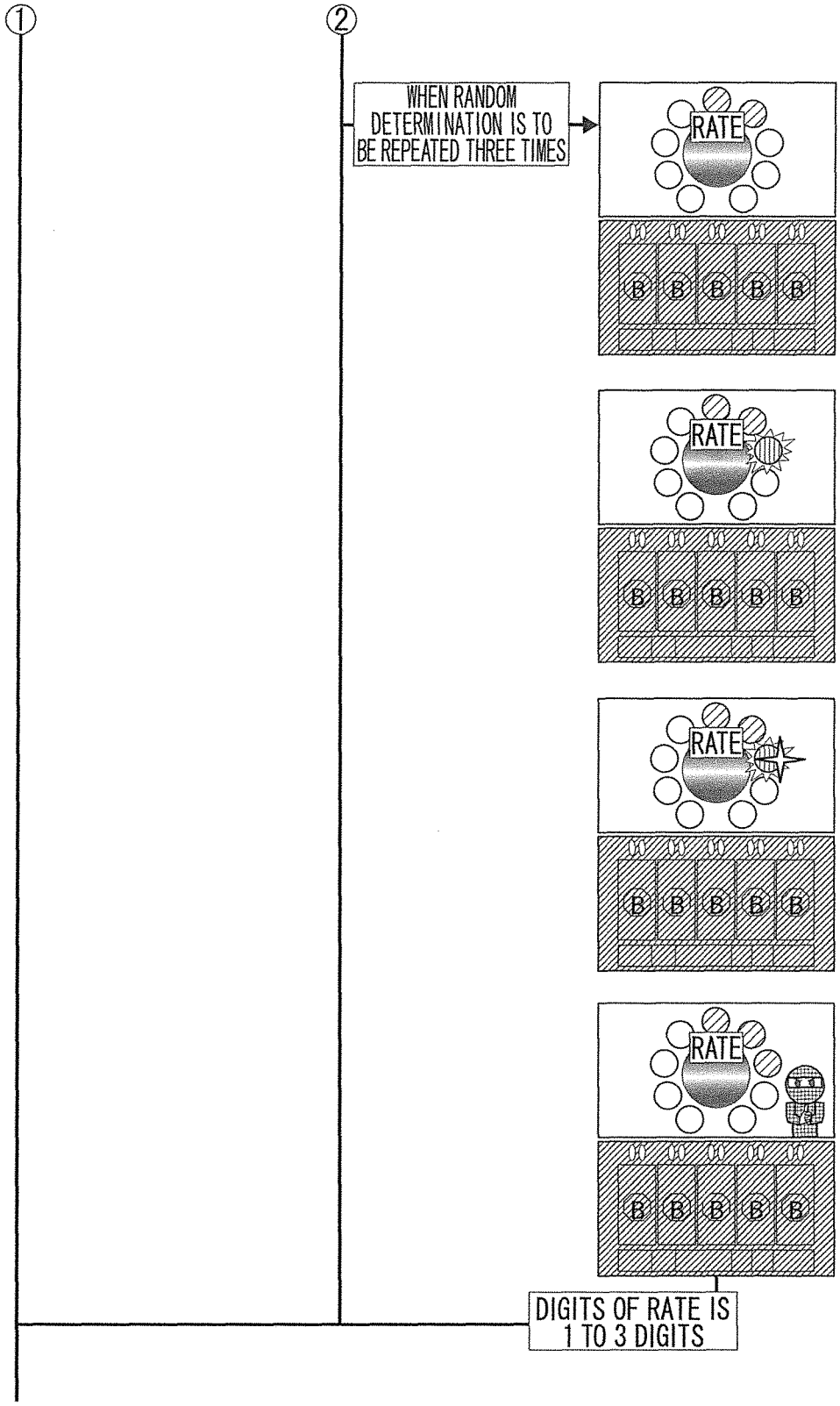
FIG. 43 is an explanatory diagram showing an effect provided in a free game process.

Next, the main CPU 71 executes a roulette stop display control process (step S157). In this process, according to the roulette stop patterns 196 shown in FIG. 29 and the stop pattern determined in the stop pattern random determination process in S156, an effect display is performed in such a manner that a light pointer moves clockwise on the areas No. 0 to No. 8 and gradually slows down to stop at the area out of the areas No. 0 to No. 8 determined in the free game payout rate random determination in S155, by repeating turning on and turning off of each area; e.g., turning off the area No. 0 while turning on the area No. 1→turning off the area No. 1 while turning on the area No. 2→ . . . (see FIG. 37). Note that in the present embodiment, there is provided a video effect of a Ninja star sticks on to the area where the light pointer stops, as shown in 41-4 of FIG. 41. Further, the payout rate corresponding to the area where the light pointer stops is indicated at the center of the roulette, as shown in 42-1 of FIG. 42.

Next, the main CPU 71 subtract 1 from the free game payout rate random determination execution count stored in the RAM 73 and updates the same (S158). For example, if the free game payout rate random determination execution count stored in the RAM 73 is 3, the free game payout rate random determination execution count is updated to a value "2" which is the result of subtracting 1 from 3.

Next, the main CPU 71 determines if the free game payout rate random determination execution count updated in S158 is greater than 0 (S159). If it is determined that the free game payout rate random determination execution count is greater than 0 (S159: Yes), the process of S153 is executed.

If it is determined that the free game payout rate random determination execution count is not greater than 0 (S159: No), a payout rate multiplication process is executed (S160). In a series of the above processes, the free game payout rate random determination (corresponding to the preliminary payout rate random determination) is executed a number of times determined in the free game payout rate random determination count determination process of S152. Then, in the payout rate multiplication process, the payout rates resulting from the free game payout rate random determinations are multiplied, and the value resulting from the multiplication is stored in the RAM 73 as a payout rate for the payout obtainable in the free game. For example, where the free game payout rate random determination is determined as to be executed three times, and where the payout rate of "×10" is resulted in the free game payout rate random determination of the first time, the payout rate of "×5" in the second time, and the payout rate of "×7" in the third time, the payout rate for the payout obtainable in the free game is determined as to be ×350 which is the product of multiplication of the payout rates resulting from each of the free game payout rate random determinations (i.e., 10×5×7=350).

It should be noted that the payout rates to be determined in the free game payout rate random determination may include ×0. Further, in the above, the value resulting from the multiplication of the payout rates determined in the free game payout rate random determinations is set as the payout rate for the payout obtainable in the free game. However, the payout rate of the payout obtainable in the free game does not necessarily have to be the product of the above multiplication, and may be a sum of the payout rates determined in the free game payout rate random determinations.

After S160, this process ends.

In the above structure, the free game payout rate random determination for randomly determining the payout rate for the payout obtainable in the free game is executed, when the free game trigger is established and the right to play the free game is awarded. This random determination of the payout rate for the payout obtainable in the free game provides enjoyment, every time the right to play the free game is awarded.

Further, in the above structure, the payout rate for the payout obtained in the free game is determined through multiplication involving each payout rate determined by the free game payout rate random determination executed a certain number of times according to the number of "BONUS" symbols rearranged on the display windows 150 in the normal game. The number of times the free game payout rate random determination is executed increases with an increase in the number of "BONUS" symbols rearranged on the display windows 150 in the normal game. This way, the player will be interested in the number of "BONUS" symbols rearranged on the display windows 150, and enjoy the normal game.

In the above described free game payout rate random determination process which determines the payout rate for the payout obtainable in the free game, the movement of lighting (light pointer) (speed, timing of stopping) which indicates the result is randomly determined based on the roulette stop patterns 196. This causes the player to enjoy and be interested in the free game payout rate random determination process which determines the payout rate for the payout obtainable in the free game.

(Other Effects)

Figure 47:
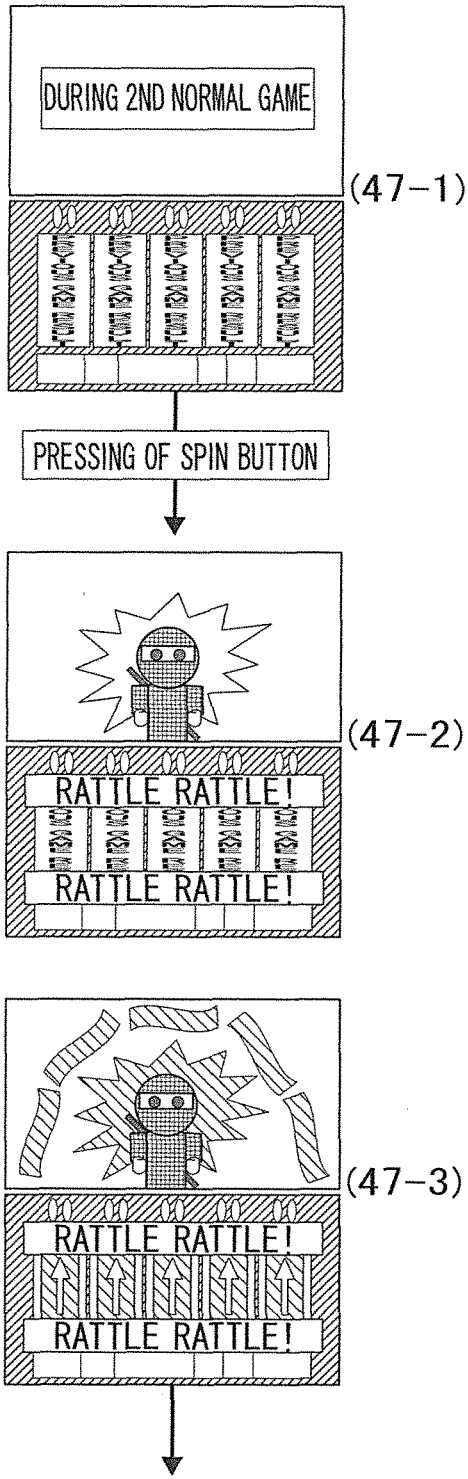
FIG. 47 is an explanatory diagram explaining an indication effect.

The slot machine 1 may perform an indication effect. Specifically, as shown in 47-1 of FIG. 47, when the normal game ends and another round of normal game starts (when the spin button 46 is pressed), an effect display is provided such that a blue ninja is displayed on the upper image display panel 131, and the reels 101 to 105 rattle instead of scrolling (47-2 of FIG. 47). After that, the reels 101 to 105 are displayed in blue by the backlight unit M7 provided to the reels 101 to 105 (see 47-3 of FIG. 47). Then, the displaying in blue which occurs on the reels 101 to 105 moves to the aura image 301 behind the blue ninja displayed on the upper image display panel 131, and the aura image 301 is displayed in blue (48-1 of FIG. 48). After that, there is no development in the indication effect, an effect such that the ninja slices the screen is performed as shown in 48-3 of FIG. 48, and scroll of the reels 101 to 105 is started thereafter.

Figure 48:
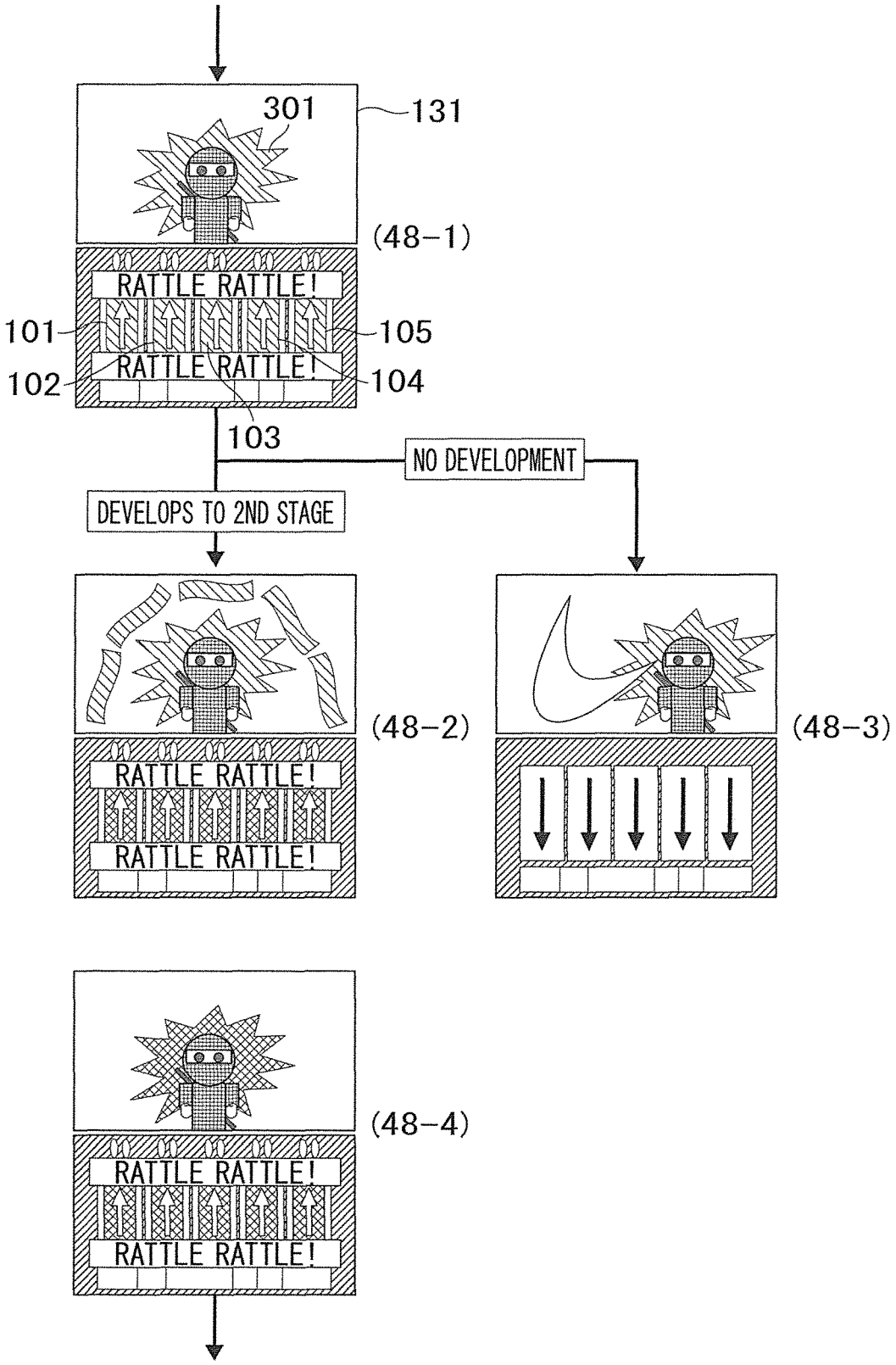
FIG. 48 is an explanatory diagram explaining an indication effect.

On the other hand, if the indication effect develops (2nd stage), an effect display is provided such that the blue ninja is displayed on the upper image display panel 131, and the reels 101 to 105 rattle instead of scrolling (see 48-2 of FIG. 48). After that, the reels 101 to 105 are displayed in red by the backlight unit M7 provided to the reels 101 to 105. Then, the displaying in red which occurs on the reels 101 to 105 moves to the aura image 301 behind the blue ninja displayed on the upper image display panel 131, and the aura image 301 is displayed in red (48-4 of FIG. 48). After that, there is no development in the indication effect, an effect such that the ninja slices the screen is performed as shown in 49-2 of FIG. 49, and scroll of the reels 101 to 105 is started thereafter.

Figure 49:
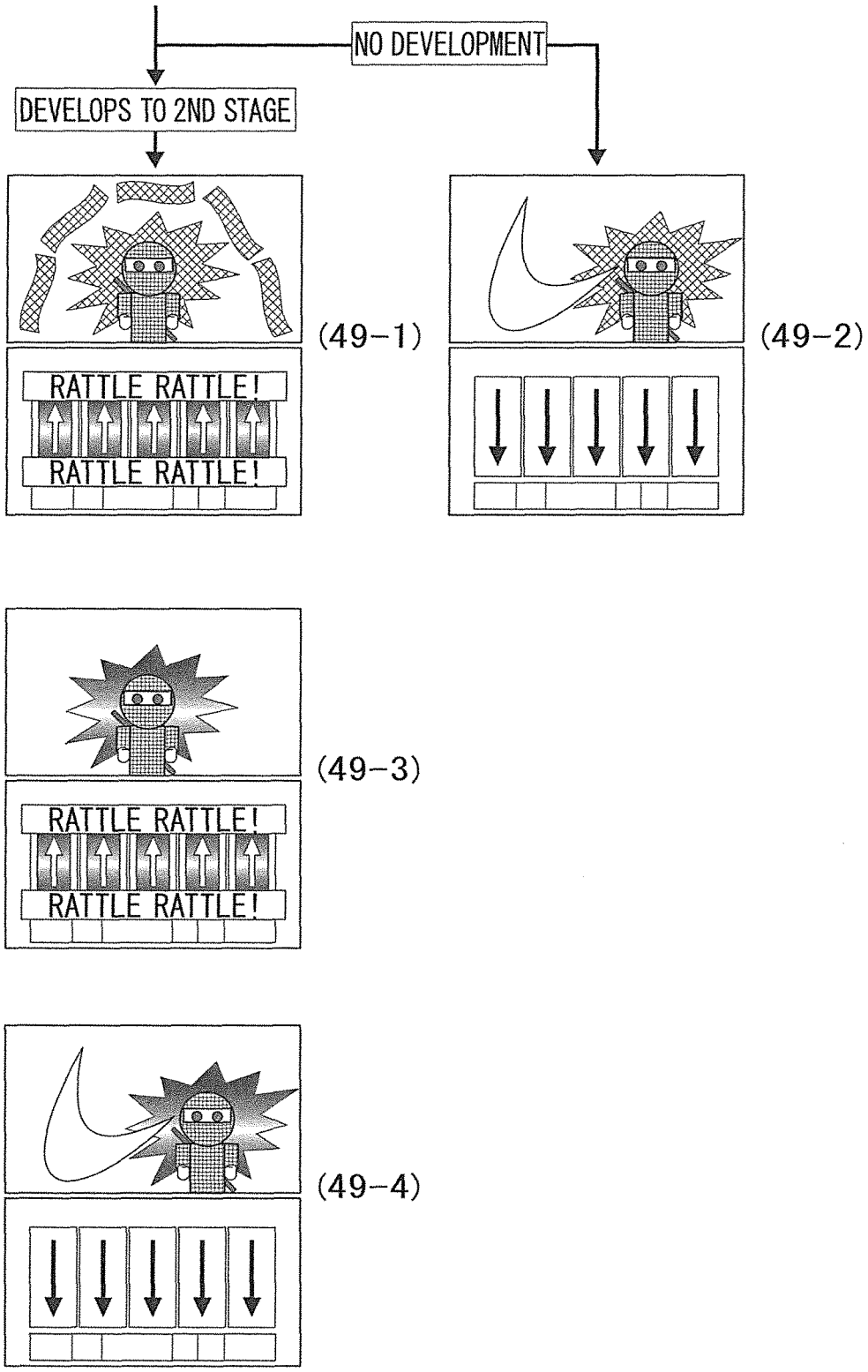
FIG. 49 is an explanatory diagram explaining an indication effect.
Figure 50:
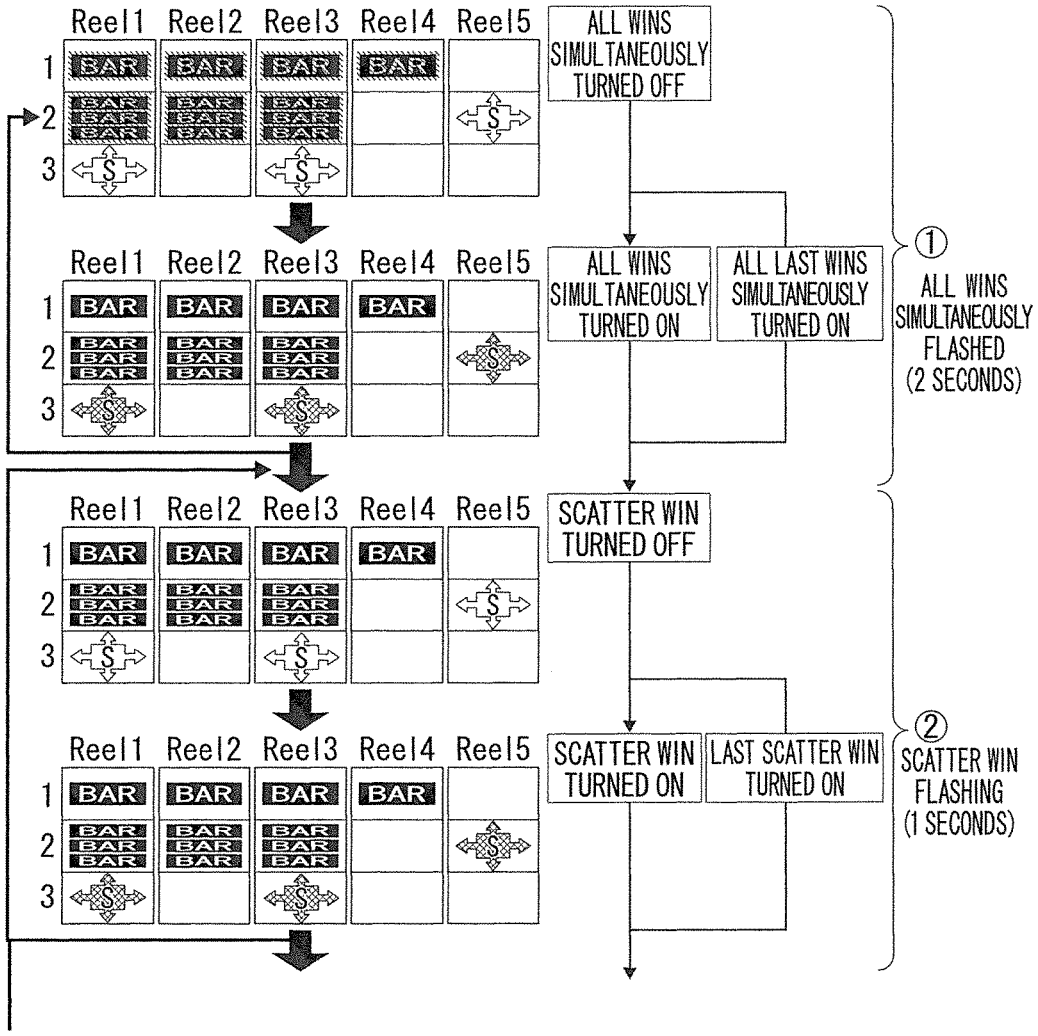
FIG. 50 is an explanatory diagram explaining a symbol flashing effect.

On the other hand, if the indication effect develops (3rd stage), an effect display is provided such that the blue ninja is displayed on the upper image display panel 131, and the reels 101 to 105 rattle instead of scrolling (see 49-3 of FIG. 49). After that, the reels 101 to 105 are displayed in rainbow colors by the backlight unit M7 provided to the reels 101 to 105. Then, the displaying in the rainbow colors which occurs on the reels 101 to 105 moves to the aura image 301 behind the blue ninja displayed on the upper image display panel 131, and the aura image 301 is displayed in the rainbow colors (49-3 of FIG. 49). After that, an effect such that the ninja slices the screen is performed as shown in 49-4 of FIG. 49, and scroll of the reels 101 to 105 is started thereafter.

(Symbol Flashing Effect)

The slot machine 1 may perform a flashing effect using the backlight units M7, when a symbol combination yielding a payout is rearranged on an active payline.

Figure 51:
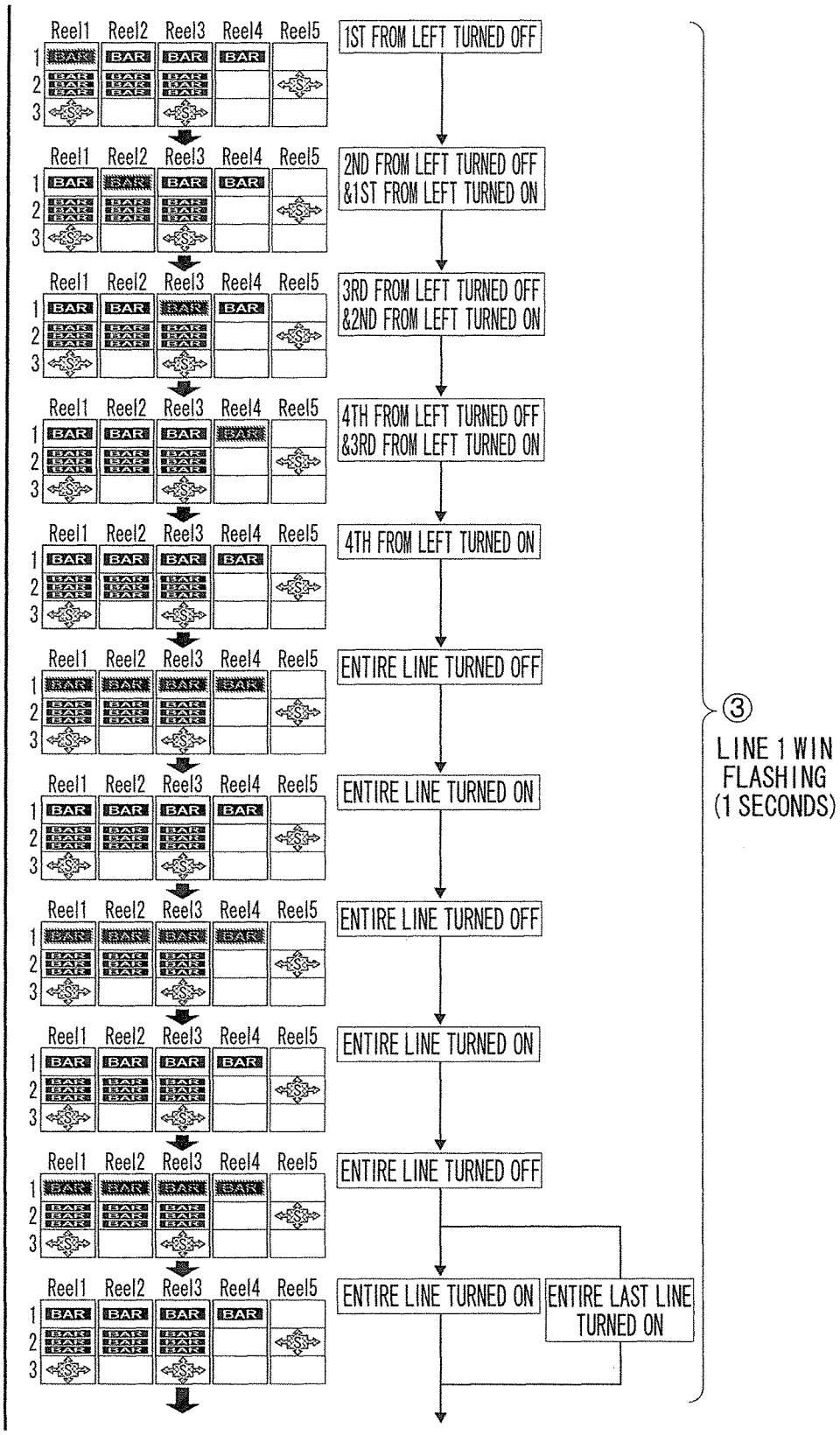
FIG. 51 is an explanatory diagram explaining a symbol flashing effect.
Figure 52:
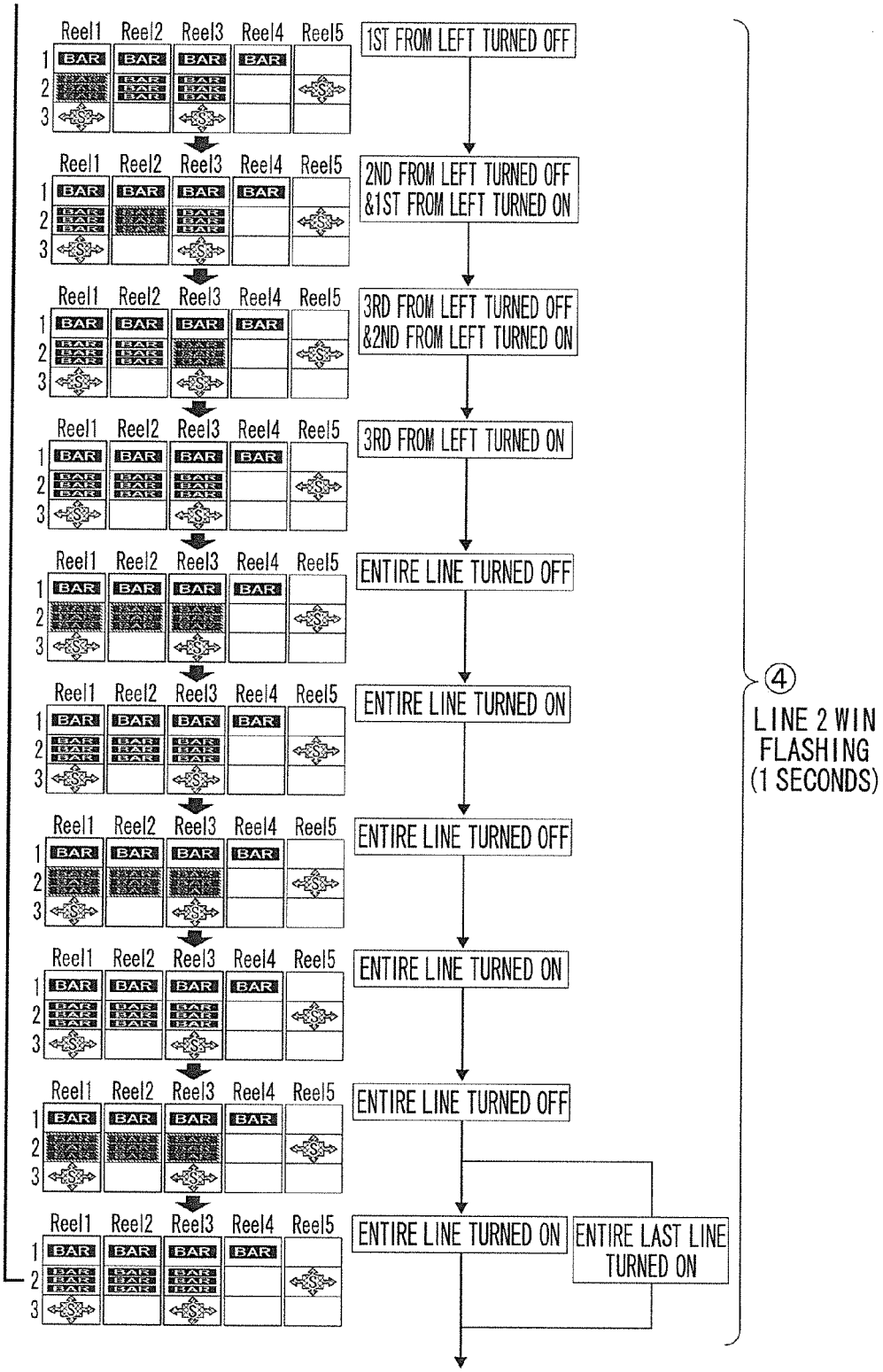
FIG. 52 is an explanatory diagram explaining a symbol flashing effect.

For example, as shown in FIG. 51, symbols constituting a symbol combination which yields a payout (WIN) are flashed (turning on and turning off). Meanwhile, scatter symbols (BONUS symbols) are also flashed. For example, as shown in FIG. 51, symbols constituting a symbol combination which yields a payout (WIN) are flashed so it looks as if there is a flow from the left to right along the payline. Further, if there is another payline with a symbol combination which yields a payout (WIN), the symbols constituting the combination are flashed so it looks as if there is a flow from the left to right along the payline (see FIG. 52).

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

REFERENCE SIGNS LIST

1. Slot machine
70. Motherboard
71. Main CPU
73. RAM
101 to 105. Reels
131. Upper Image Display Panel
150. Display window
191. Normal Game Payout Table
192. Free Game Payout Table
M1. Reel device

What is claimed is:

1. A gaming machine configured to run a normal game and a free game which develops from the normal game, the gaming machine comprising:

a game medium acceptor configured to accept a game medium with a monetary value which establishes a credit balance for a player;

a bet input device configured to receive a bet whose amount is designated by the player based on the credit balance;

a symbol display device configured to variably display and rearrange a plurality of symbols including one or more trigger symbols;

a controller being programmed to, as a result of the player's bet, execute:

(a1) running the normal game in which the symbols are rearranged on the symbol display device;

(a2) determining whether or not a trigger condition which is a condition for rearranging a predetermined number or more of the trigger symbols on the symbol display device is established, in the normal game;

(a3) if the trigger condition is determined as to be established, awarding a right to play the free game a predetermined number of times and randomly determining a payout rate for payouts obtainable in the free games;

(a4) running the free game a predetermined number of times;

(a5) awarding a payout which is a product of a payout obtained in the free game of the step (a4) multiplied by the payout rate randomly determined in step (a3); and (a6) paying out other game medium to the player or establishing the credit balance according to the payout, wherein, in the step (a3), preliminary payout rate random determination is executed a certain number of times according to the number of trigger symbols rearranged on the symbol display device in the step (a2), and a value resulting from multiplication involving each preliminary payout rate determined by the preliminary payout rate random determination is determined as the payout rate for the payout obtainable in the free game.

2. The gaming machine according to claim 1, wherein, preliminary payout rates to be determined by the preliminary payout rate random determination includes ×0.

3. A gaming machine configured to run a normal game and a free game which develops from the normal game, the gaming machine comprising:

a game medium acceptor configured to accept a game medium with a monetary value which establishes a credit balance for a player;

a bet input device configured to receive a bet whose amount is designated by the player based on the credit balance;

a symbol display device configured to variably display and rearrange a plurality of symbols including one or more trigger symbols;

a storage device; and a controller being programmed to, as a result of the player's bet, execute:

(a1) running the normal game in which the symbols are rearranged on the symbol display device;

(a2) determining whether or not a trigger condition which is a condition for rearranging a predetermined number or more of the trigger symbols on the symbol display device is established, in the normal game;

(a3) if the trigger condition is determined as to be established, awarding a right to play the free game a predetermined number of times and randomly determining a payout rate for payouts obtainable in the free games;

(a4) running the free game a predetermined number of times;

(a5) awarding a payout which is a product of a payout obtained in the free game of the step (a4) multiplied by the payout rate randomly determined in step (a3); and (a6) paying out other game medium to the player or establishing the credit balance according to the payout, wherein in the step (a3), the payout rate random determination is a roulette random determination such that a pointer moves on a plurality of areas circularly arranged, each corresponding to a payout rate and stops on a random area, and a payout rate corresponding to the area where the pointer has stopped is determined as the payout rate for the payout obtainable in the free game, the storage device stores a roulette effect table specifying a plurality of speeds and the timings of stopping, for the pointer which moves on the plurality of areas circularly arranged, each corresponding to a payout rate, and effect random determination is executed based on the roulette effect table, to determine the speed and the timing of stopping the pointer which moves on the plurality of areas circularly arranged, each corresponding to a payout rate.

4. The gaming machine according to claim 3, wherein, an area where the pointer stopped once is excluded from subsequent free game payout rate random determination.

5. The gaming machine according to claim 3, wherein, the areas corresponding to the plurality of payout rates are capable of being illuminated by the display device; and the areas are sequentially and repetitively turned on and turned off, so as to provide an effect such that the pointer moves among the circularly arranged areas corresponding to the plurality of payout rates, respectively.

6. The gaming machine according to claim 5, wherein, effects are given to the way of stopping the roulette by varying the period of lighting each area.

7. The gaming machine according to claim 3, wherein, when the pointer stops at any of the circularly arranged areas corresponding to the plurality of payout rates, respectively, a visual effect is provided such that a Ninja star sticks on to the area where the pointer stopped, and the payout rate corresponding to that area where the pointer stopped is displayed on the display device.

8. A gaming machine configured to run a normal game and a free game which develops from the normal game, the gaming machine comprising:

a game medium acceptor configured to accept a game medium with a monetary value which establishes a credit balance for a player;

a bet input device configured to receive a bet whose amount is designated by the player based on the credit balance;

a symbol display device configured to variably display and rearrange a plurality of symbols including one or more trigger symbols;

a controller being programmed to, as a result of the player's bet, execute:

(a1) running the normal game in which the symbols are rearranged on the symbol display device;

(a2) determining whether or not a trigger condition which is a condition for rearranging a predetermined number or more of the trigger symbols on the symbol display device is established, in the normal game;

(a3) if the trigger condition is determined as to be established, awarding a right to play the free game a predetermined number of times and randomly determining a payout rate for payouts obtainable in the free games;

(a4) running the free game a predetermined number of times;

(a5) awarding a payout which is a product of a payout obtained in the free game of the step (a4) multiplied by the payout rate randomly determined in step (a3); and (a6) paying out other game medium to the player or establishing the credit balance according to the payout, wherein, in the step (a3), preliminary payout rate random determination is executed a certain number of times according to the number of trigger symbols rearranged on the symbol display device in the step (a2), and a value resulting from addition involving each preliminary payout rate determined by the preliminary payout rate random determination is determined as the payout rate for the payout obtainable in the free game.

* * * * *